US010988891B2

(12) United States Patent
Park et al.

(10) Patent No.: US 10,988,891 B2
(45) Date of Patent: Apr. 27, 2021

(54) WASHING MACHINE

(71) Applicant: SAMSUNG ELECTRONICS CO., LTD., Suwon-si (KR)

(72) Inventors: Jun Hyun Park, Osan-si (KR); Geun Kang, Hwaseong-si (KR); Sung Jin Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 206 days.

(21) Appl. No.: 16/101,837

(22) Filed: Aug. 13, 2018

(65) Prior Publication Data

US 2018/0347101 A1 Dec. 6, 2018

Related U.S. Application Data

(63) Continuation of application No. 15/067,931, filed on Mar. 11, 2016, now Pat. No. 10,047,474.

(30) Foreign Application Priority Data

Mar. 13, 2015 (KR) ..... KR10-2015-0035191
Aug. 27, 2015 (KR) ..... KR10-2015-0120876

(51) Int. Cl.

| | |
|---|---|
| ***D06F 39/14*** | (2006.01) |
| ***D06F 29/00*** | (2006.01) |
| ***D06F 39/12*** | (2006.01) |
| ***D06F 31/00*** | (2006.01) |
| ***D06F 39/08*** | (2006.01) |
| *D06F 1/04* | (2006.01) |

(52) U.S. Cl.
CPC ..... *D06F 39/14* (2013.01); *D06F 29/00* (2013.01); *D06F 31/00* (2013.01); *D06F 39/088* (2013.01); *D06F 39/12* (2013.01); *D06F 1/04* (2013.01)

(58) Field of Classification Search
CPC ..... D06F 29/00; D06F 31/00; D06F 39/12; D06F 39/14; D06F 39/088
See application file for complete search history.

(56) References Cited

U.S. PATENT DOCUMENTS

| | | | |
|---|---|---|---|
| 3,026,699 | A | 3/1962 | Rhodes |
| 3,039,284 | A | 6/1962 | Shelton |
| 3,039,286 | A | 6/1962 | Shelton |
| 3,209,560 | A | 10/1965 | Shelton |
| 3,509,741 | A | 5/1970 | Morey |
| 3,575,020 | A | 4/1971 | Hubbard |
| 5,253,493 | A | 10/1993 | Ohashi |
| 7,296,443 | B2 | 11/2007 | Usherovich |

(Continued)

OTHER PUBLICATIONS

Corrected Notice of Allowability dated Apr. 30, 2018, issued in U.S. Appl. No. 15/067,931.

(Continued)

*Primary Examiner* — Joseph L. Perrin
(74) *Attorney, Agent, or Firm* — Staas & Halsey LLP

(57) ABSTRACT

Disclosed herein is a washing machine including a main body having a washing space and an opening through which clothes are inserted and withdrawn into and from the washing space, a door to open and close the opening, and a sub-washing unit to form a sub-washing space separate from the washing space and separably provided from the door. By such configuration, sub-washing may be efficiently performed, and space utilization may be improved.

14 Claims, 49 Drawing Sheets

(56) References Cited

U.S. PATENT DOCUMENTS

| | | | | |
|---|---|---|---|---|
| 2002/0134117 | A1 | 9/2002 | Arai | |
| 2005/0072194 | A1 | 4/2005 | Ryohke | |
| 2016/0102425 | A1* | 4/2016 | Scheckelhoff ..... | D06F 29/00 68/13 R |

OTHER PUBLICATIONS

Notice of Allowability dated Apr. 11, 2018, issued in U.S. Appl. No. 15/067,931.
Office Action dated Dec. 12, 2017, issued in U.S. Appl. No. 15/067,931.
Restriction Requirement dated Sep. 18, 2017, issued in U.S. Appl. No. 15/067,931.
U.S. Appl. No. 15/067,931, filed Mar. 11, 2016, Jun Hyun Park et al., Samsung Electronics Co., Ltd.

* cited by examiner

WASHING MACHINE

CROSS-REFERENCE TO RELATED APPLICATION

This application is a Continuation of U.S. Ser. No. 15/067,931 filed Mar. 11, 2016, which claims the priority benefit of Korean Patent Application Nos. 10-2015-0035191 and 10-2015-0120876, filed on Mar. 13, 2015 and Aug. 27, 2015, respectively in the Korean Intellectual Property Office, the disclosure of which is incorporated herein by reference.

BACKGROUND

1. Field

The present disclosure relates to a washing machine, and more particularly, to a washing machine having a structure capable of hand-washing.

2. Description of the Related Art

Generally, a washing machine is an apparatus which washes clothes using electricity, and types of the washing machine include a drum-type washing machine in which a rotary tub is horizontally disposed and clothes are washed by being lifted upward and lowered along an inner circumferential surface of the rotary tub when the rotary tub rotates back and forth with respect to a horizontal axis, and a vertical-axis washing machine in which a rotary tub having a pulsator therein is vertically disposed and clothes are washed using a water current generated by the pulsator when the rotary tub rotates back and forth with respect to a vertical axis.

The drum type washing machine includes a main body forming an exterior, a cylindrical tub installed in the main body to retain wash water, a drum rotatably installed in the tub to wash laundry, a driving motor disposed behind the tub to rotate the drum, and a door installed at a front surface of the main body. An inlet communicating with the drum is provided at at least a portion of the main body, and the door opens and closes the inlet.

Washing machines may also be classified as top-loading washing machines and front-loading washing machines according to their shape. The top-loading washing machine is a washing machine in which laundry may be inserted into a rotary tub through an opening provided at an upper surface of the washing machine. The front-loading washing machine is a washing machine in which laundry may be inserted into a rotary tub through an opening provided at a side surface of the washing machine. In general, agitator-type washing machines and vortex-type washing machines are top-loading washing machines, and the drum-type washing machines are front-loading washing machines.

However, washing ingrained dirt or partial stains on the clothes are difficult using the above washing processes of the washing machines. Since a washing machine generally has a washing space defined by a fixed tub and a rotary rub but does not have a space for hand-washing or separate washing, in this case, washing using the washing machine should be performed after a hand-washing or a separate washing outside of the washing machine. Also, additional wash water is required for this.

When hand-washing or separate washing is performed within the washing machine itself, a separate washing place is not required, and wash water which was used in the hand-washing or separate washing can be reused in a washing process of the washing machine, thereby saving wash water.

SUMMARY

It is an aspect of the present disclosure to provide a washing machine with a structure for hand-washing in which a space for hand-washing is formed.

It is another aspect of the present disclosure to provide a washing machine in which a structure for hand-washing is easily storable and usable.

According to an aspect of the present disclosure, a washing machine includes a main body having a washing space and an opening through which clothes are inserted and withdrawn into and from the washing space, a door to open and close the opening, and a sub-washing unit separably provided from the door to form a sub-washing space separate from the washing space.

The sub-washing unit may be provided to be movable between a first state of being restrained by the door and a second state of being separated from the door to enable sub-washing.

The sub-washing unit may be disposed at the opening at the second state.

The door may include a unit holding part to restrain the sub-washing unit by the door at the first state.

The unit holding part may include a control part provided at the door to be pressed by an external force and be movable back and forth, and a locking part to move by the back and forth movements of the control part to restrain one portion of the sub-washing unit.

The sub-washing unit may include a locking groove into which the locking part is inserted, and a locking seating part provided adjacent to the locking groove to be restrained by the locking part.

The unit holding part may include an insertion rail formed along an inner portion of the door to have one portion of the sub-washing unit inserted thereinto.

The unit holding part may include a holding lever disposed at one surface of the door to be rotatably provided, and may move between a locking position in which the holding lever comes in contact with one portion of the unit body to restrain the unit body and an unlocking position in which the holding lever rotates from the locking position to release the restraining of the unit body.

The unit holding part may include a sliding lever disposed at one surface of the door to be slidably provided, and may move between a locking position in which the sliding lever comes in contact with one portion of the unit body to restrain the unit body and an unlocking position in which the sliding lever slides and moves from the locking position to release the restraining of the unit body.

The unit holding part may include a first holding part provided at the door and a second holding part provided to have an attractive force with respect to the first holding part and provided at the sub-washing unit.

The first and second holding parts may include a magnetic body.

The sub-washing unit may include a unit hinge part rotatably coupled to a door hinge part provided at the door to be separably provided from the door hinge part.

The unit hinge part may be formed to surround at least a portion of the door hinge part to be rotatable with respect to the door hinge part and have one portion thereof opened to be separable from the door hinge part.

The sub-washing unit may be provided to be movable among a first state of being restrained by the door, a second state of relatively rotating from the door to enable sub-washing, and a third state of being separated from the door. The door may include a unit holding part to restrain the sub-washing unit by the door at the first state, and the unit holding part may include a locking part protruding from any one of the door and the sub-washing unit, and an interference part provided at the other one of the door and the sub-washing unit to be restrained by the locking part.

The washing machine may further include a water supply valve to control an introduction of wash water to the main body from the outside, and a water supply pipe having an inlet part connected to the water supply valve, a first outlet part to supply wash water introduced into the inlet part to the washing space, and a second outlet part to supply the wash water introduced into the inlet part to the sub-washing space, wherein the first and second outlet parts are configured to be branched from the inlet part.

According to another aspect of the present disclosure, a washing machine includes a washing machine main body having a main body in which an opening is formed and a door to open and close the opening, and a sub-washing unit to form a sub-washing space in which hand-washing is possible, wherein the sub-washing unit may be provided to be movable between a mounted state of being seated on the main body to enable hand-washing and a discharge state of moving from the mounted state to discharge wash water in the sub-washing space to an inner portion of the main body.

The sub-washing unit may include a sub-water drain port formed at one portion of the sub-washing space, and the sub-washing unit may rotate and move from the mounted state to the discharge state such that the wash water in the sub-washing space is discharged from the sub-washing unit through the sub-water drain port.

A position of the sub-water drain port may be lower at the discharge state than at the mounted state.

The main body may include a seating part on which one portion of the sub-washing unit is seated for the sub-washing unit to be at the mounted state and a rotation support part disposed at the seating part to support rotation of the sub-washing unit, and the sub-washing unit may include a unit body to form the sub-washing space and a rotary protrusion protruding from the unit body to be rotatably coupled to the rotation support part and provided for the sub-washing unit to rotate and move between the mounted state and the discharge state.

The sub-washing unit may include a seating flange formed along a circumference of the main body to be seated on the main body, and the main body may include a seating part on which a first portion of the seating flange is seated for the sub-washing unit to be at the mounted state, and an inclined seating part to which a second portion extending from the first portion corresponds and inclined downward from the seating part to rotate and move from the mounted state to the discharge state.

The sub-washing unit may be separably provided from the washing machine main body.

According to yet another aspect of the present disclosure, a washing machine includes a cabinet having a washing space and an opening through which clothes are inserted to and withdrawn from the washing space, a door having a mounting space in which one surface is concavely formed and to open and close the opening, and a sub-washing unit to form a sub-washing space separate from the washing space and provided to be mountable on the mounting space.

The sub-washing unit may be rotatably and separably provided with respect to the door.

The sub-washing unit may be provided to be movable among a first state of being mounted on the mounting space, a second state of rotating from the first state to form the sub-washing space, and a third state of being separated from the door.

The sub-washing unit may include a unit body having a first body rotatably provided at the door and a second body rotatably provided with respect to the first body.

The sub-washing unit may be configured such that the first and second bodies overlap each other at the first state and the first and second bodies are provided to be spaced apart from each other by a predetermined angle therebetween at the second state to form the sub-washing space.

The unit body may include a unit hinge part formed at the first body to be rotatably provided with respect to the door, and a unit mounting part provided to be coupleable to a coupling part formed at the cabinet and formed at the second body for the sub-washing unit to maintain the second state.

The unit body may include a body rotation part formed between the first body and the second body and provided for the second body to relatively rotate with respect to the first body, and the body rotation part may be disposed lower than the unit hinge part and the unit mounting part when the sub-washing unit is at the second state.

The unit body may include an edge part bent along at least a partial circumference of at least one of the first and second bodies.

The unit body may include a sub-water drain port formed at the first body and provided to drain wash water of the sub-washing space.

The washing machine may further include a unit holding part to restrain the sub-washing unit by the door when the sub-washing unit is at the first state.

The unit holding part may include a control part provided at the door to be pressed by an external force and be movable back and forth, and a locking part to move by the back and forth movements of the control part and provided to restrain one portion of the sub-washing unit.

The unit holding part may include a holding lever disposed at one surface of the door to be rotatably provided, and may move between a locking position in which the holding lever comes in contact with one portion of the unit body to restrain the unit body and an unlocking position in which the holding lever rotates from the locking position to release the restraining of the unit body.

The unit holding part may include a restoring elastic member provided on a rotation axis of the holding lever to generate an elastic force in the circumferential direction with respect to the rotation axis in order to restore the unit holding part to the locking position from the unlocking position.

The unit holding part may include a sliding lever disposed at one surface of the door to be slidably provided, and may move between a locking position in which the sliding lever comes in contact with one portion of the unit body to restrain the unit body and an unlocking position in which the sliding lever slides and moves from the locking position to release the restraining of the unit body.

The unit holding part may include a first holding part provided at the door and a second holding part provided to have an attractive force with respect to the first holding part and provided at the sub-washing unit.

The first and second holding parts may include a magnetic body.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
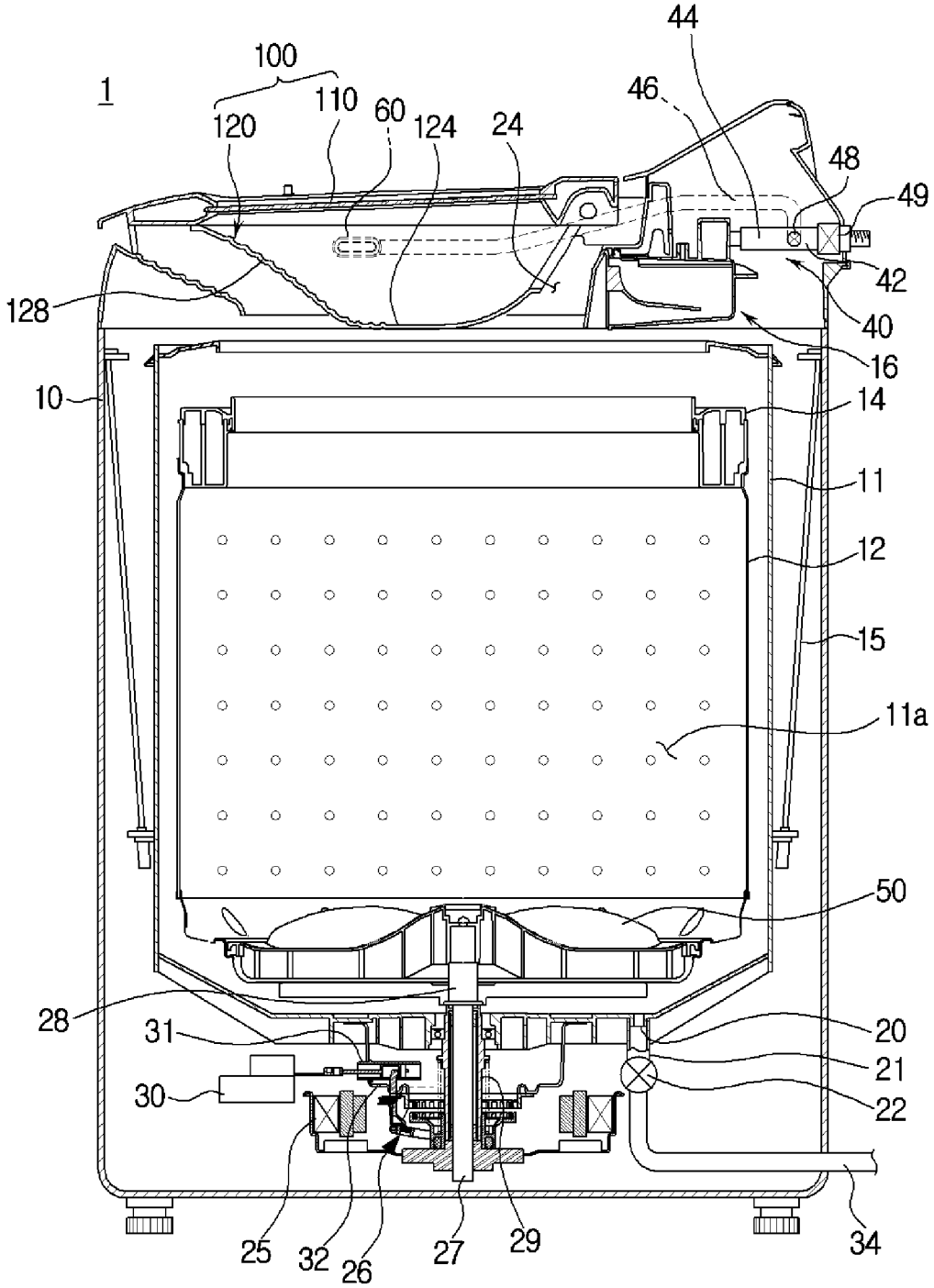
FIG. 1 is a cross-sectional view of a washing machine according to an embodiment of the present disclosure.

Embodiments to be described in this specification and configurations illustrated in the drawings are merely preferred embodiments of the invention disclosed herein, and various modified embodiments that may substitute for the embodiments and the drawings of this specification may be present at the time of applying this application.

In addition, like reference numerals or marks presented in each of the drawings of this specification represent parts or elements that substantially perform the same functions.

In addition, terms used in this specification are used for describing the embodiments, and are not intended to limit and/or restrict the invention disclosed herein. Singular expressions include plural expressions unless clearly meaning otherwise in the context. In this specification, terms such as "include" or "have" are to designate that features, numbers, steps, operations, elements, parts described in this specification or combinations thereof are present, and are not for excluding a presence or a possibility of adding one or more other features, numbers, steps, operations, elements, parts or combinations thereof in advance.

In addition, although terms including ordinals such as "first" and "second" used in this specification may be used to describe various elements, the elements are not limited by the terms, and the terms are used only for a purpose of distinguishing one element from another element. For example, a first element may be referred to as a second element and similarly, a second element may also be referred to as a first element while not departing from the scope of the present disclosure. The term "and/or" includes a combination of a plurality of related described items or any one item among the plurality of related described items.

Hereinafter, embodiments according to the present disclosure will be described in detail with reference to the accompanying drawings.

FIG. 1 is a cross-sectional view of a washing machine according to an embodiment of the present disclosure.

As illustrated in FIG. 1, a washing machine 1 may include a washing machine main body having a main body 10 forming an opening 24 and a door 110 to open and close the opening 24. Also, the washing machine 1 includes a fixed tub 11 disposed inside the main body 10 to retain wash water, a rotary tub 12 rotatably disposed in the fixed tub 11, and a pulsator 50 disposed inside the rotary tub 12 to generate a water current.

The opening 24 is formed at an upper portion of the main body 10 to allow the laundry to be inserted into the rotary tub 12. The opening 24 may be opened and closed by the door 110 installed at the upper portion of the main body 10. The fixed tub 11 may be supported by a suspension device 15 within the main body 10.

A water supply device 40 for supplying wash water to the fixed tub 11 and a sub-washing unit 120 is installed at an upper portion of the fixed tub 11. The water supply device 40 will be described later.

The rotary tub 12 is formed in a cylindrical shape having an open upper portion and has a plurality of drainage holes 13 formed on the lateral surface thereof. A balancer 14 may be mounted to an upper portion of the rotary tub 12 to allow the rotary tub 12 to stably rotate at high speed.

A motor 25 to generate driving force to rotate the rotary tub 12 and the pulsator 50 and a power switching device 26 to simultaneously or selectively transfer the driving force generated by the motor 25 to the rotary tub 12 and the pulsator 50 are installed at an outer lower portion of the fixed tub 11.

A hollow type spin-drying shaft 29 may be coupled to the rotary tub 12, and a washing shaft 27 installed in a hollow portion of the spin-drying shaft 29 may be coupled to the pulsator 50 through a washing shaft coupling unit 28. The motor 25 may simultaneously or selectively transfer the driving force to the rotary tub 12 and the pulsator 50 in accordance with a vertical movement of the power switching device 26.

The power switching device 26 may include an actuator 30 to generate driving force for power switching, a rod unit 31 to rectilinearly move in accordance with the movement of the actuator 30, and a clutch unit 32 connected to the rod unit 31 to rotate in accordance with the movement of the rod unit 31.

A drain port 20 is formed at the bottom of the fixed tub 11 to discharge wash water retained in the fixed tub 11, and a first drainpipe 21 is connected to the drain port 20. A drain valve 22 for controlling draining may be installed at the first drainpipe 21. An outlet of the drain valve 22 may be connected to a second drainpipe 34 for discharging wash water to the outside.

Figure 2:
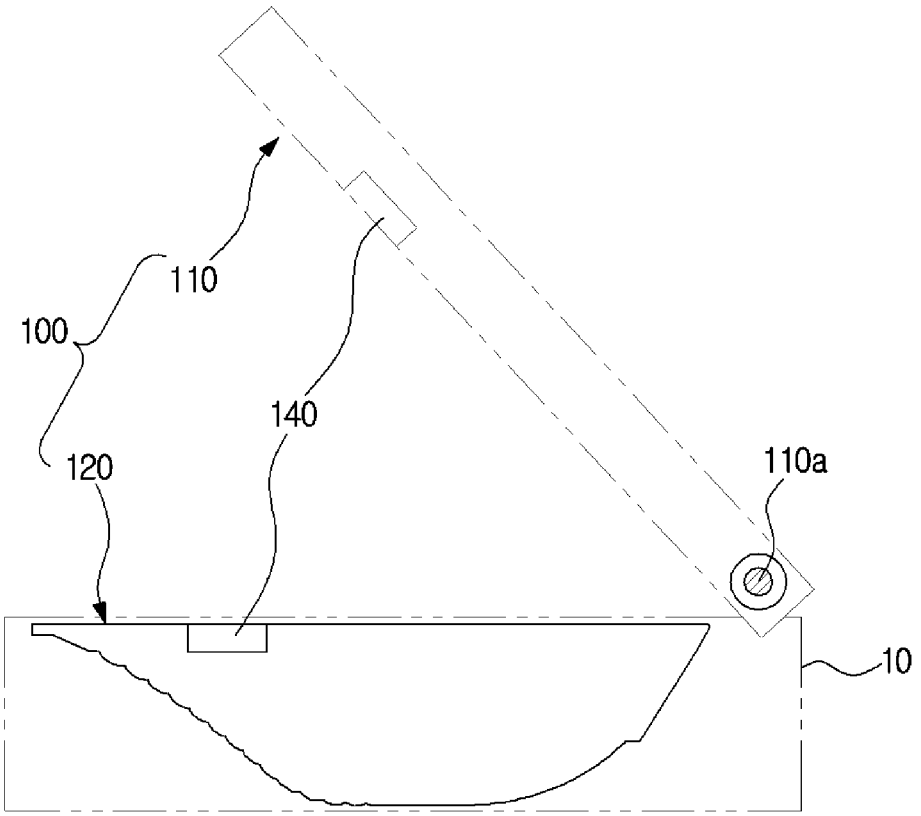
FIG. 2 is a view briefly illustrating a partial configuration of the washing machine according to the embodiment of the present disclosure.

FIG. 2 is a view briefly illustrating a partial configuration of the washing machine according to the embodiment of the present disclosure.

A door assembly 100 may include the door 110 and the sub-washing unit 120.

The door 110 is disposed at one portion of the main body 10 and configured to open and close the opening 24. The door 110 may be rotatably provided with respect to a door rotation unit 110*a* provided at the main body 10.

The sub-washing unit 120 is provided to enable separate hand-washing. The sub-washing unit 120 has a sub-washing space 120*a* to be described below to allow separate hand-washing. The sub-washing unit 120 may be separably coupled to the door 110. Specifically, a unit holding part 140 may be disposed at the door 110 and the sub-washing unit 120 such that the sub-washing unit 120 may be separably provided from the door 110. Also, the sub-washing unit 120 is seated on the main body 10 when being used such that a user may perform sub-washing such as hand-washing.

The sub-washing unit 120 may be separably provided from the door 110. Specifically, by the unit holding part 140, the sub-washing unit 120 may be separably provided from the door 110. Although it will be described in detail later, by the above configuration, the sub-washing unit 120 may move between a first state of being restrained by the door 110 and a second state of being separated from the door 110.

Figure 3:
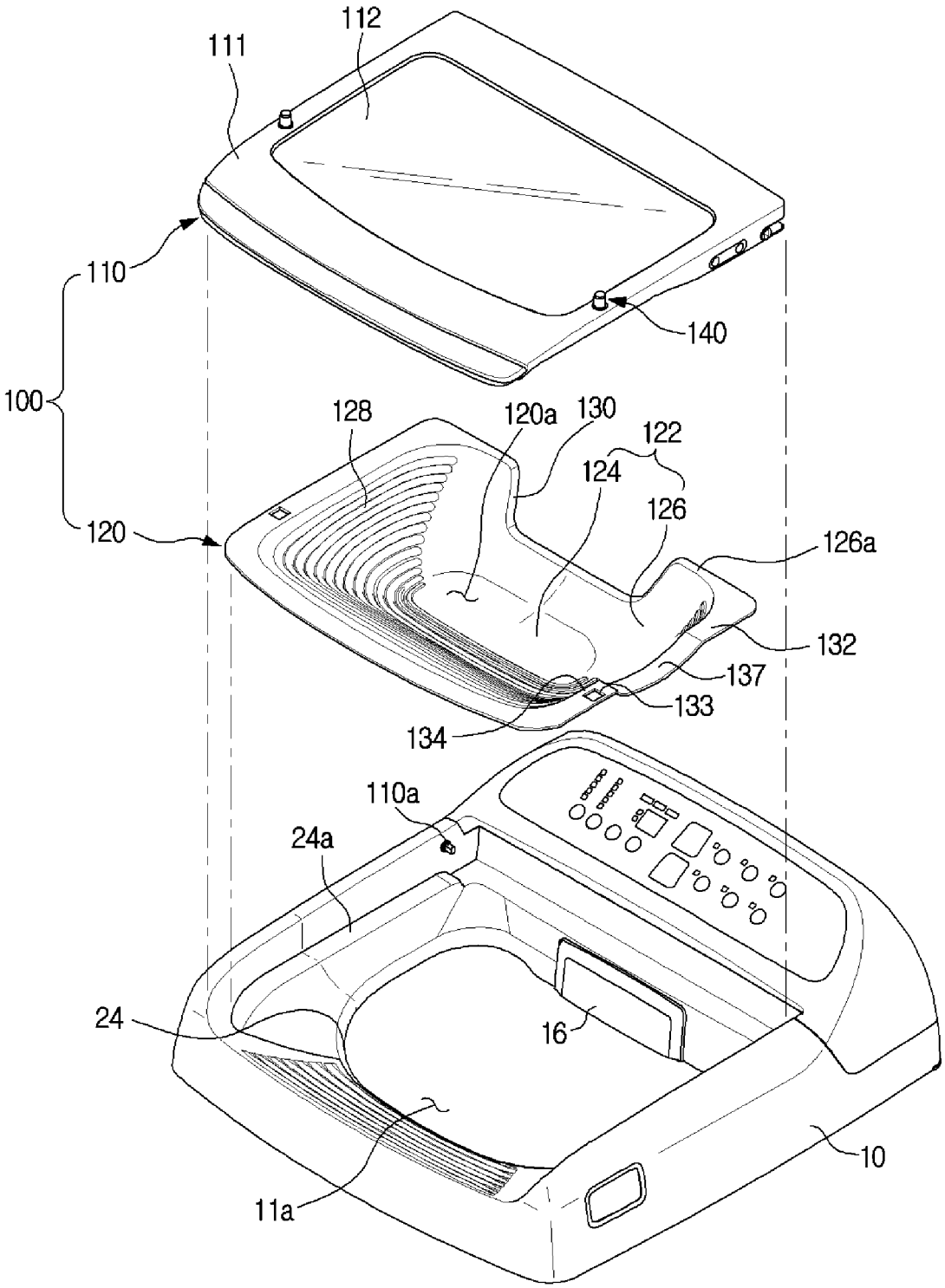
FIG. 3 is an exploded perspective view of a door assembly of the washing machine according to the embodiment of the present disclosure.
Figure 4:
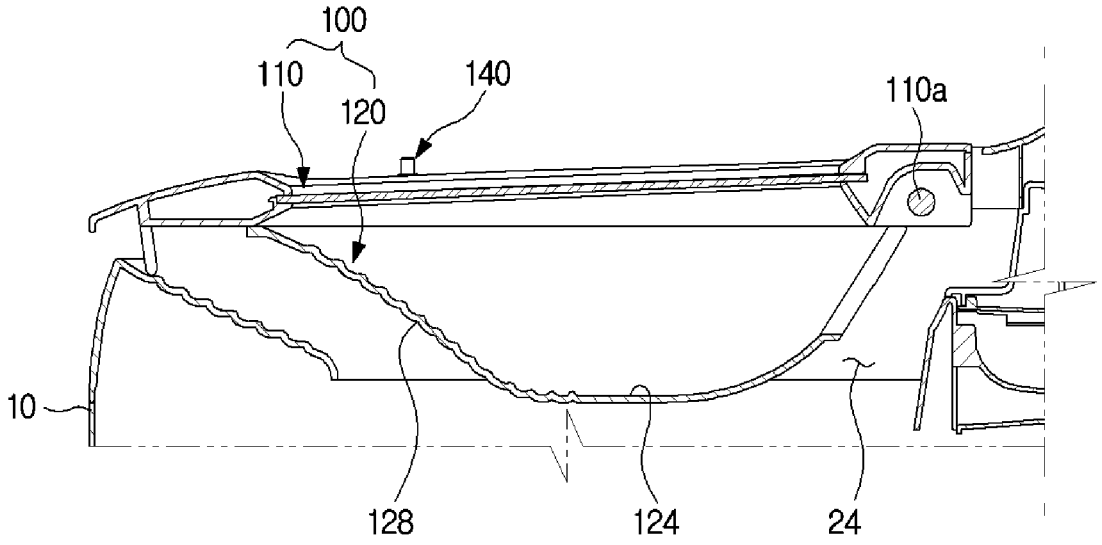
FIG. 4 is a cross-sectional view of the door assembly and a configuration in the vicinity of the door assembly of the washing machine according to the embodiment of the present disclosure.

FIG. 3 is an exploded perspective view of a door assembly of the washing machine according to the embodiment of the present disclosure, and FIG. 4 is a cross-sectional view of the door assembly and a configuration in the vicinity of the door assembly of the washing machine according to the embodiment of the present disclosure.

The door assembly 100 may be disposed at the opening 24.

The door assembly 100 may include the door 110 and the sub-washing unit 120. The door 110 and the sub-washing unit 120 may be referred to as a main door 110 and a hand-washing case 120, respectively.

The door 110 is disposed at one portion of the main body 10 and configured to open and close the opening 24. The door 110 may include a transparent member 112 such that the inside of the washing machine is visible even when the opening 24 is closed by the door 110. The transparent member 112 may be disposed at a door frame 111.

The sub-washing unit 120 has the sub-washing space 120*a* to allow separate hand-washing. The sub-washing space 120*a* is isolated from a main washing space 11*a*, which is defined by the fixed tub 11 and the rotary tub 12, to allow washing.

Since the main washing space 11*a* is isolated from the sub-washing space 120*a*, independent washing may respectively be performed in each of the spaces. In addition, washing may be performed in the main washing space 11*a* and the sub-washing space 120*a* separately or simultaneously.

The sub-washing unit 120 may include a unit body 122 formed of a bottom portion 124 and a side portion 126.

The sub-washing space 120*a* of the sub-washing unit 120 is defined by the unit body 122. The bottom portion 124 which is an element that determines a depth of the sub-washing space 120*a* may have a flat or curved surface. The side portion 126 is formed to be gradient toward the bottom portion 124. The bottom portion 124 and the side portion 126 are configured to have a nearly concave sub-washing space 120*a*, and thus separate washing may be performed in the sub-washing space 120*a* by receiving wash water.

The sub-washing unit 120 may include friction protrusions 128.

The friction protrusions 128 may be provided at the unit body 122 to facilitate sub-washing. In an embodiment of the present disclosure, the friction protrusions 128 are provided at the side portion 126. However, embodiments of the present disclosure are not limited thereto, and the friction protrusions 128 may be provided at any inner surface of the unit body 122. The friction protrusions 128 serve to efficiently remove contaminants from clothes by increasing friction force between clothes and the friction protrusions 128 during hand-washing. According to the embodiment of the present disclosure, the friction protrusions 128 protrude from the inner surface of the sub-washing unit 120. As illustrated herein, a plurality of friction protrusions 128 may be disposed to be parallel to each other. However, the shape and alignment of the friction protrusions 128 are not limited thereto.

The sub-washing unit 120 may include a sub-water drain port 130.

The sub-water drain port 130 is configured to drain wash water used during washing in the sub-washing space 120*a*. The sub-water drain port 130 may have a hole shape, include a separate opening/closing member, and be disposed at the bottom portion 124 of the sub-washing space 120*a*. According to the embodiment of the present disclosure, the sub-water drain port 130 is disposed at the side portion 126 of the unit body 122. As the sub-washing unit 120, retaining wash water in the sub-washing space 120*a*, is tilted during rotation, and the wash water may be discharged through the sub-water drain port 130.

The sub-water drain port 130 may be formed at a portion of the unit body 122 to be lower than an upper end portion 126*a* of an adjacent portion of the unit body 122. That is, the sub-water drain port 130 may be formed at the unit body 122 to be recessed below the upper end portion 126*a* of the unit body 122. However, the shape of the sub-water drain port 130 is not limited thereto, and the sub-water drain port 130 may have any shape so long as wash water retained in the sub-washing space 120*a* is discharged when the sub-washing unit 120 is tilted.

The sub-washing unit 120 may include a seating flange 132.

The seating flange 132 may be formed along the circumference of the upper end of the sub-washing unit 120 in a flange shape and may be seated on the main body 10. That is, the seating flange 132 may be formed in a flange shape along the upper end of the unit body 122.

A seating portion 24*a* that protrudes from the circumference of the opening 24 may be formed at the inner surface of the opening 24 of the main body 10. The seating flange 132 is configured to be seated on the seating portion 24*a*. As the seating flange 132 is mounted on the seating portion 24*a*, the sub-washing unit 120 may be seated on the main body 10.

Referring to FIGS. 1 to 4, the washing machine 1 according to the embodiment of the present disclosure may include the water supply device 40 to supply water into the main washing space 11*a* and the sub-washing space 120*a*. The water supply device 40 may include a water supply pipe 42, a main water supply pipe 44, a sub-water supply pipe 46, and a switching unit 49.

One end of the water supply pipe 42 may be connected to the water supply valve 18, and the other end thereof may be connected to the switching unit 49. The water supply pipe 42 is configured to transport wash water supplied from the water supply valve 18 to the switching unit 49.

The main water supply pipe 44 may be provided to supply water into the main washing space 11*a*. One end of the main water supply pipe 44 may be connected to a detergent feed device 16, and the other end thereof may be connected to the switching unit 49.

The sub-water supply pipe 46 may be provided to supply water into the sub-washing space 120*a* of the sub-washing unit 120. One end of the sub-water supply pipe 46 may be connected to a sub-water supply port 60, and the other end thereof may be connected to the switching unit 49.

The switching unit 49 is configured to selectively supply wash water received from the water supply pipe 42 to the main water supply pipe 44 or the sub-water supply pipe 46. That is, the wash water is supplied to a washing space via at least one of the main water supply pipe 44 and the sub-water supply pipe 46 by controlling the switching unit 49. The switching unit 49 may include a 3-way valve.

In the embodiment of the present disclosure, the main water supply pipe 44 and the sub-water supply pipe 46 may be branched 48 from the water supply pipe 42 via the switching unit 49 interposed therebetween. However, the main water supply pipe 44 and the sub-water supply pipe 46 may be connected to the water supply valve 18, and wash water may be supplied by controlling the water supply valve 18. That is, the main water supply pipe 44 having one end connected to the detergent feed device 16 and the sub-water supply pipe 46 having one end connected to the sub-water supply port 60 may respectively be connected to the water supply valve 18 via the other ends thereof.

According to the embodiment of the present disclosure, wash water is selectively supplied to any one of the main water supply pipe 44 and the sub-water supply pipe 46. However, wash water may also be supplied to both of the main water supply pipe 44 and the sub-water supply pipe 46 simultaneously. In addition, wash water may be supplied via the sub-water supply pipe 46 regardless of the position of the sub-washing unit 120. When the sub-washing unit 120 is on the opening 24, wash water supplied via the sub-water supply pipe 46 may be retained in the sub-washing unit 120. Also, even when the sub-washing unit 120 is spaced apart from the opening 24, a user may supply wash water via the sub-water supply pipe 46 for washing clothes or hands of the user.

The sub-water supply port 60 may be configured to communicate with the sub-water supply pipe 46. The sub-water supply port 60 may be provided at one portion of the sub-washing unit 120 to supply wash water into the sub-washing unit 120.

The sub-washing unit 120 includes a wash water inlet 137 corresponding to the sub-water supply port 60 such that wash water supplied from the sub-water supply port 60 is introduced into the sub-washing unit 120. The wash water inlet 137 may be formed at a portion of the unit body 122 to be lower than an upper end portion 126*a* of an adjacent portion of the unit body 122. That is, the wash water inlet 137 may be formed at the unit body 122 to be recessed below the upper end portion 126*a* of the unit body 122. However, the shape of the wash water inlet 137 is not limited thereto, and the wash water inlet 137 may have any shape so long as wash water is introduced into the sub-washing space 120*a* through the sub-water supply port 60 without being interfered with the unit body 122.

The sub-washing unit 120 may be formed of a thermoplastic resin. The sub-washing unit 120 may be formed of acrylonitrile-butadiene-styrene (ABS). However, the material used to form the sub-washing unit 120 is not limited thereto, and any material having impact resistance and rigidity suitable for hand-washing may also be used.

Figure 5:
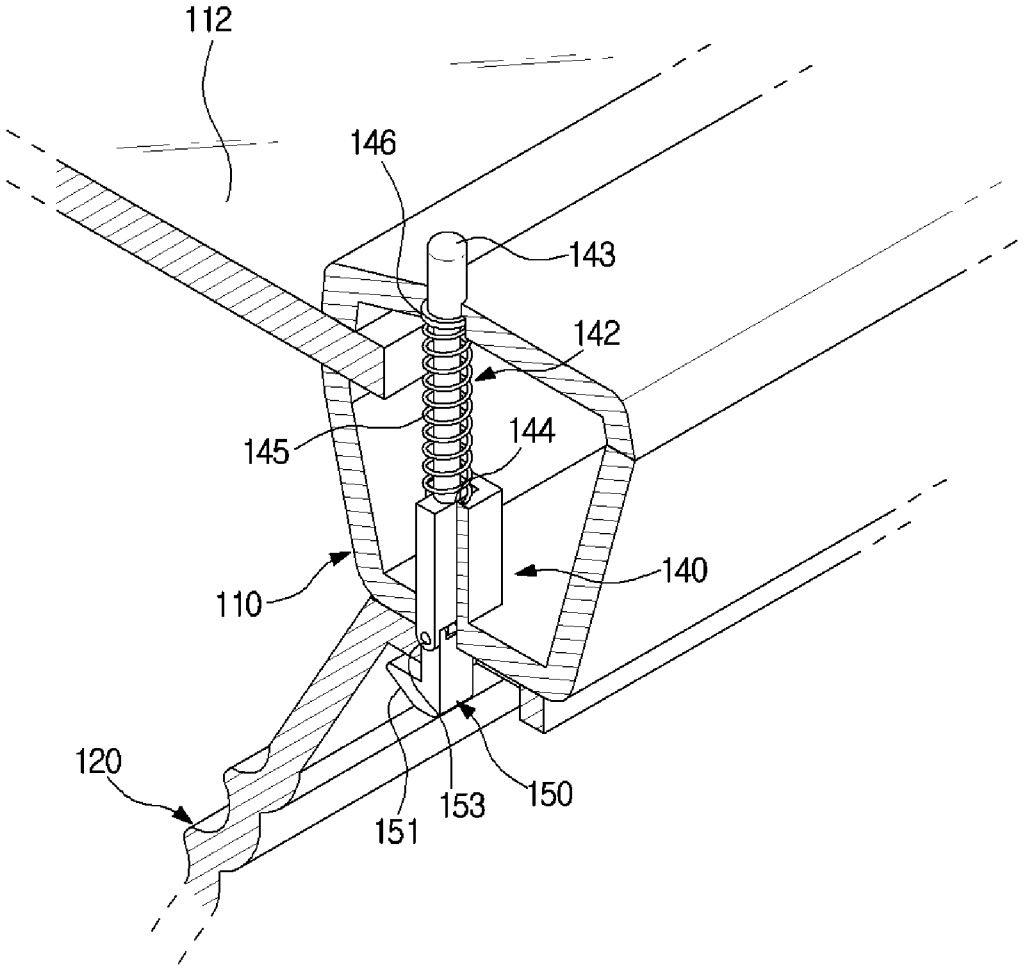
FIG. 5 is a view related to a unit holding part of the washing machine according to the embodiment of the present disclosure.
Figure 6:
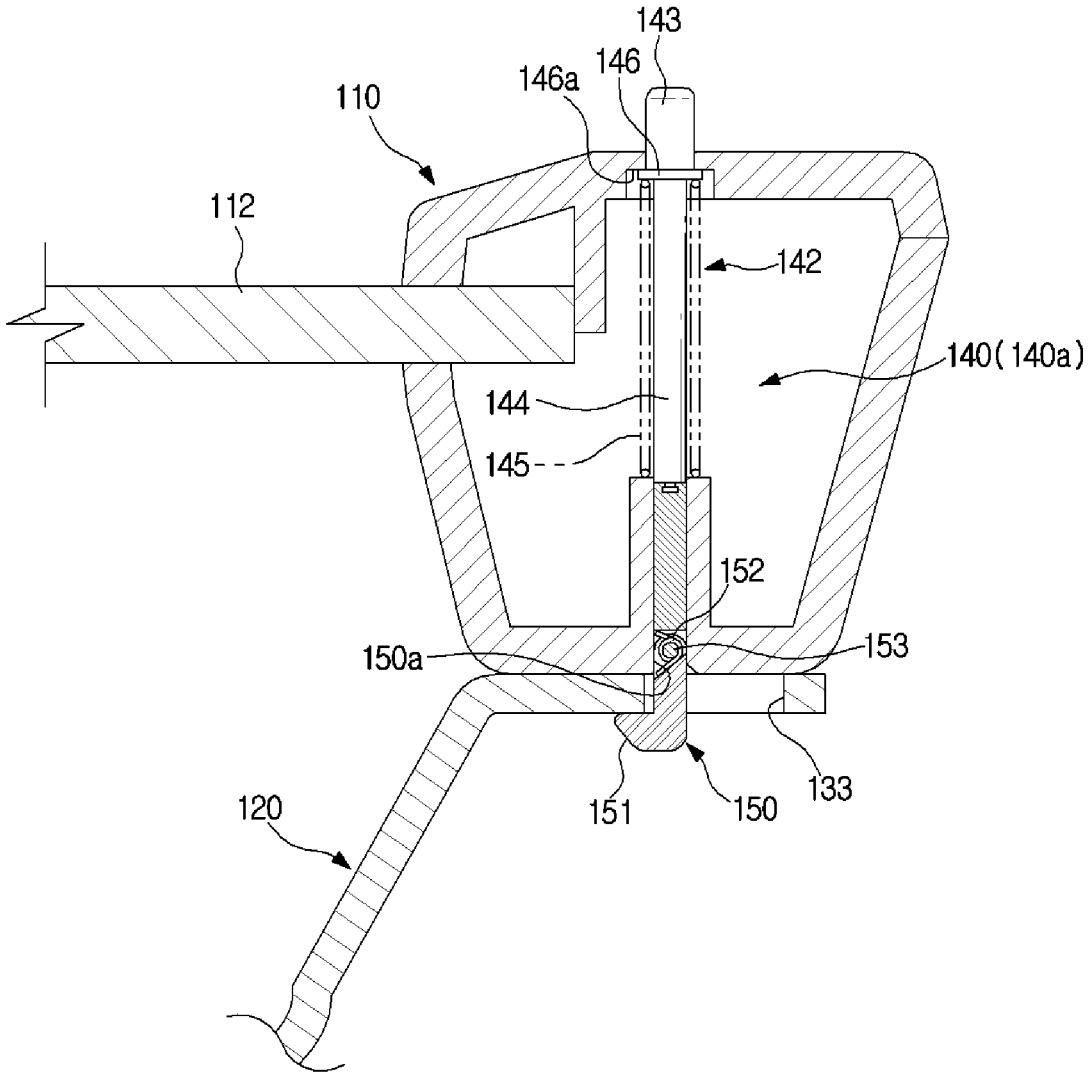
FIGS. 6 and 7 are views related to a movement of the unit holding part of the washing machine according to the embodiment of the present disclosure.
Figure 7:
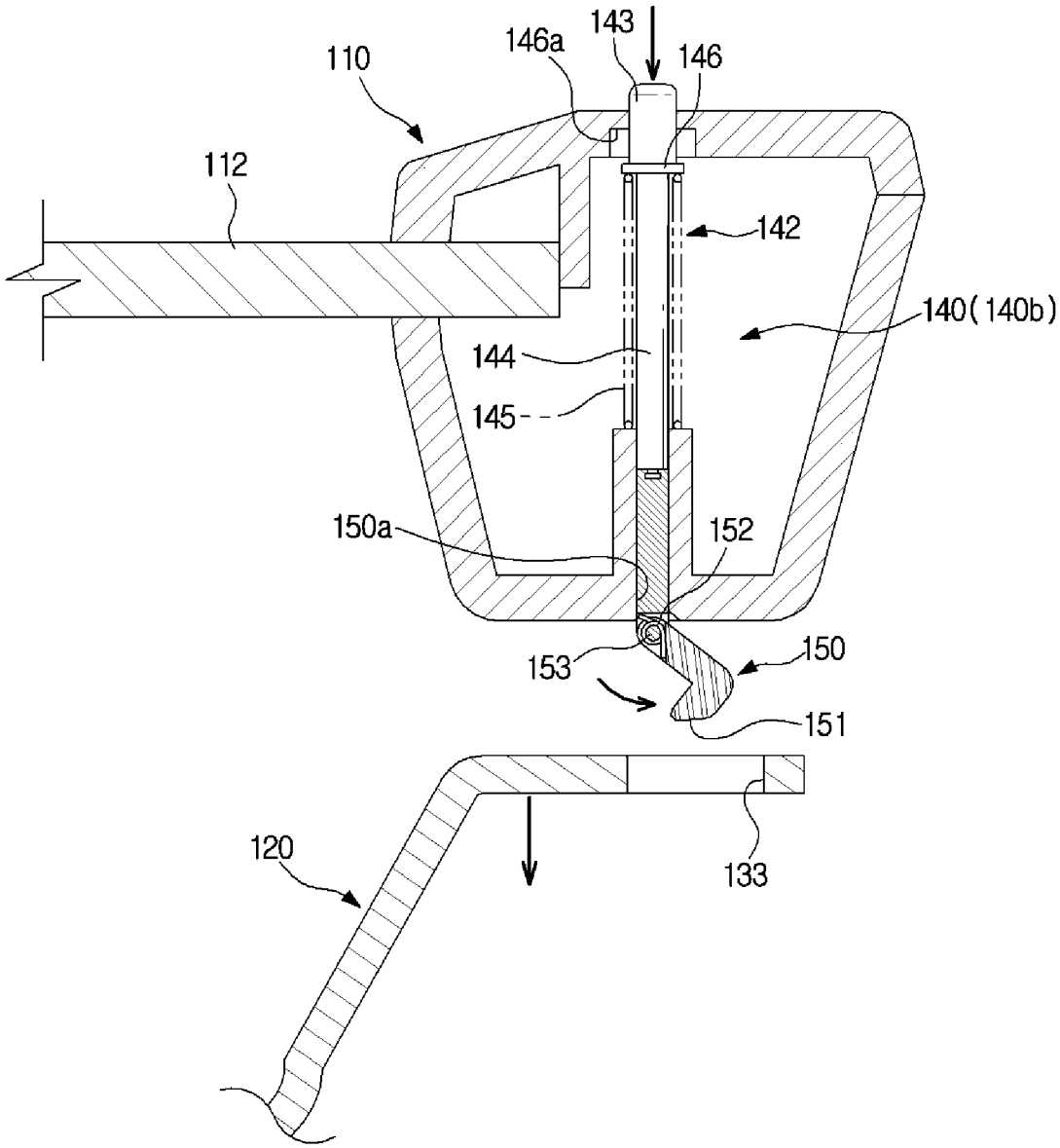

FIG. 5 is a view related to a unit holding part of the washing machine according to the embodiment of the present disclosure, and FIGS. 6 and 7 are views related to a movement of the unit holding part of the washing machine according to the embodiment of the present disclosure.

The door assembly 100 may include the unit holding part 140.

The unit holding part 140 may be provided at the door 110 such that the sub-washing unit 120 may be separably coupled to the door 110.

At least one unit holding part 140 is provided at the door 110 to enable the sub-washing unit 120 to be coupled to the door 110. The sub-washing unit 120 may be separated from the door 110 by manipulating the unit holding part 140. The unit holding part 140 is configured to move between a restraining position 140*a* of restraining the sub-washing unit 120 and a releasing position 140*b* of releasing the restraining of the sub-washing unit 120.

The unit holding part 140 may include a control part 142 and a locking part 150.

The control part 142 has at least one portion configured to protrude from the door 110 and is configured to move back and forth. The control part 142 is supported by a control elastic member 145 to move by an external force and be elastically restored when the external force is released.

The control part 142 includes a button part 143 having at least a portion exposed to the outside to be pressed by an external force, and a control body 144 extending from the button part 143.

A separation prevention flange 146 may be formed along a circumference of the control body 144 to prevent the control part 142 from being separated to outside of the door 110 at the control body 144.

The separation prevention flange 146 is configured to be locked to a separation prevention part 146*a* corresponding to the separation prevention flange 146 at one portion of the door 110 such that the control part 142 is not separated to the outside of the door 110.

The locking part 150 is configured to restrain one portion of the sub-washing unit 120. The locking part 150 may be formed in shape of a ring bent toward an inside of the door 110, and one portion of the sub-washing unit 120 may be restrained to the locking part 150. The locking part 150 may be inserted into a locking groove 133 formed at the seating flange 132 of the sub-washing unit 120 to restrain the seating flange 132. Specifically, the locking part 150 is inserted into the locking groove 133 to restrain a locking seating part 134 adjacent to the locking groove 133 on the seating flange 132.

As to be described later, a locking guide part 151 may be slantly formed at a ring-shaped end portion of the locking part 150 such that the locking part 150 is elastically deformed by a movement of the locking seating part 134 of the seating flange 132. The locking guide part 151 may be formed of an inclined surface tilted toward the inner portion of the door 110 with respect to a direction in which the sub-washing unit 120 is coupled to the door 110. By this configuration, the locking guide part 151 moves along the locking seating part 134 to elastically deform the locking part 150 when the sub-washing unit 120 is coupled to the door 110. When the locking seating part 134 moves to an inner portion of the locking part 150, the locking part 150 is elastically restored to restrain the locking seating part 134.

The locking part 150 may be rotatably provided at an end portion of the control part 142. Specifically, the locking part 150 may be provided to be rotatable with respect to the control part 142 around a locking hinge 153.

When the unit holding part 140 is at the restraining position 140*a*, rotation of the locking part 150 may be restrained by a rotation restraining part 150*a* formed at the door 110. That is, the locking hinge 153 that enables the locking part 150 to be rotatable with respect to the control part 142 is disposed at an inner portion of the rotation restraining part 150*a* for the rotation of the locking part 150 to be restrained by the rotation restraining part 150*a*.

In addition, when the unit holding part 140 is at the releasing position 140*b*, the locking part 150 may be detached from the rotation restraining part 150*a* and restraining of the locking part 150 may be released. That is, the locking hinge 153 that enables the locking part 150 to be rotatable with respect to the control part 142 is disposed at an outer portion of the rotation restraining part 150*a* for the restraining of the locking part 150 by the rotation restraining part 150*a* to be released.

The locking part 150 may include a locking elastic member 152 such that the locking part 150 may rotate in a direction of being separated from the locking groove 133 when the restraining of the locking part 150 by the rotation restraining part 150*a* is released.

When the unit holding part 140 is at the restraining position 140*a*, the control elastic member 145 supports the control part 142 in a tensioned state and the locking part 150 is restrained by the rotation restraining part 150*a*. When the unit holding part 140 is at the releasing position 140*b*, the control part 142 is pressed such that the control elastic member 145 supports the control part 142 in a compressed state. As the control part 142 moves downward, the releasing of the locking part 150 by the rotation restraining part 150*a* is released and the locking part 150 rotates in the direction of being separated from the locking groove 133 by the locking elastic member 152.

Hereinafter, a movement of the unit holding part 140 will be described.

First, a movement of separating the sub-washing unit 120 from the door 110 will be described with reference to FIGS. 6 and 7.

The unit holding part 140 is at the restraining position 140*a* when an external force is not acted thereon. That is, the locking part 150 is inserted into the locking groove 133 of the sub-washing unit 120 such that the seating flange 132 is restrained by the locking part 150.

Then, the unit holding part 140 moves to the releasing position 140*b* from the restraining position 140*a* when the external force is acted thereon. That is, when the control part 142 is pressed, the control elastic member 145 is compressed, and the locking part 150 moves downward. The locking part 150 rotates in the direction of being separated from the locking groove 133 by the locking elastic member 152, and restraining of the sub-washing unit 120 by the seating flange 132 is released.

After the sub-washing unit 120 is separated from the locking part 150, when the external force is released, the control part 142 is elastically restored by the control elastic member 145, and the locking part 150 is restrained by the rotation restraining part 150*a* such that the unit holding part 140 moves to be restored to the restraining position 140*a*.

A movement of coupling the sub-washing unit 120 to the door 110 will be described.

When the sub-washing unit 120 is moved toward the door 110 for the locking part 150 to be inserted into the locking groove 133, the locking seating part 134 of the seating flange 132 presses the locking guide part 151 of the locking part 150. The locking part 150 is pressed and elastically deformed by the locking seating part 134. When the locking seating part 134 passes through the locking guide part 151, the locking part 150 is elastically restored to restrain the locking seating part 134.

Then, a movement of the sub-washing unit 120 will be described.

Figure 8:
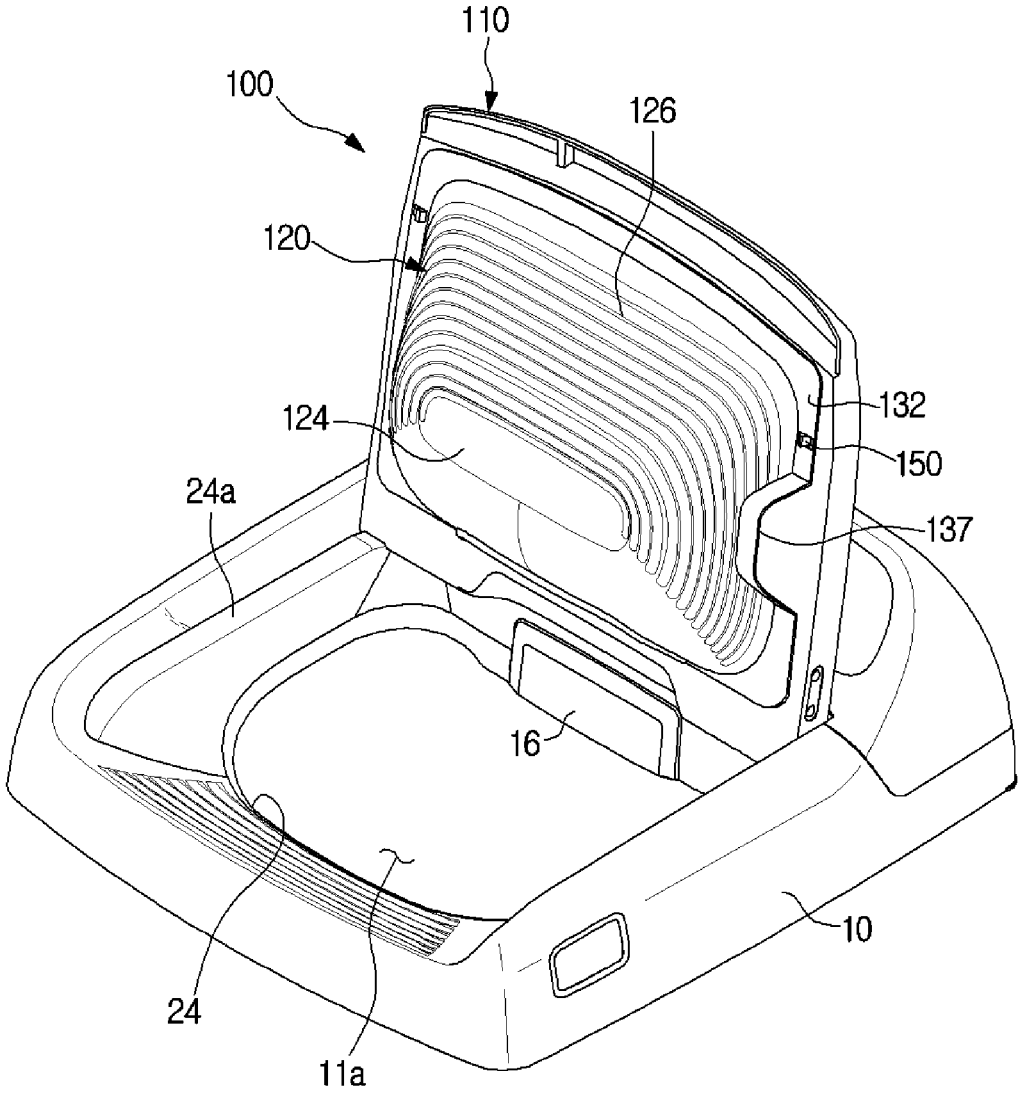
FIGS. 8, 9, and 10 are views related to a movement of a sub-washing unit according to the embodiment of the present disclosure.
Figure 9:
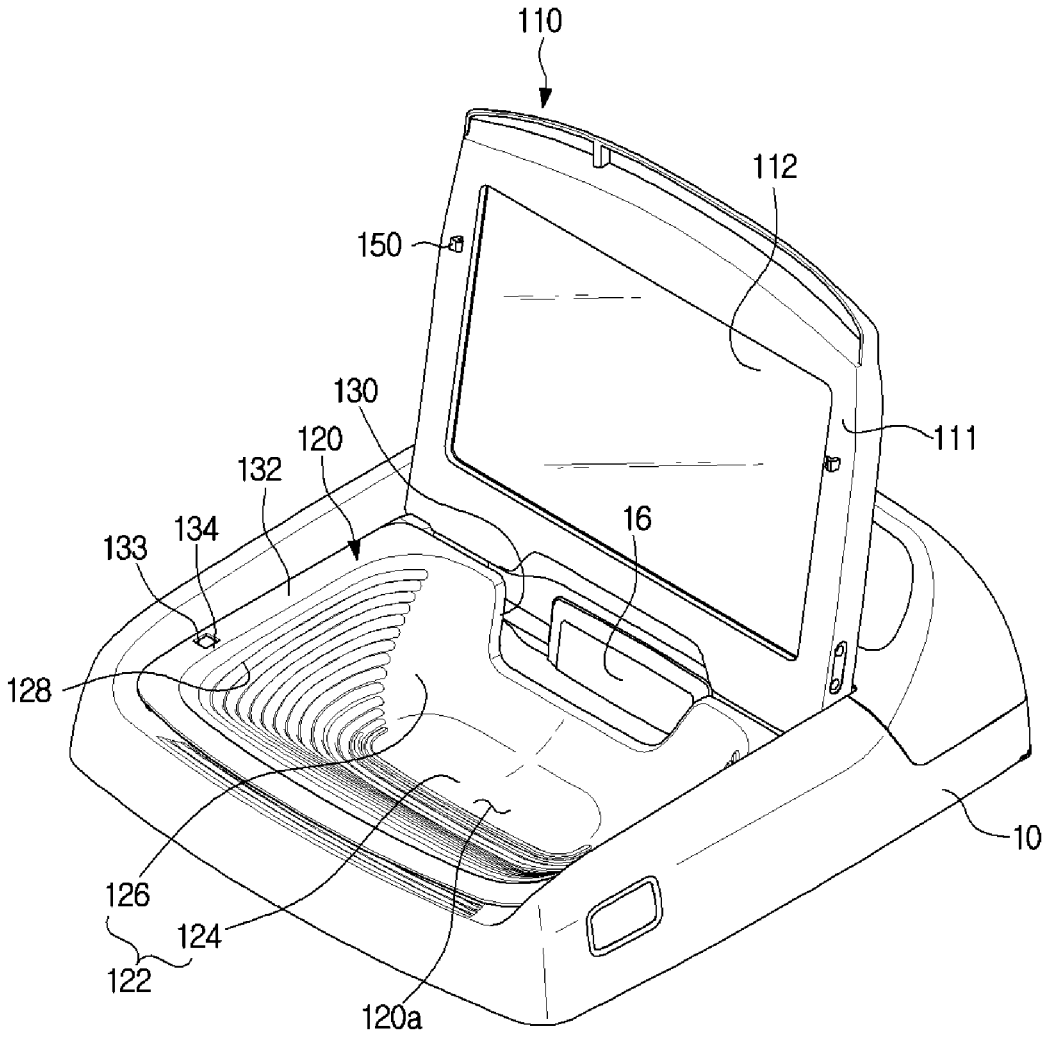
Figure 10:
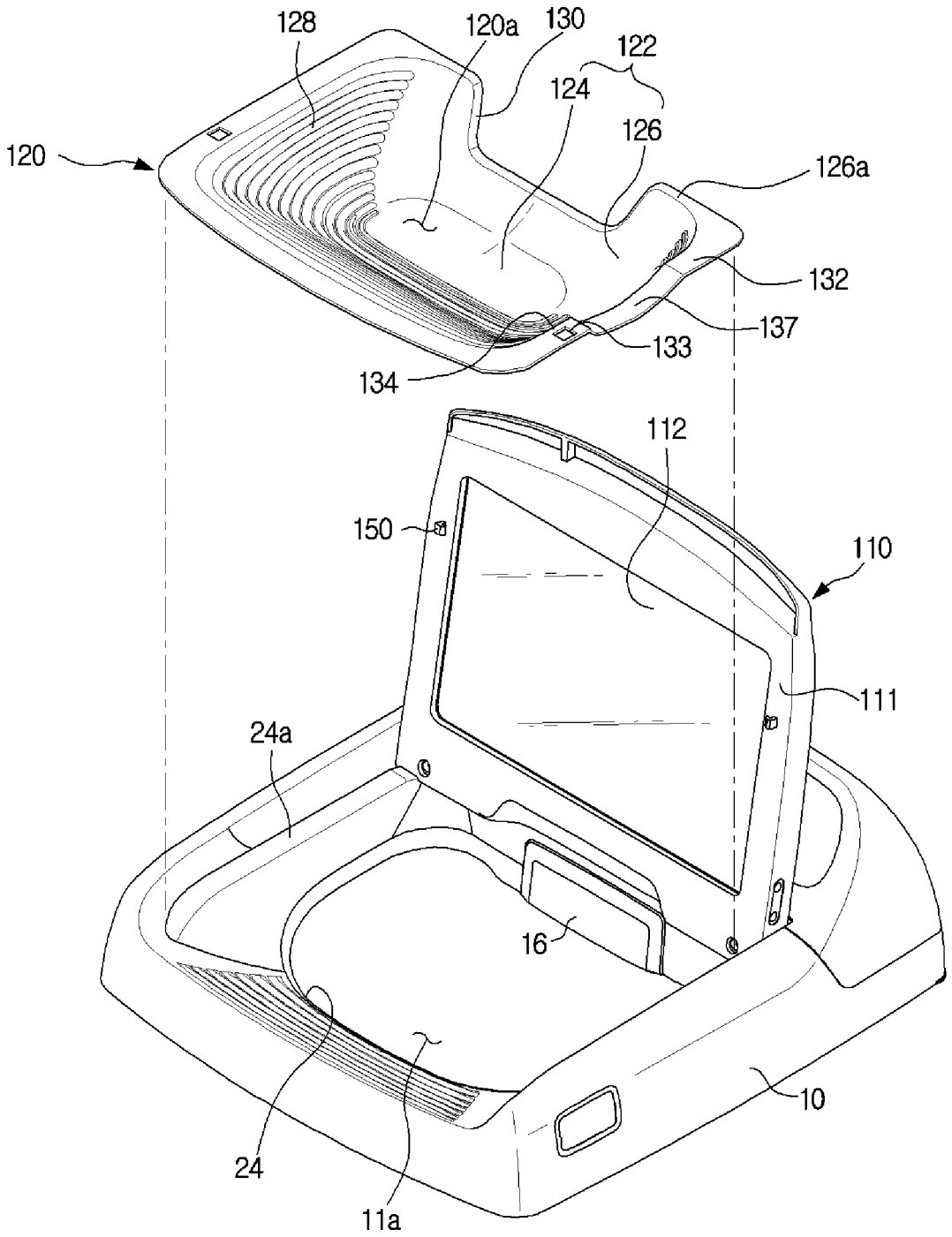

FIGS. 8, 9, and 10 are views related to a movement of a sub-washing unit according to the embodiment of the present disclosure.

Referring to FIGS. 8 and 9, the sub-washing unit 120 according to the embodiment of the present disclosure is configured to move between a first state of being restrained by the door 110 and a second state of being separated from the door 110 to enable sub-washing.

When the sub-washing unit 120 is at the first state, the sub-washing unit 120 may be restrained by the door 110 by the unit holding part 140 and rotate together with rotation of the door 110. Specifically, the unit holding part 140 is at the restraining position 140*a* while restraining the door 110.

When the sub-washing unit 120 is at the second state, restraining by the unit holding part 140 is released and the sub-washing unit 120 is separated from the door 110. Specifically, restraining by the door 110 by the unit holding part 140 is released and the unit holding part 140 is at the releasing position 140*b*. The seating flange 132 of the sub-washing unit 120 is seated on the seating portion 24*a* such that sub-washing is possible in the sub-washing space 120*a*.

Referring to FIG. 10, the sub-washing unit 120 may be configured to move to a third state of being separated from the door 110 and separated from the washing machine 1 separately from the first state and the second state. By separating the sub-washing unit 120 from the washing machine 1 using the above configuration, the opening 24 may be secured to be wider and the sub-washing unit 120 may be mounted on the door 110 or the main body 10 as needed.

Hereinafter, another embodiment of a washing machine of the present disclosure will be described.

Description of configurations overlapping with the above description will be omitted.

Figure 11:
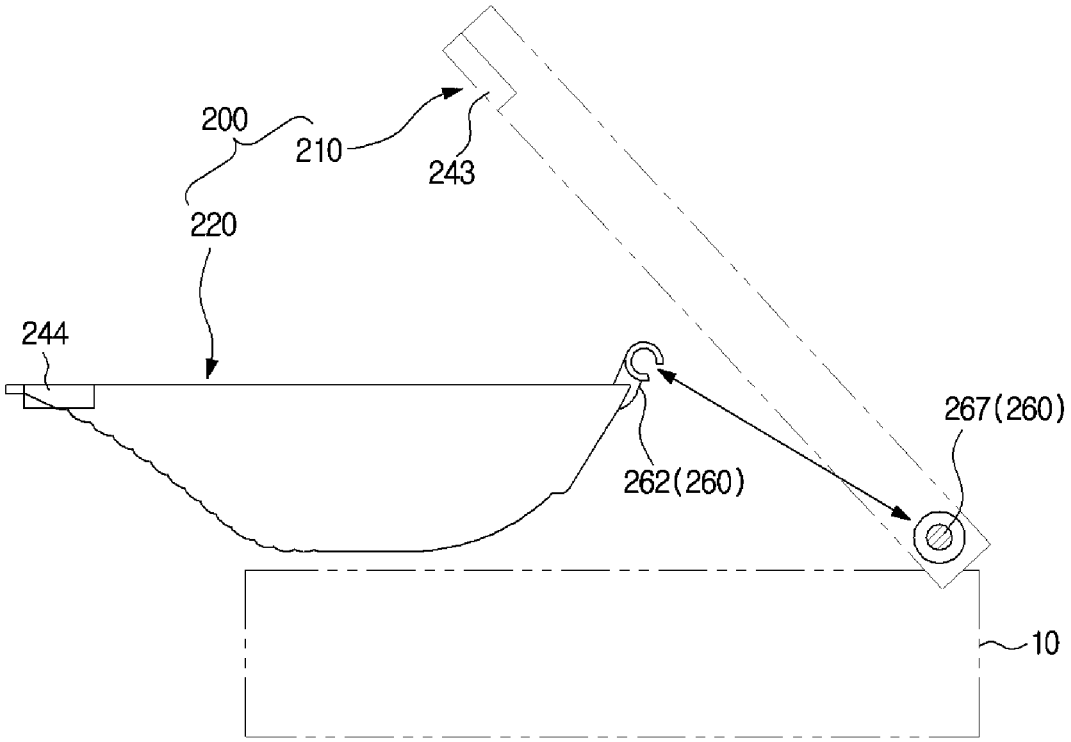
FIG. 11 is a view briefly illustrating a partial configuration of a washing machine according to another embodiment of the present disclosure.

FIG. 11 is a view briefly illustrating a partial configuration of a washing machine according to another embodiment of the present disclosure.

A door assembly 200 may include a door 210 and a sub-washing unit 220.

The door 210 is disposed at one portion of the main body 10 and configured to open and close the opening 24.

The sub-washing unit 220 is provided to enable separate hand-washing. The sub-washing unit 220 has a sub-washing space 120*a* to be described below to allow separate hand-washing. The sub-washing unit 220 may be separably coupled to the door 210. Specifically, a unit holding part 240 may be disposed at the door 210 and the sub-washing unit 220 such that the sub-washing unit 220 may be separably provided from the door 210. Also, the sub-washing unit 220 is seated on the main body 10 when being used such that a user may perform sub-washing such as hand-washing.

The sub-washing unit 220 may be rotatably configured by being coupled to hinge parts of the door 210 and the main body 10. Although it will be described in detail later, the sub-washing unit 220 may move among a first state of being restrained by the door 210, a second state of being spaced apart from the door 210 to enable sub-washing, and a third state of being separated from the door 210 by the above configuration.

Figure 12:
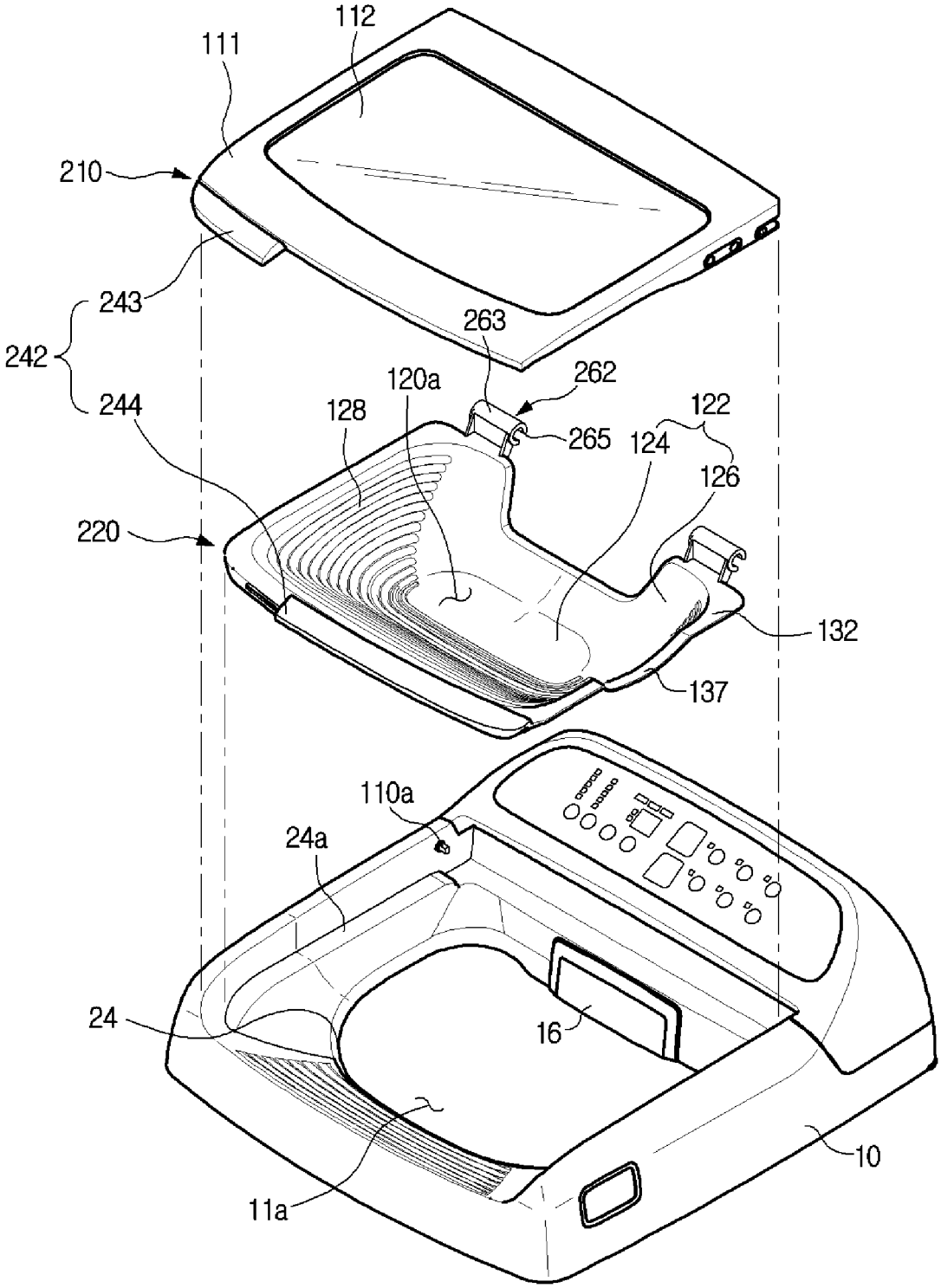
FIGS. 12 and 13 are exploded perspective views of a door assembly of the washing machine according to another embodiment of the present disclosure.
Figure 13:
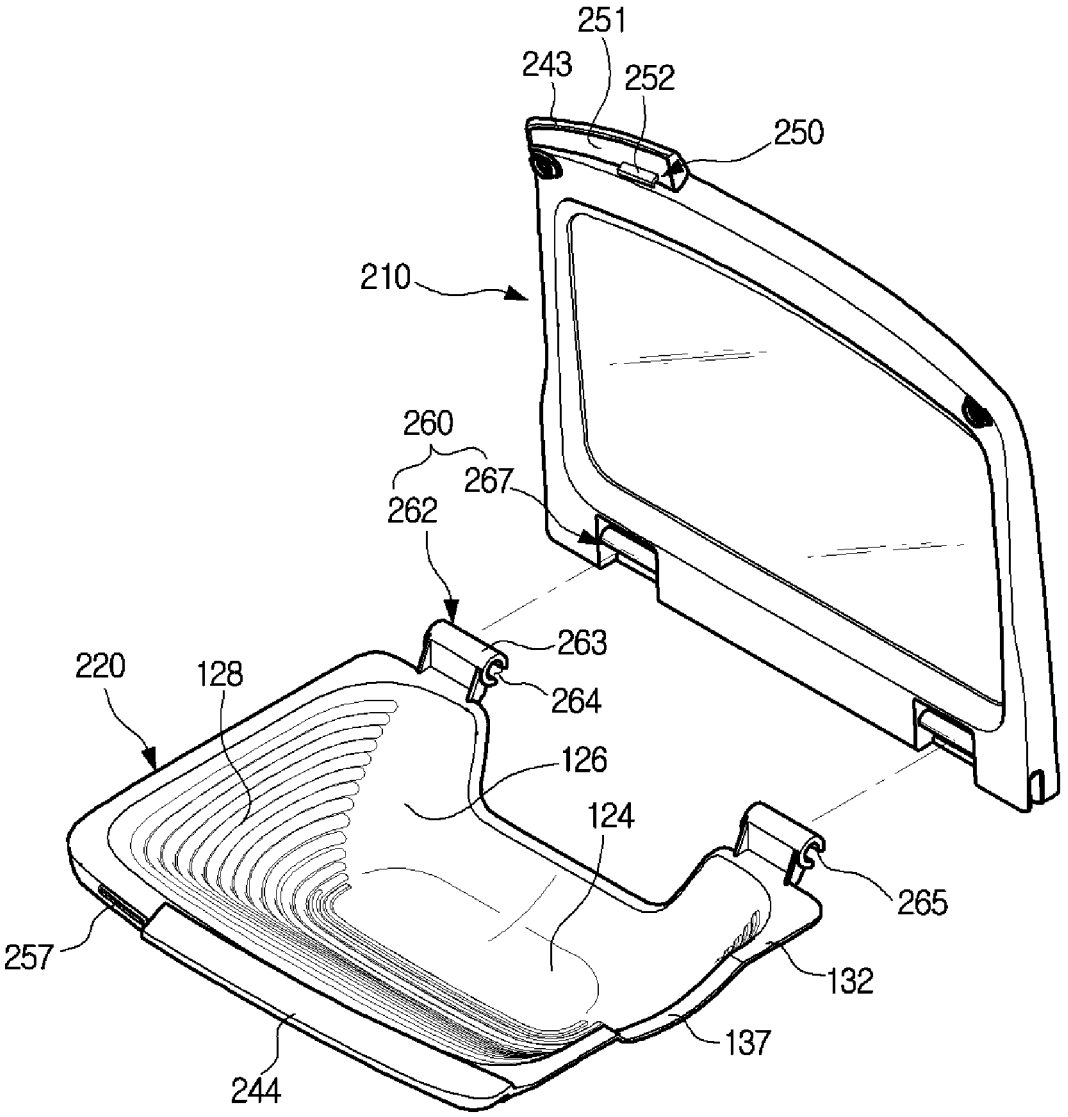
Figure 14:
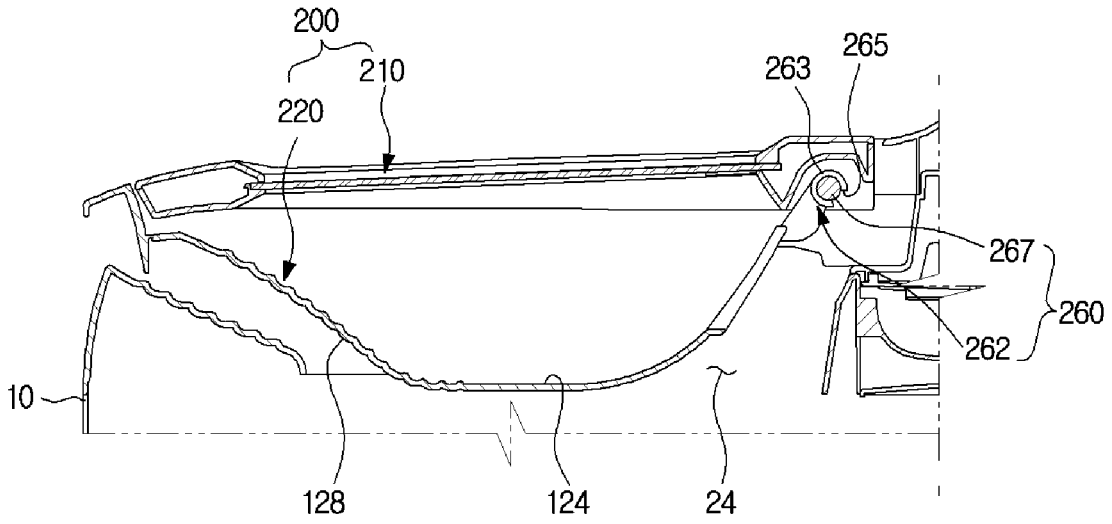
FIG. 14 is a cross-sectional view of the door assembly and a configuration in the vicinity of the door assembly of the washing machine according to another embodiment of the present disclosure.
Figure 15:
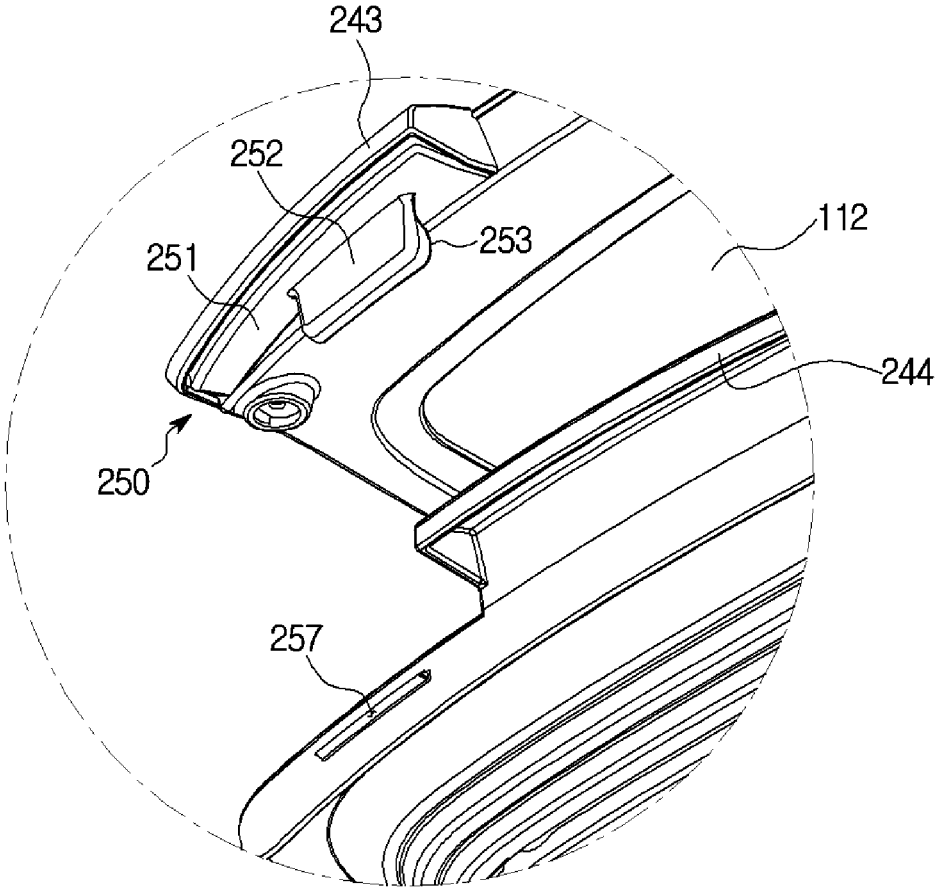
FIGS. 15, 16, 17, and 18 are views related to a unit holding part of the washing machine according to another embodiment of the present disclosure.
Figure 16:
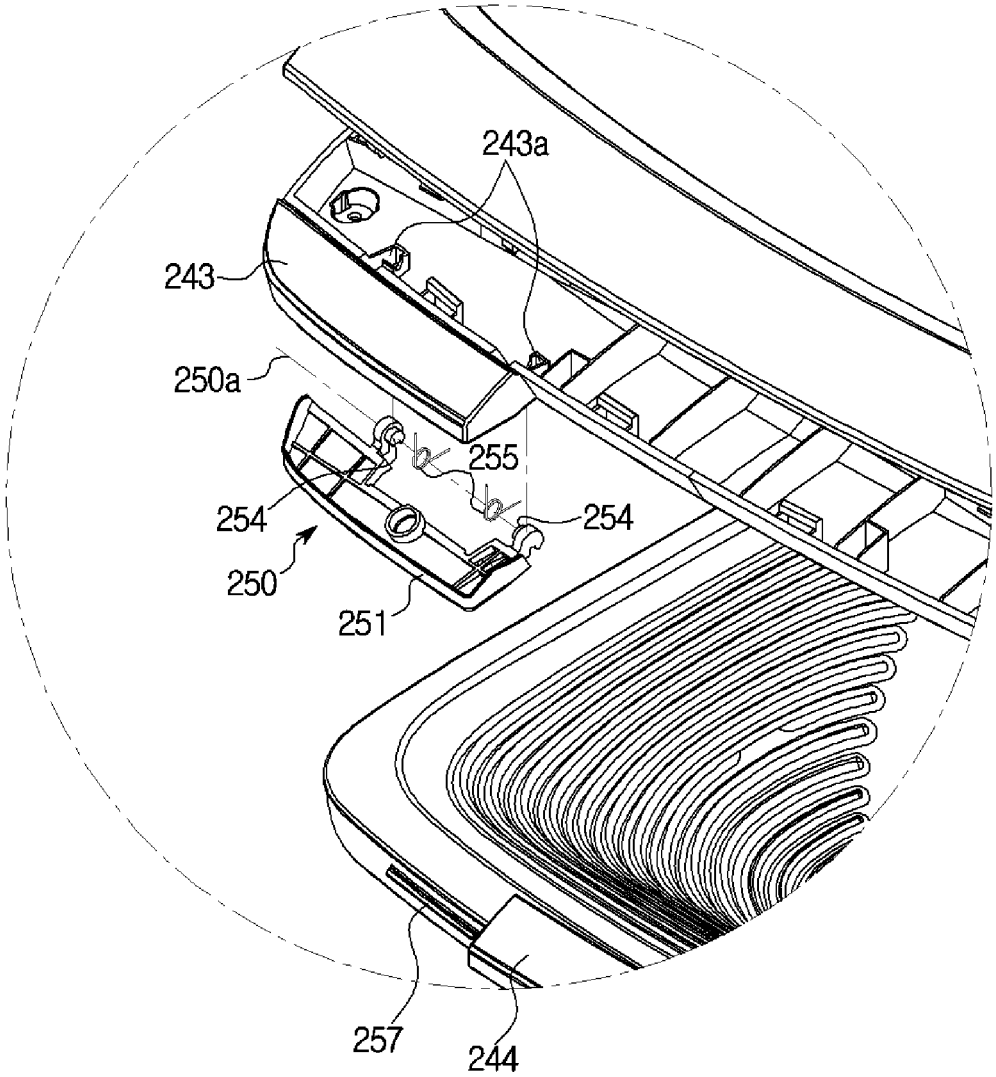
Figure 17:
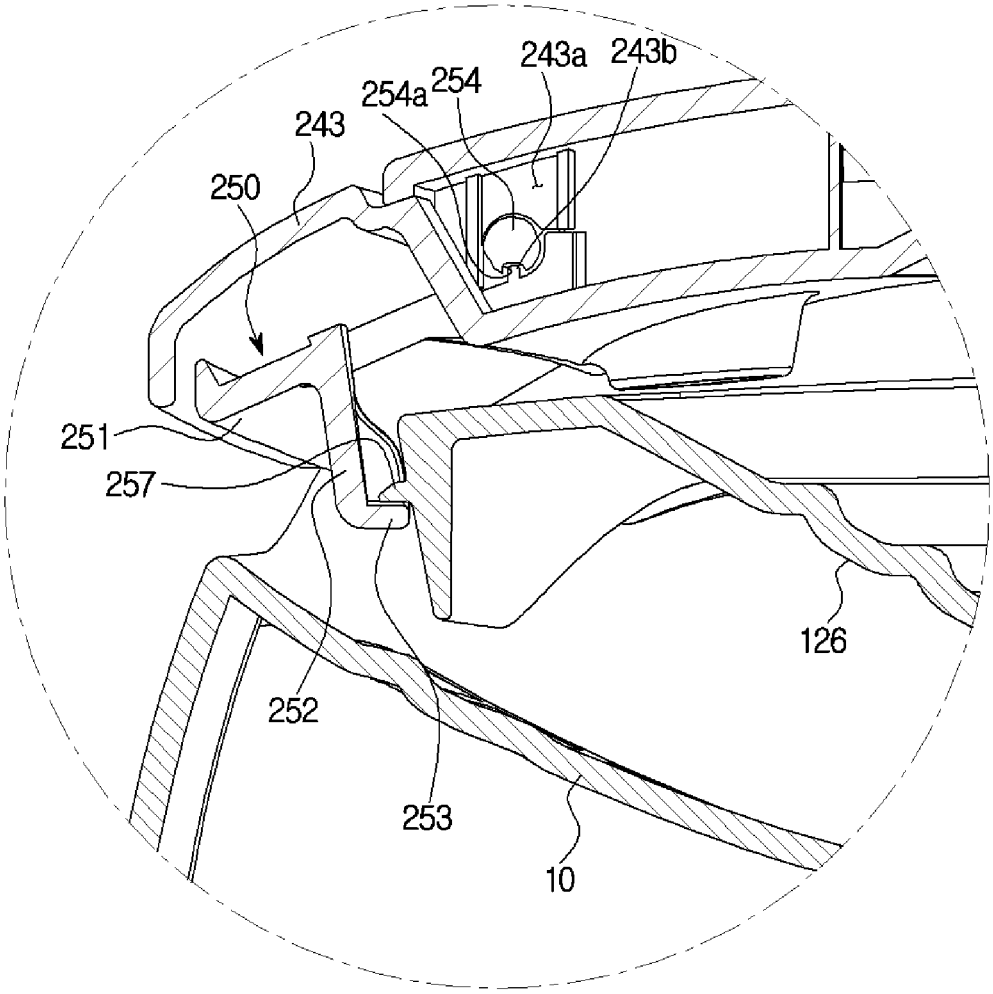
Figure 18:
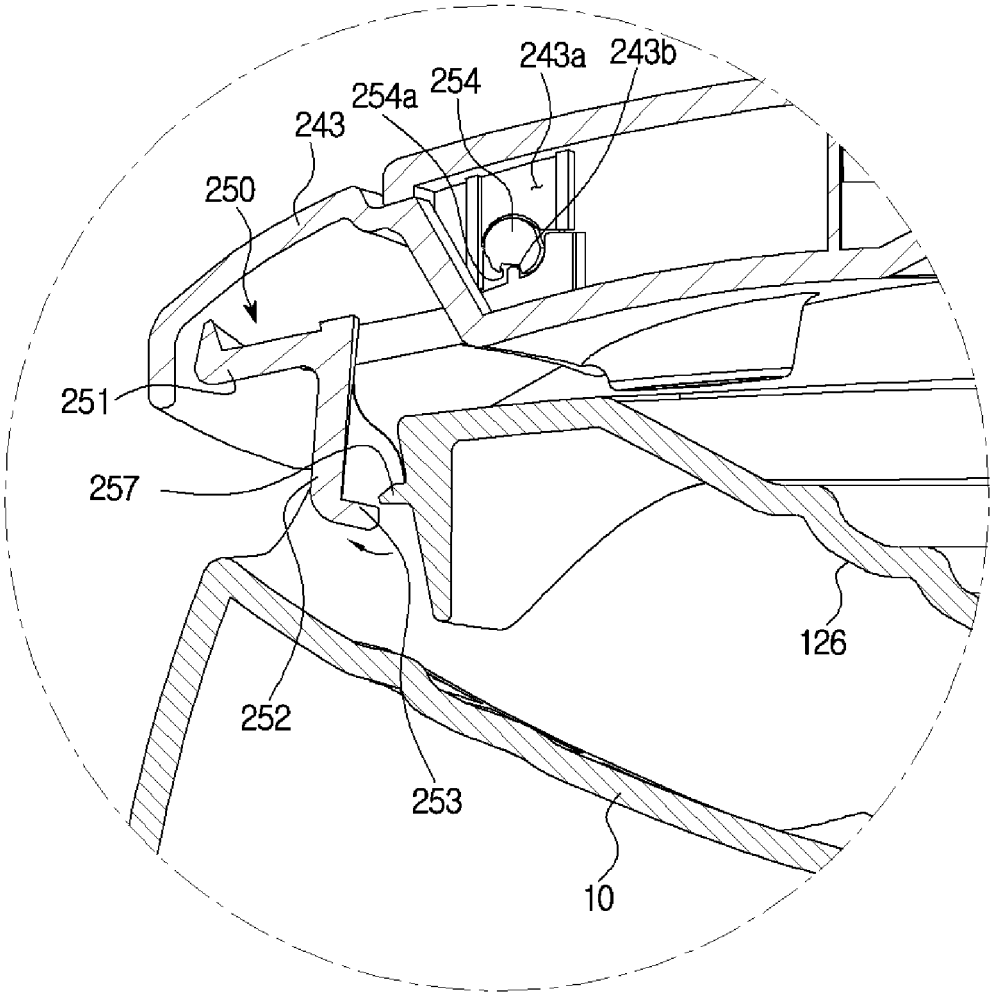

FIGS. 12 and 13 are exploded perspective views of a door assembly of the washing machine according to another embodiment of the present disclosure, and FIG. 14 is a cross-sectional view of the door assembly and a configuration in the vicinity of the door assembly of the washing machine according to another embodiment of the present disclosure.

The sub-washing unit 220 may be rotatably provided with respect to the door 210 or the main body 10. In this embodiment, the sub-washing unit 220 is rotatably provided with respect to the door 210. The sub-washing unit 220 and the door 210 are connected by a hinge unit 260, and the sub-washing unit 220 is configured to relatively rotate with respect to the door 210 by the hinge unit 260.

The hinge unit 260 is provided at the sub-washing unit 220 and the door 210 such that the sub-washing unit 220 may be rotatably coupled to the door 210. Also, the sub-washing unit 220 may be separably provided from the door 210.

The hinge unit 260 may include a unit hinge part 262 provided at the sub-washing unit 220 and a door hinge part 267 provided at the door 210. The unit hinge part 262 and the door hinge part 267 may be separably provided from each other.

In the embodiment, the unit hinge part 262 may be configured in a shape of a pipe with one open surface such that the door hinge part 267 is inserted into the one open surface. Specifically, the unit hinge part 262 includes a unit hinge body 263 to form an insertion space 264 into which the door hinge part 267 is inserted, and a hinge insertion part 265 that is open at one portion of the unit hinge body 263.

The sub-washing unit 220 is pushed into the door 210 such that the door hinge part 267 is inserted into the one open surface of the unit hinge part 262. A method of separating the sub-washing unit 220 from the door 210 is a reverse of the above method.

The unit hinge part 262 may be formed of a material having elasticity. The unit hinge body 263 opens and the hinge insertion part 265 enlarges when the door hinge part 267 is being inserted into the insertion space 264, and after the door hinge part 267 is inserted into the insertion space 264, the unit hinge body 263 is elastically restored such that the hinge insertion part 265 restores to its original size.

The unit hinge part 262 is formed to surround a circumference of the door hinge part 267, and by this configuration, the sub-washing unit 220 is rotatably provided with respect to the door 210.

FIGS. 15, 16, 17, and 18 are views related to a unit holding part of the washing machine according to another embodiment of the present disclosure.

The door assembly 200 may include the unit holding part 240.

The unit holding part 240 is provided such that the sub-washing unit 220 is separably coupled to the door 210.

The unit holding part 240 may include a handle part 242 and a locking structure.

The handle part 242 may include a door handle part 243 disposed at the door 210 and a sub-handle part 244 disposed at the sub-washing unit 220.

The door handle part 243 may be provided in front of the door 210.

Likewise, the sub-handle part 244 may be provided in front of the sub-washing unit 220.

The door handle part 243 and the sub-handle part 244 may be parallel to each other in the longitudinal direction.

The user may manipulate the door handle part 243 or the sub-handle part 244 to rotate the door 210 and the sub-washing unit 220. The door 210 may be rotated by a movement of the door handle part 243 and only the sub-washing unit 220 or both of the sub-washing unit 220 and the door 210 may be rotated by a movement of the sub-handle part 244.

The unit holding part 240 may include the locking structure.

The locking structure is configured to couple the door 210 to the sub-washing unit 220 to prevent the two from being separated from each other. For example, a locking part 250 in a protruding form may be disposed at any one of the door 210 and the sub-washing unit 220, and an interference part 257 that may interfere with the locking part 250 may be disposed at the other one. The locking part 250 may be configured such that an interference by the interference part 257 is released by the user's manipulation. Hereinafter, an embodiment in which the locking part 250 is disposed at the door 210 and the interference part 257 is disposed at the sub-washing unit 220 will be described.

The locking part 250 is disposed at the door 210 and the interference part 257 is disposed at the sub-washing unit 220 such that the door 210 may be coupled to the sub-washing unit 220 by the locking part 250 being interfered with the interference part 257. The locking part 250 may be disposed at a side of the door handle part 243. The interference part 257 may be provided at a front side surface of the sub-washing unit 220 corresponding to a position of the door handle part 243 at which the locking part 250 is disposed. The interference part 257 may protrude from the front side surface of the sub-washing unit 220 to interfere with a protruding part 253 of the locking part 250 to be described below. The positions and forms of the locking part 250 and the interference part 257 are not limited to the above.

A state in which the door 210 and the sub-washing unit 220 are not separated due to the locking part 250 being interfered by the interference part 257 may be a state in which the door assembly 200 is locked. A state in which the locking part 250 is not interfered by the interference part 257 due to the user's manipulation may be a state in which locking of the door assembly 200 is released.

The locking part 250 may be disposed at a lower portion of the door handle part 243. The locking part 250 may be rotatably mounted around a rotation axis 250*a*. The locking part 250 may include a manipulation part 251 disposed to face a bottom surface of the door handle part 243, an extension part 252 protruding and extending to form a predetermined angle with one surface of the manipulation part 251, and the protruding part 253 protruding from one surface of the extension part 252.

The extension part 252 may extend to form approximately 90° with one surface of the manipulation part 251. The protruding part 253 may protrude from one surface of the extension part 252 disposed at an end portion. The protruding part 253 may be selectively interfered by the interference part 257 disposed at the sub-washing unit 220.

A rotary protrusion 254 may be disposed at one portion of the manipulation part 251. The rotary protrusion 254 may protrude toward the rotation axis 250*a* such that the manipulation part 251 may rotate around the rotation axis 250*a*. An accommodation part 243*a* into which the rotary protrusion 254 is insertable may be provided at the door 210 adjacent to the door handle part 243. The rotary protrusion 254 may be rotatably disposed within the accommodation part 243*a*.

A rotary hole 254*a* may be formed at one portion of the rotary protrusion 254. When the rotary protrusion 254 rotates around the rotation axis 250*a* by a predetermined angle, an inner surface of the rotary hole 254*a* is interfered by an insertion part 243*b* such that the rotary protrusion 254 is restrained not to rotate by an angle equal to or greater than the predetermined angle.

The locking part 250 may further include an elastic member 255. When the door assembly 200 is at the first state, to prevent the door 210 and the sub-washing unit 220 from being separated, the elastic member 255 may press the locking part 250 such that the protruding part 253 maintains a state of being interfered by the interference part 257. For example, the elastic member 255 may be provided to press an upper surface of the manipulation part 251 downward. The manipulation part 251 rotates counterclockwise around the rotation axis 250*a* by the elastic member 255 such that the protruding part 253 may be interfered by the interference part 257.

As above, as long as the door assembly 200 is at the first state and there is no external force, the door 210 and the sub-washing unit 220 may remain coupled to each other by the locking part 250.

Next, a movement of the sub-washing unit 220 according to another embodiment of the present disclosure will be described.

Figure 19:
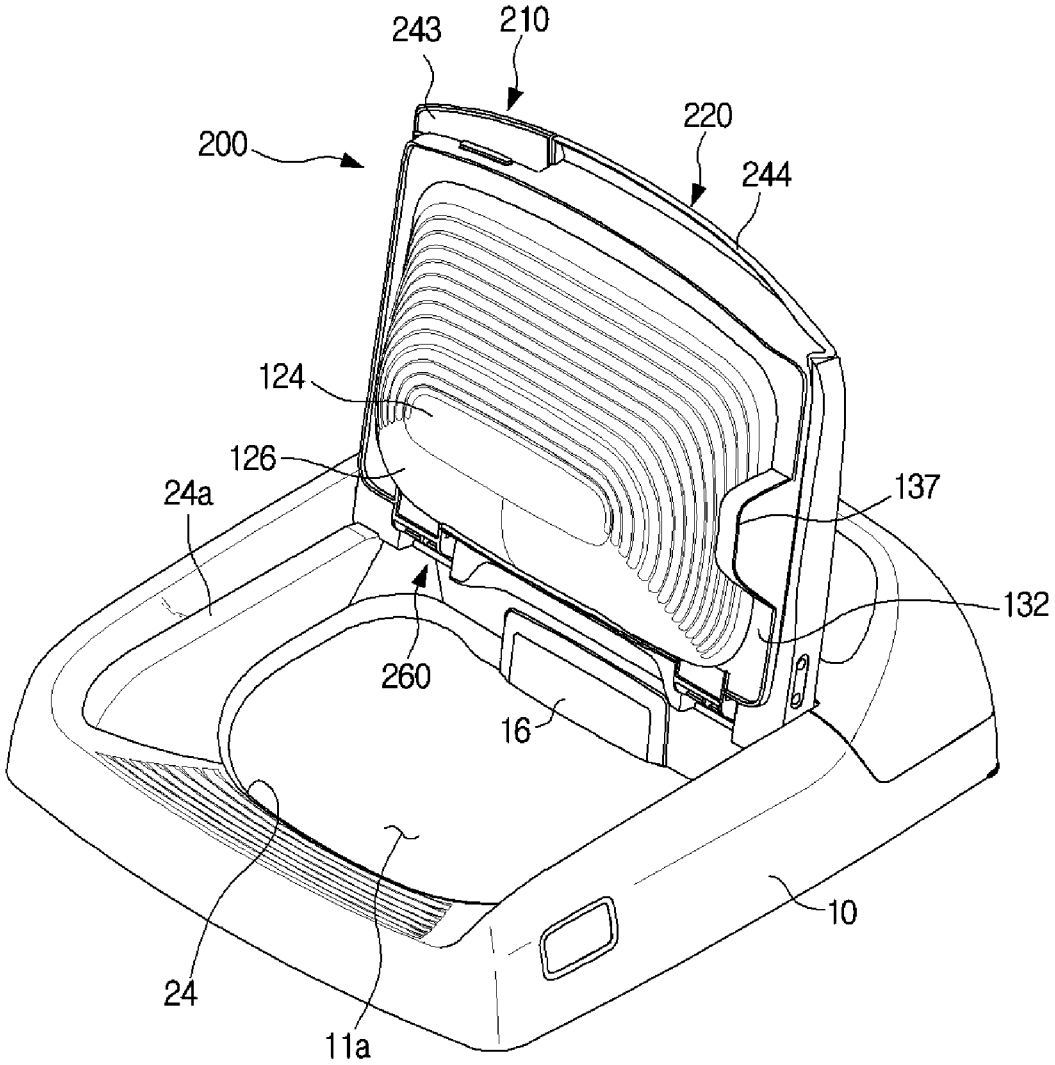
FIGS. 19, 20, and 21 are views related to a movement of a sub-washing unit according to another embodiment of the present disclosure.
Figure 20:
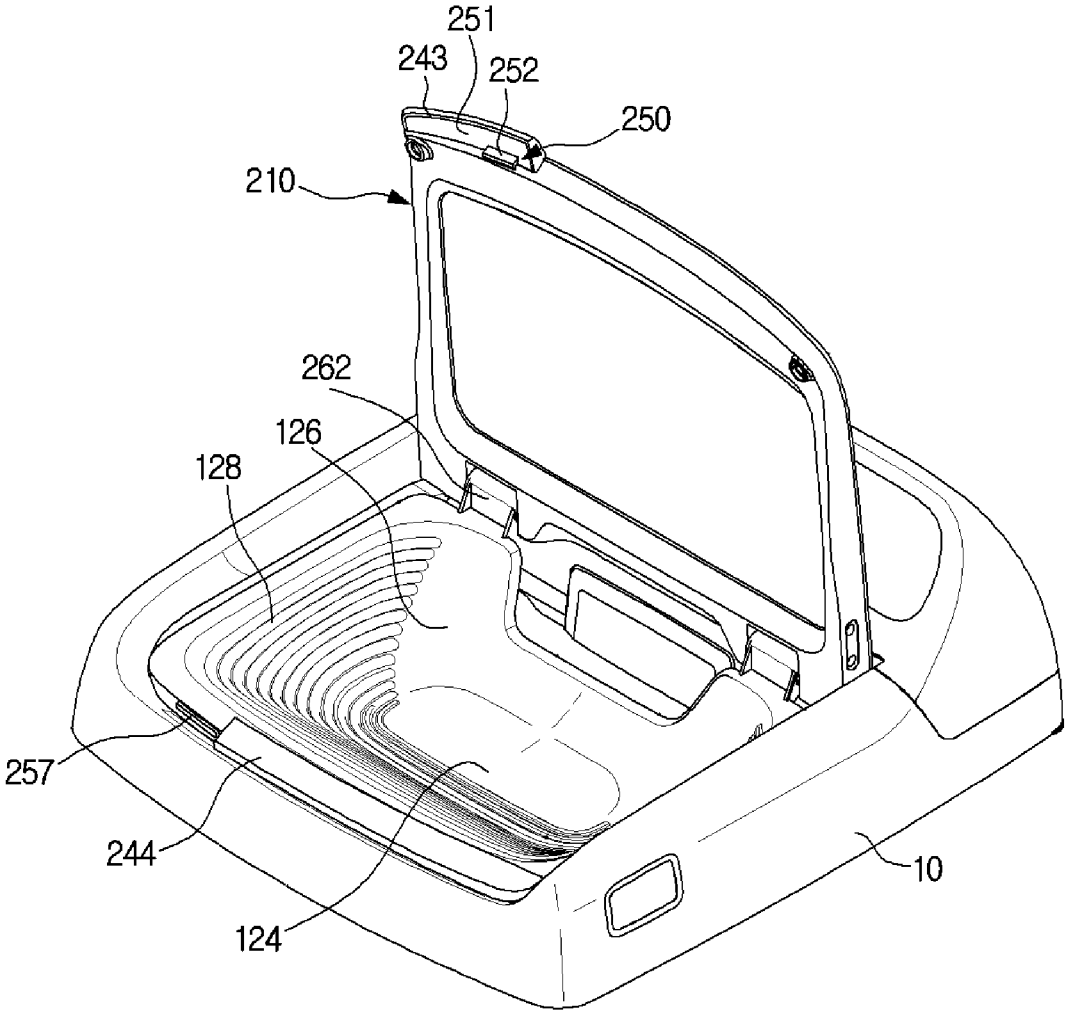
Figure 21:
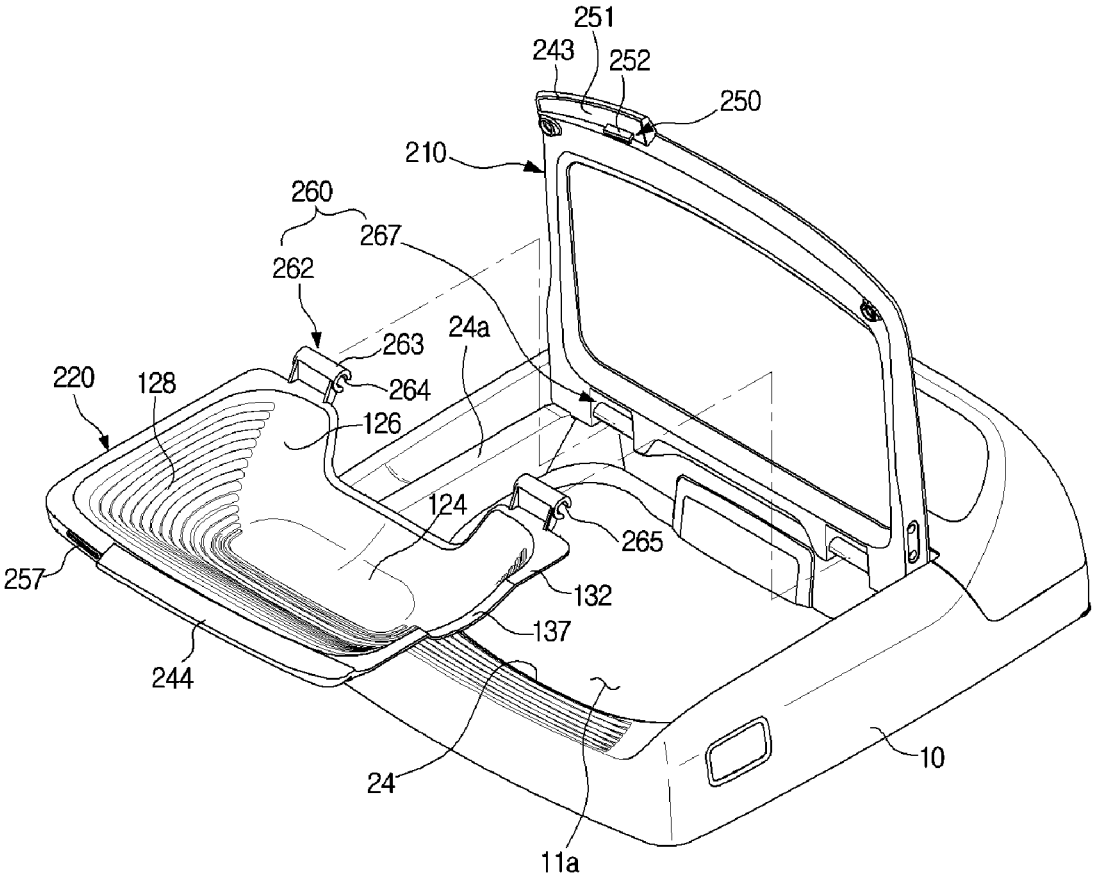

FIGS. 19, 20, and 21 are views related to a movement of a sub-washing unit according to another embodiment of the present disclosure.

Referring to FIGS. 19, 20, and 21, the sub-washing unit 220 according to the embodiment is configured to be movable among a first state of being restrained by the door 210, a second state of relatively rotating from the door 210 to enable sub-washing, and a third state of being separated from the door 210.

When the sub-washing unit 220 is at the first state, the sub-washing unit 220 may be restrained by the door 210 and rotate together with the rotation of the door 210. Specifically, the locking part 250 of the unit holding part 240 interferes with the interference part 257 such that the sub-washing unit 220 is restrained by the door 210.

When the sub-washing unit 220 is at the second state, restraining by the unit holding part 240 is released and the sub-washing unit 220 relatively rotates from the door 210. Specifically, the locking part 250 of the unit holding part 240 releases the interference with the interference part 257. Since the unit hinge part 262 is rotatably coupled to the door hinge part 267, the sub-washing unit 220 relatively rotates from the door 210 at the second state. The seating flange 132 of the sub-washing unit 220 is seated on the seating portion 24*a* such that sub-washing is possible in the sub-washing space 120*a*.

When the sub-washing unit 220 is at the third state, restraining by the unit holding part 240 is released and the unit hinge part 262 is also separated from the door hinge part 267 such that the sub-washing unit 220 is separated from the door 210. By separating the sub-washing unit 220 from the washing machine 1 using the above configuration, the opening 24 may be secured to be wider and the sub-washing unit 220 may be mounted on the door 210 as needed.

Hereinafter, yet another embodiment of a washing machine of the present disclosure will be described.

Description of configurations overlapping with the above description will be omitted.

Figure 22:
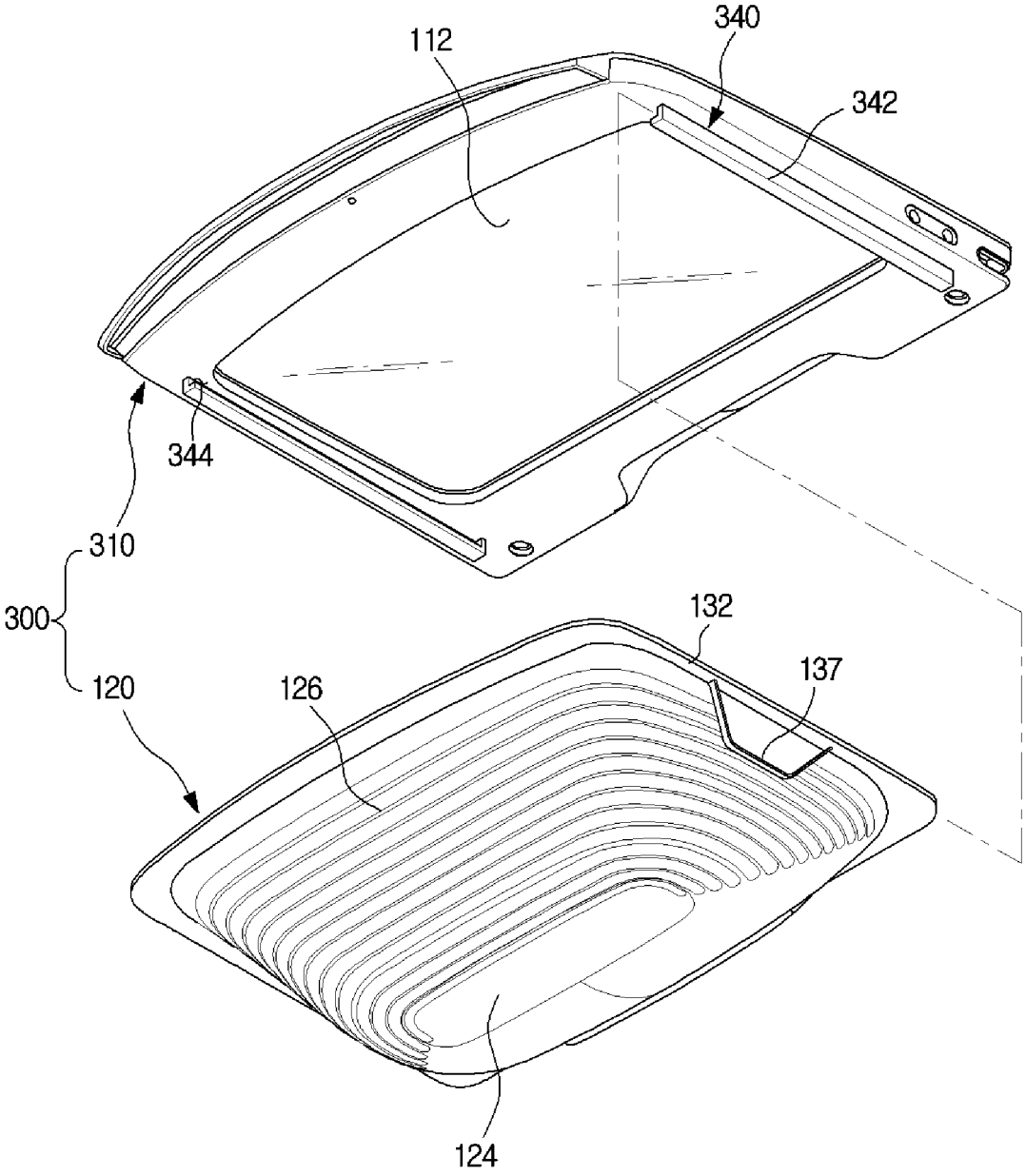
FIG. 22 is a view related to a unit holding part of a washing machine according to yet another embodiment of the present disclosure.

FIG. 22 is a view related to a unit holding part of a washing machine according to yet another embodiment of the present disclosure.

A door assembly 300 may include a unit holding part 340.

The unit holding part 340 is provided such that the sub-washing unit 120 may be separably coupled to a door 310.

When the sub-washing unit 120 is at a first state, the sub-washing unit 120 may be restrained by the door 310 by the unit holding part 340 and rotate together with rotation of the door 310.

When the sub-washing unit 120 is at a second state, the sub-washing unit 120 is separated from the door 310 due to the restraining by the unit holding part 340 being released and the seating flange 132 of the sub-washing unit 120 is seated on the seating portion 24*a* such that sub-washing is possible in the sub-washing space 120*a*.

Separately from the first state and the second state, the sub-washing unit 120 may include a third state of being separated from the door 310 and separated from the washing machine 1.

The unit holding part 340 may include an insertion rail 342.

The insertion rail 342 is disposed at an inner portion of the door 310 to allow the sub-washing unit 120 to be separably coupled to the door 310.

An insertion groove 344 may be formed at an inner portion of the insertion rail 342 such that the seating flange 132 of the sub-washing unit 120 may be inserted thereinto. Corresponding to the seating flange 132, the insertion rail 342 may be longitudinally formed in one direction at the inner portion of the door 310. Also, the insertion rail 342 may be formed as one pair facing each other for seating flanges 132 at both sides of the sub-washing unit 120 to be respectively inserted thereinto.

Hereinafter, still another embodiment of a washing machine of the present disclosure will be described.

Description of configurations overlapping with the above description will be omitted.

Figure 23:
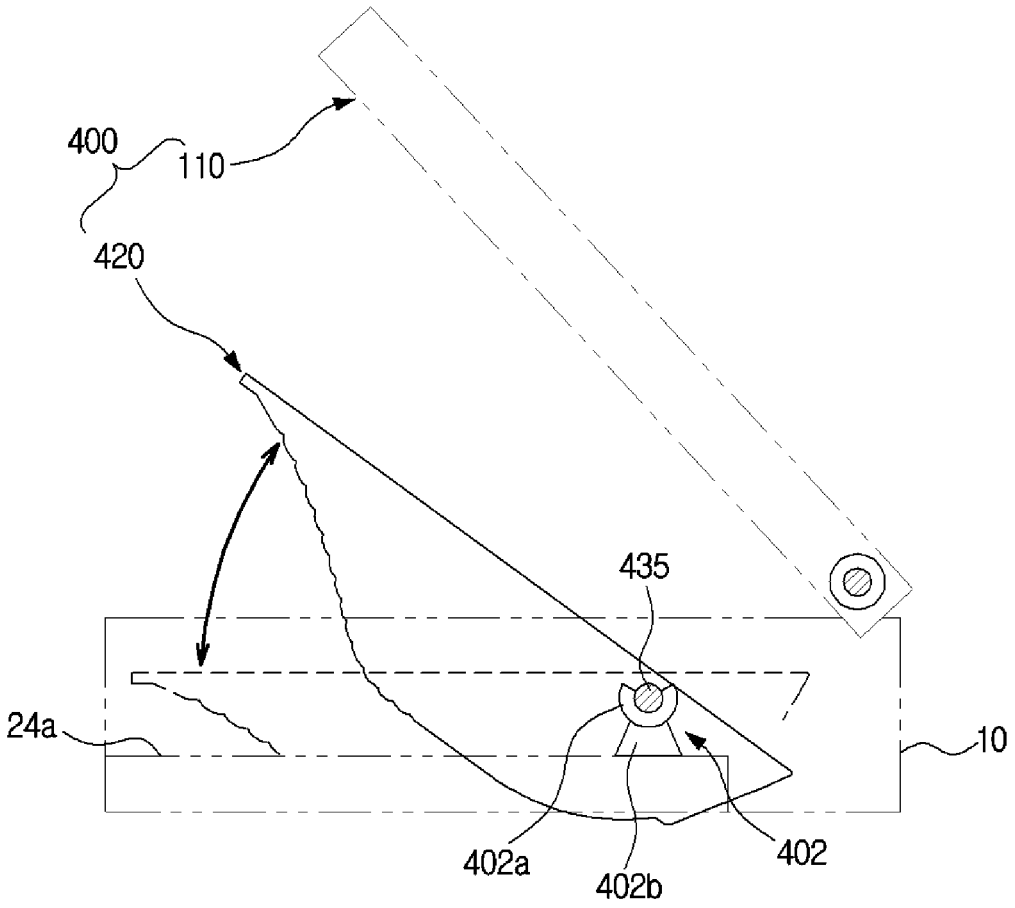
FIG. 23 is a view briefly illustrating a partial configuration of the washing machine according to still another embodiment of the present disclosure.

FIG. 23 is a view briefly illustrating a partial configuration of the washing machine according to still another embodiment of the present disclosure.

A door assembly 400 may include the door 110 and a sub-washing unit 420.

The door 110 is disposed at one portion of the main body 10 and configured to open and close the opening 24.

The sub-washing unit 420 is provided to enable separate hand-washing.

The sub-washing unit 420 has the sub-washing space 120*a* to be described below to allow separate hand-washing. The sub-washing unit 420 may be separably coupled to the door 110. Although this is not illustrated, a structure of the unit holding part 140 of the previous embodiment may be applied. Also, the sub-washing unit 120 is seated on the main body 10 when being used such that the user may perform sub-washing such as hand-washing.

The sub-washing unit 420 may include a structure for rotating and moving the sub-washing unit 420 to discharge wash water after sub-washing such as hand-washing is performed, and sub-washing is finished.

Figure 24:
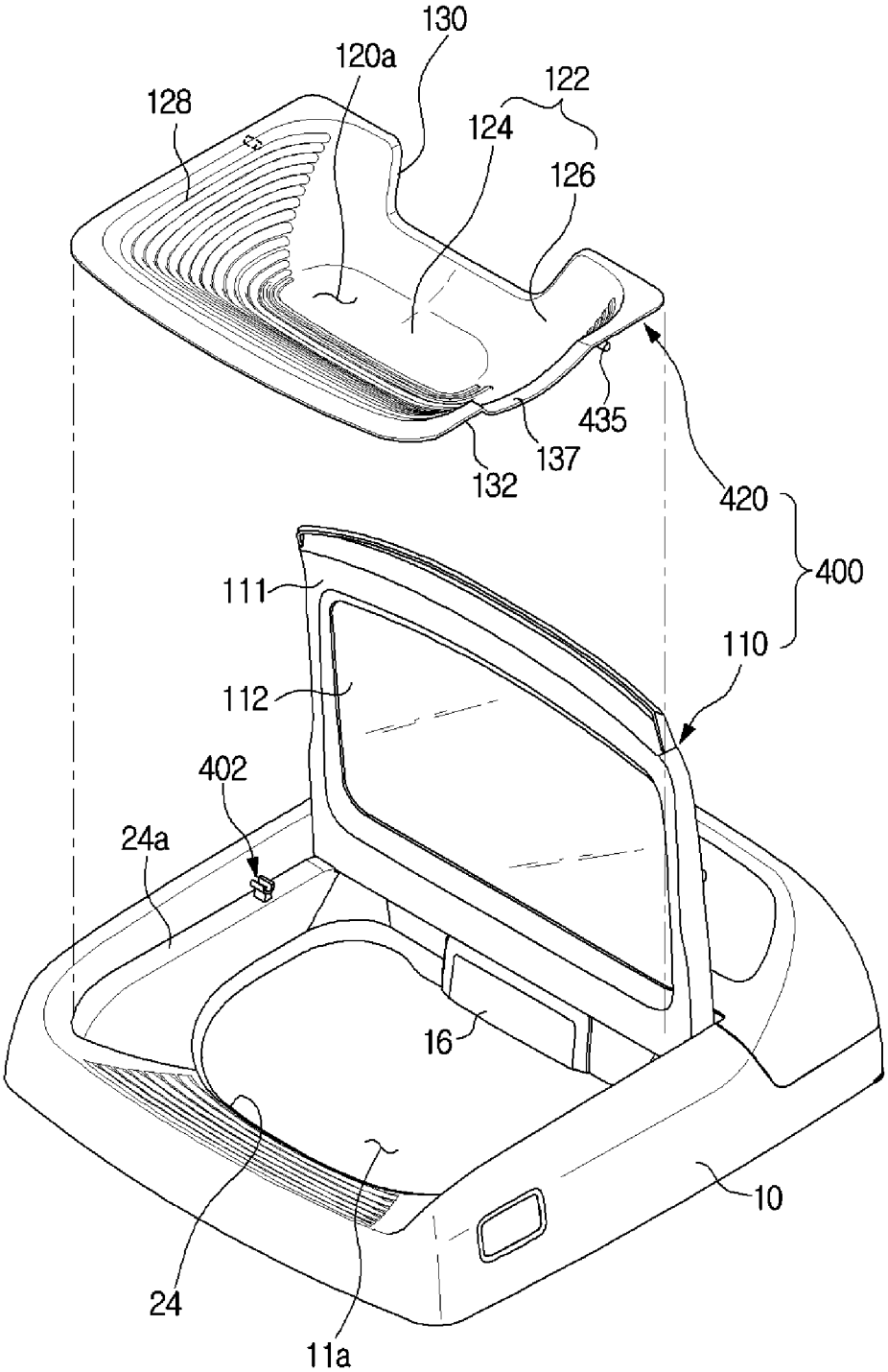
FIGS. 24 and 25 are views related to mounting of a sub-washing unit on a main body according to still another embodiment of the present disclosure.
Figure 25:
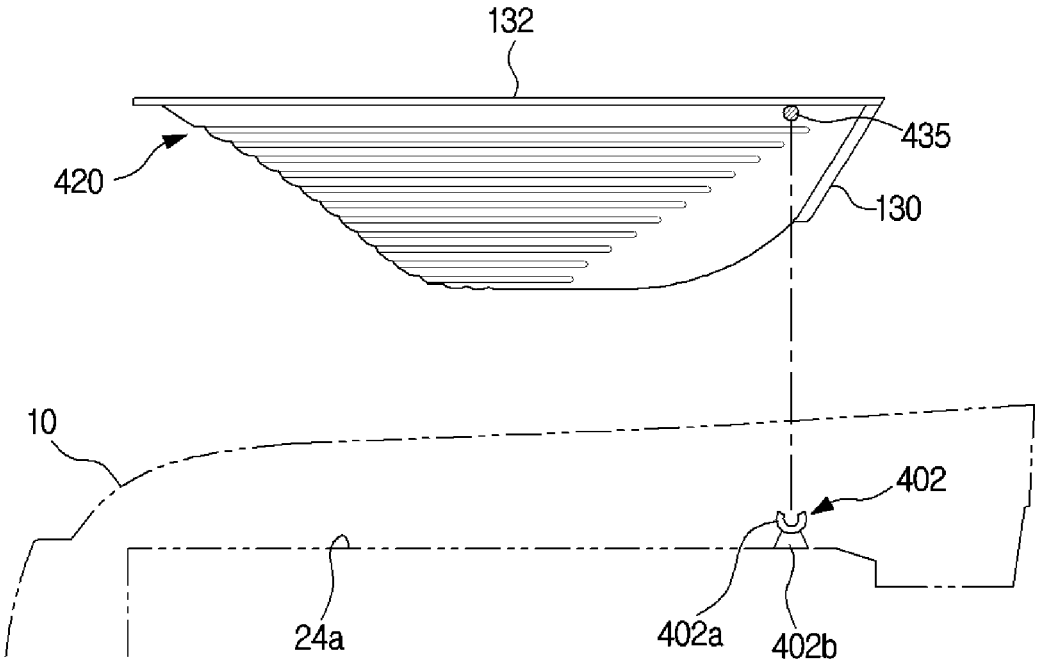
Figure 26:
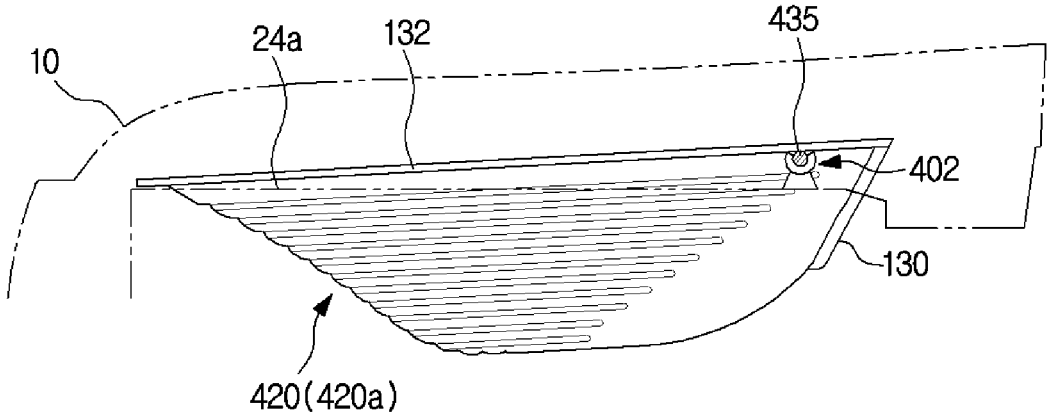
FIGS. 26 and 27 are views related to a movement of the sub-washing unit according to still another embodiment of the present disclosure.
Figure 27:
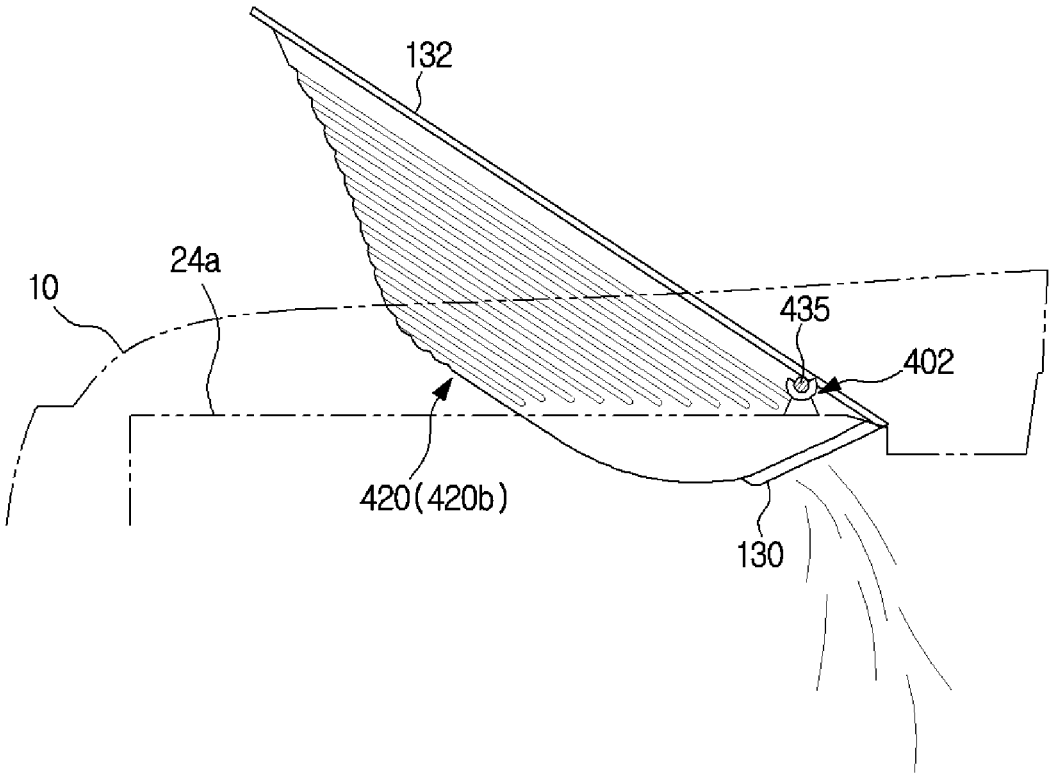

FIGS. 24 and 25 are views related to mounting of a sub-washing unit on a main body according to still another embodiment of the present disclosure, and FIGS. 26 and 27 are views related to a movement of the sub-washing unit according to still another embodiment of the present disclosure.

To rotate and move the sub-washing unit 420, a rotation support part 402 may be provided as an example. The rotation support part 402 may be configured to support rotation of the sub-washing unit 420. When wash water retained in the sub-washing unit 420 is drained through the sub-water drain port 130, the sub-washing unit 420 is tilted in one direction. The rotation support part 402 is provided at the seating portion 24*a* to allow the sub-washing unit 420 to be easily tilted when being tilted in the one direction.

The rotation support part 402 may be disposed on the seating portion 24*a*. A position in the seating portion 24*a* at which the rotation support part 402 is disposed is not limited, and the rotation support part 402 may be disposed at any place so long as the rotation support part 402 is configured to support rotation of the sub-washing unit 420 around a rotary protrusion 435 formed at the sub-washing unit 420.

The rotary protrusion 435 may be formed at the unit body 122 and be rotatably coupled to the rotation support part 402. As to be described below, the rotary protrusion 435 is coupled to the rotation support part 402 such that the sub-washing unit 420 is configured to rotate between a mounted state 420*a* and a discharge state 420*b*.

The rotation support part 402 may include a protrusion insertion part 402*a* into which the rotary protrusion 435 protruding from the unit body 122 of the sub-washing unit 420 is inserted, and a protrusion support part 402*b* to support the protrusion insertion part 402*a*.

As illustrated in FIGS. 25 and 26, the sub-washing unit 420 may be mounted on the main body 10 such that the rotary protrusion 435 is inserted into the protrusion insertion part 402*a*. At least a portion of the seating flange 132 of the sub-washing unit 420 may be configured to come in contact with the seating portion 24*a*. Since sub-washing is possible when at least a portion of the seating flange 132 comes in contact with the seating portion 24*a* and the rotary protrusion 435 is inserted into the protrusion insertion part 402*a* as above, this state may be referred to as the mounted state 420*a*.

Referring to FIG. 27, when wash water inside the sub-washing unit 420 is drained after sub-washing is finished, the sub-washing unit 420 is tilted to discharge the wash water through the sub-water drain port 130.

Here, the sub-washing unit 420 rotates around the rotary protrusion 435 and the sub-water drain port 130 moves to a position lower than at the mounted state 420*a* such that the wash water inside the sub-washing unit 420 is discharged from the sub-washing unit 420. A state in which the sub-washing unit 420 has rotated around the rotary protrusion 435 from the mounted state 420*a* may be referred to as the discharge state 420*b*.

As above, when sub-washing is finished, the sub-washing unit 420 may be rotated from the mounted state 420*a* to the discharge state 420*b* to discharge the wash water retained in the sub-washing unit 420 through the sub-water drain port 130.

Hereinafter, still another embodiment of a washing machine of the present disclosure will be described.

Description of configurations overlapping with the above description will be omitted.

Figure 28:
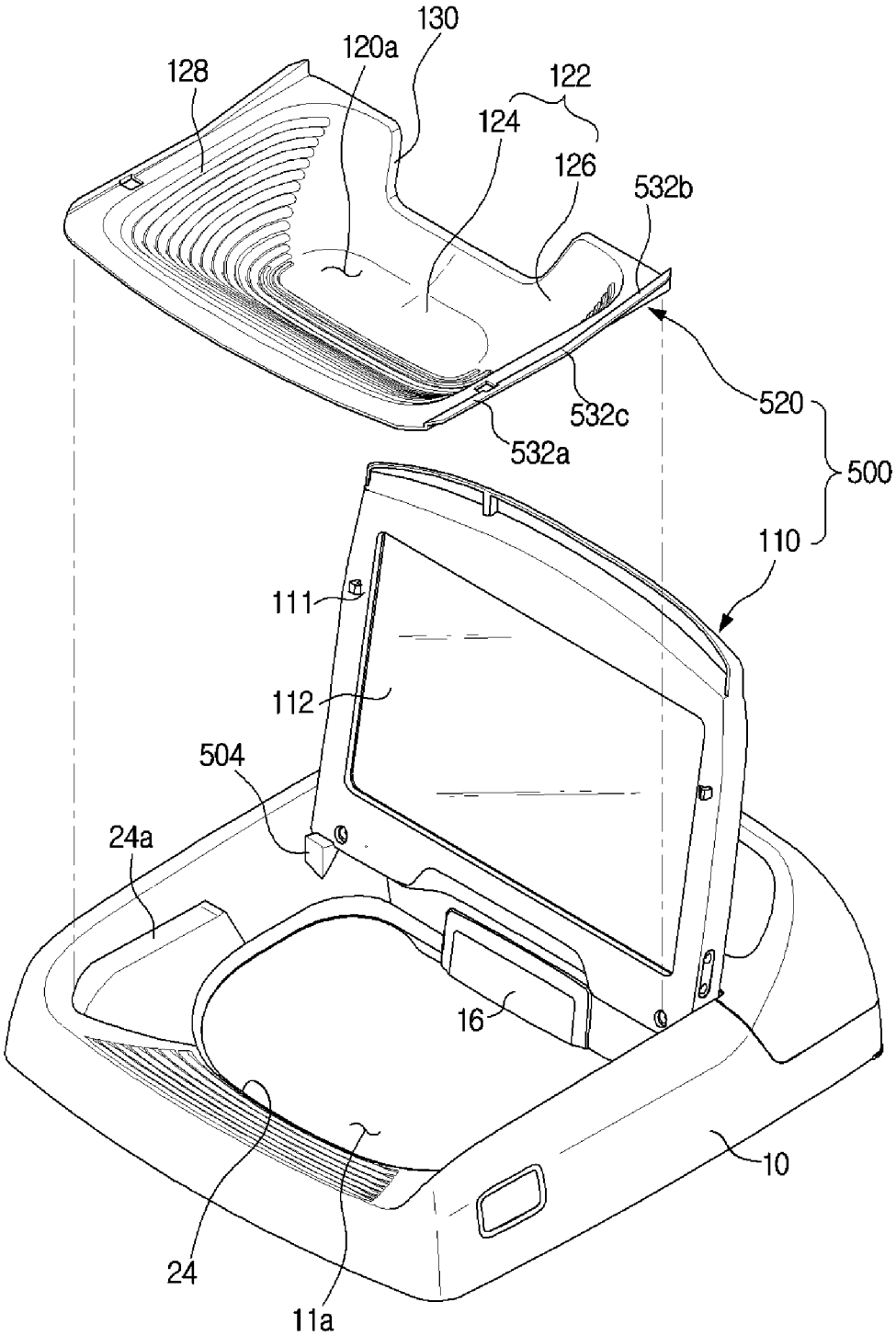
FIGS. 28 and 29 are views related to mounting of a sub-washing unit on a main body according to still another embodiment of the present disclosure.
Figure 29:
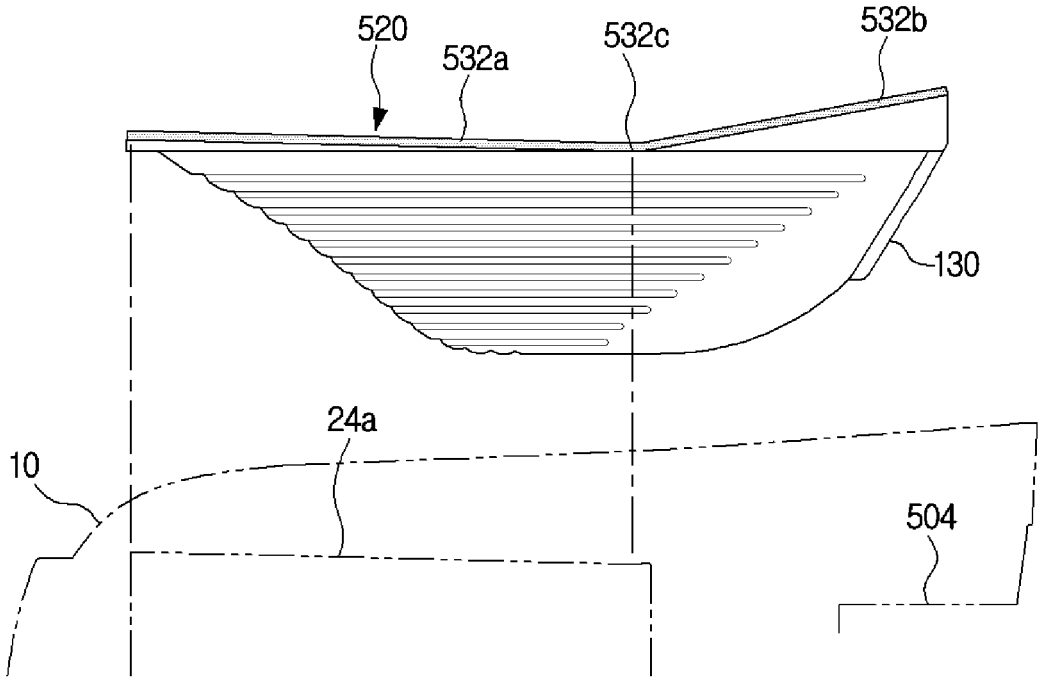
Figure 30:
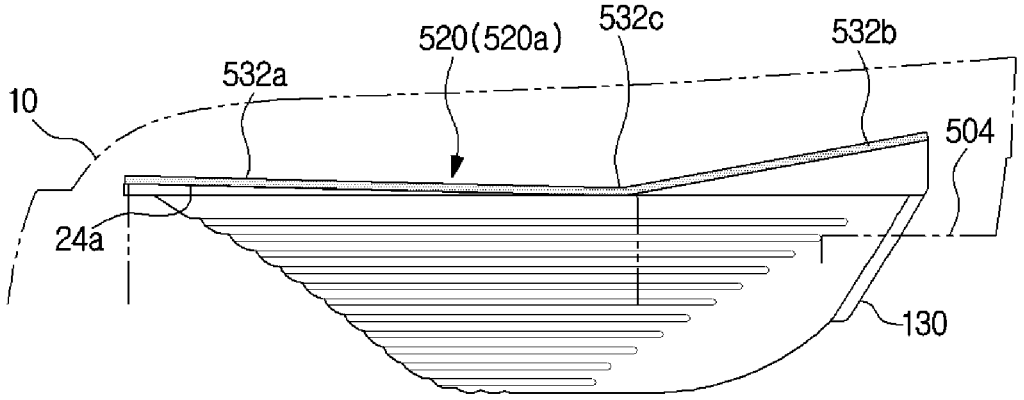
FIGS. 30 and 31 are views related to a movement of the sub-washing unit according to still another embodiment of the present disclosure.
Figure 31:
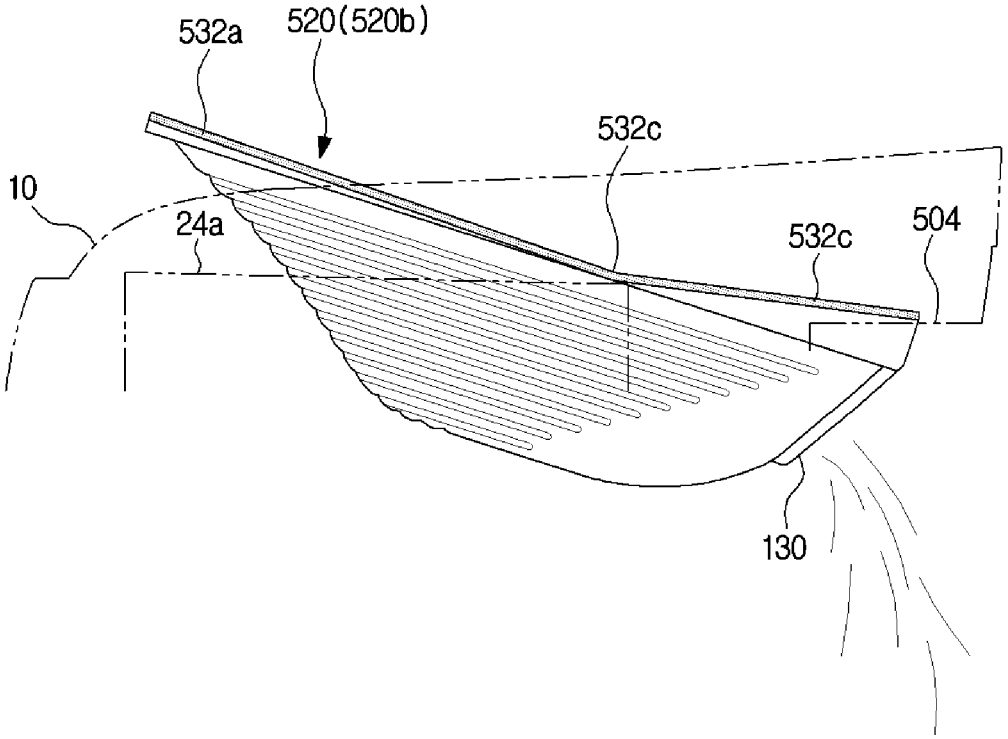

FIGS. 28 and 29 are views related to mounting of a sub-washing unit on a main body according to still another embodiment of the present disclosure, and FIGS. 30 and 31 are views related to a movement of the sub-washing unit according to still another embodiment of the present disclosure.

A door assembly 500 may include the door 110 and a sub-washing unit 520.

The sub-washing unit 520 may include a seating flange 532*a* and an inclined flange 532*b*.

The seating flange 532*a* is formed along a circumference of an upper end of the sub-washing unit 520 in a shape of a flange to be seated on the main body 10. That is, the seating flange 532*a* may be configured in the shape of a flange along at least a portion of the upper end of the unit body 122.

The seating portion 24*a* protruding along the circumference of the opening 24 may be provided at an inner portion of the opening 24 of the main body 10. The seating flange 532*a* is configured to be seated on the seating portion 24*a*. As the seating flange 532*a* is seated on the seating portion 24*a*, the sub-washing unit 520 may be seated on the main body 10.

The inclined flange 532*b* may extend from the seating flange 532*a*. The inclined flange 532*b* may extend to a rear portion of the seating flange 532*a*. The inclined flange 532*b* may be slantly formed to be tilted upward at the rear portion of the seating flange 532*a*. Specifically, when the seating flange 532*a* is seated on the seating portion 24*a*, the inclined flange 532*b* may be slantly configured to have a slope of a predetermined angle with the seating portion 24*a*. The inclined flange 532*b* may be slantly formed with the seating flange 532*a* such that the sub-washing unit 520 may rotate while making the seating flange 532*a* and the seating portion 24*a* spaced apart when the inclined flange 532*b* is pressed.

A rotation stopper 504 to limit a movement of the inclined flange 532*b* may be provided at an inner portion of the opening 24 of the main body 10. The rotation stopper 504 is provided on a movement path of the inclined flange 532*b* to prevent the inclined flange 532*b* from excessively moving.

The seating portion 24*a* is configured to correspond only to the seating flange 532*a* for the inclined flange 532*b* to not be interfered when the sub-washing unit 520 rotates, but embodiments are not limited thereto. Specifically, the seating portion 24*a* may extend to correspond also to the inclined flange 532*b* to serve as the rotation stopper 504 with respect to the movement of the inclined flange 532*b* when the sub-washing unit 520 rotates.

The sub-washing unit 520 may include a rotation support part 532*c* to support rotation of the sub-washing unit 520 from between the seating flange 532*a* and the inclined flange 532*b*.

As illustrated in FIGS. 28 and 29, the sub-washing unit 520 may be mounted on the main body 10 for the seating flange 532*a* to be seated on the seating portion 24*a*. A state in which the seating flange 532*a* is seated on the seating portion 24*a* and thus sub-washing is possible may be referred to as a mounted state 520*a*.

Referring to FIG. 30, when wash water inside the sub-washing unit 520 is drained after sub-washing is finished, the sub-washing unit 520 is tilted to discharge the wash water through the sub-water drain port 130.

When the inclined flange 532*b* of the sub-washing unit 520 is pressed, the sub-washing unit 520 is rotated such that the seating flange 532*a* is spaced apart from the seating portion 24*a*. The sub-washing unit 520 may rotate around the rotation support part 532*c*, and the sub-water drain port 130 is moved to a position lower than at the mounted state 520*a* such that the wash water inside the sub-washing unit 520 is discharged from the sub-washing unit 520. A state in which the sub-washing unit 520 rotates from the mounted state 520*a* and thus the wash water may be drained through the sub-water drain port 130 may be referred to as a discharge state 520*b*.

As above, after the sub-washing is finished, the sub-washing unit 520 may be rotated from the mounted state 520*a* to the discharge state 520*b* to discharge the wash water retained in the sub-washing unit 520 through the sub-water drain port 130.

Hereinafter, still another embodiment of a washing machine of the present disclosure will be described.

Description of configurations overlapping with the above description will be omitted.

Figure 32:
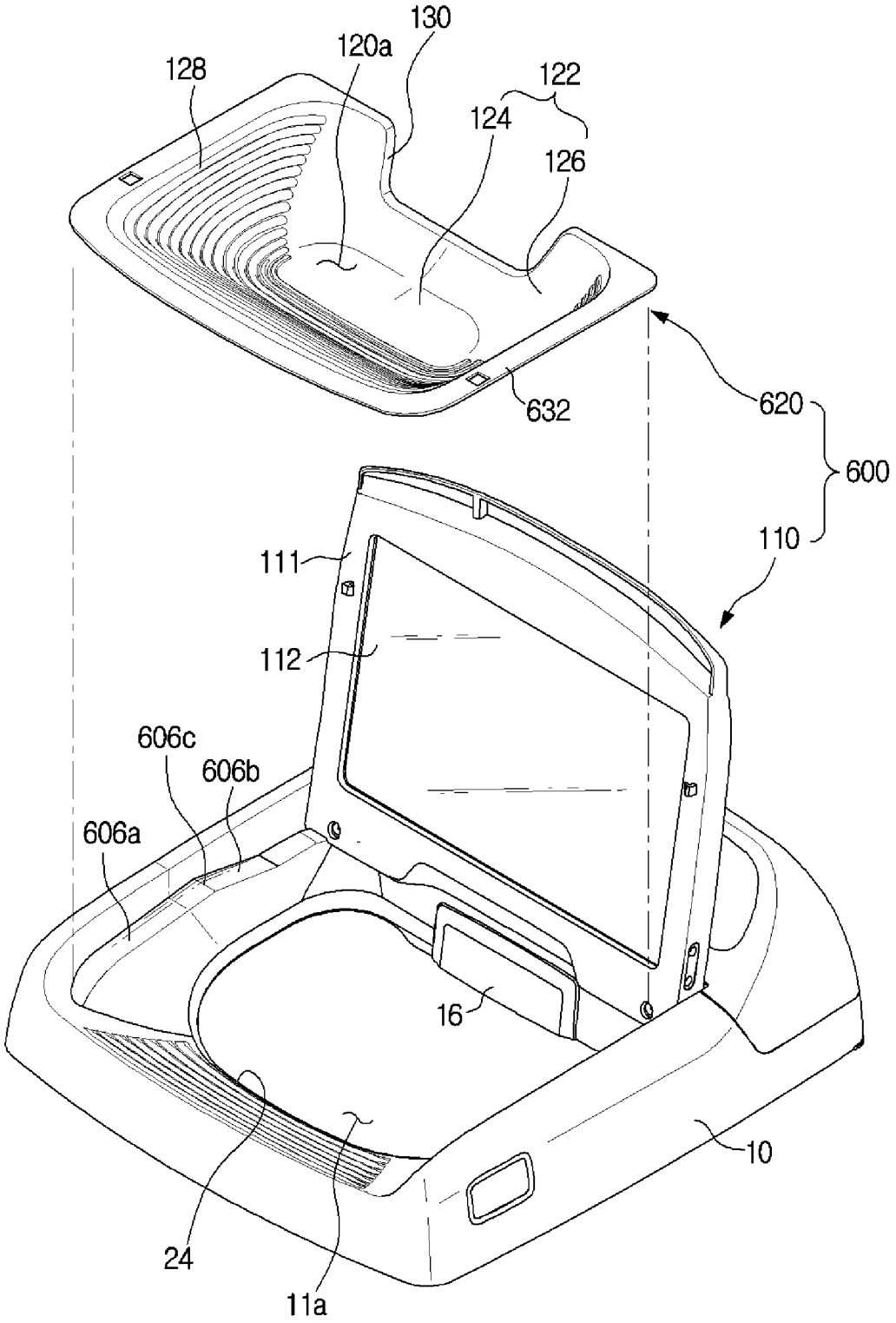
FIGS. 32 and 33 are views related to mounting of a sub-washing unit on a main body according to still another embodiment of the present disclosure.
Figure 33:
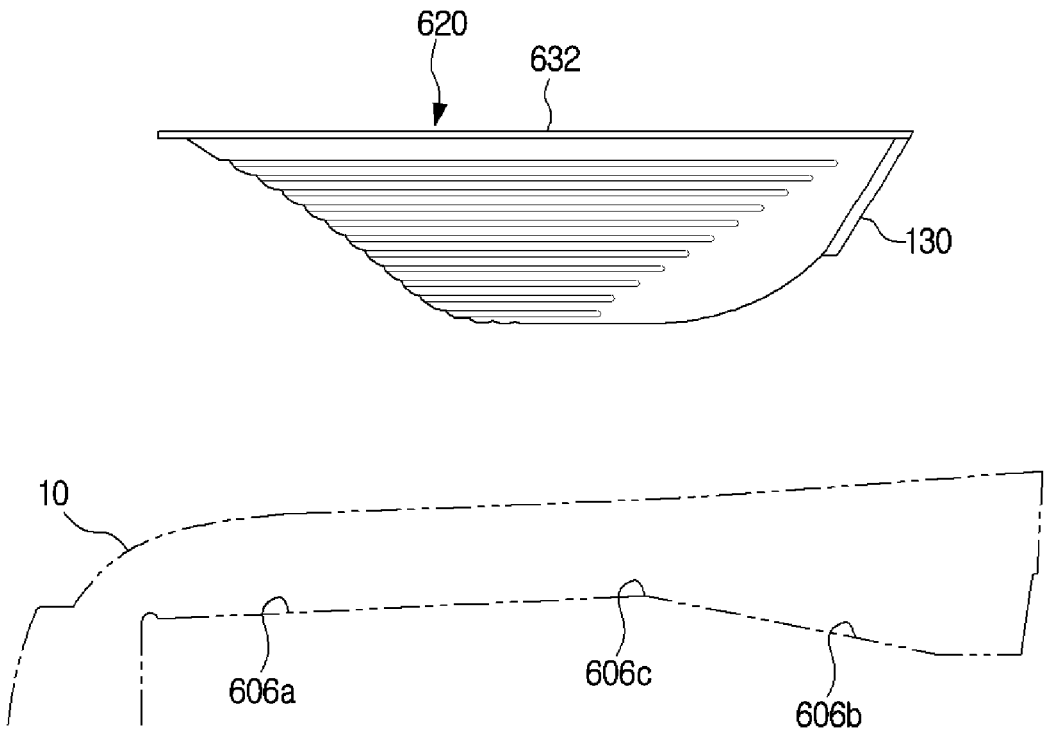
Figure 34:
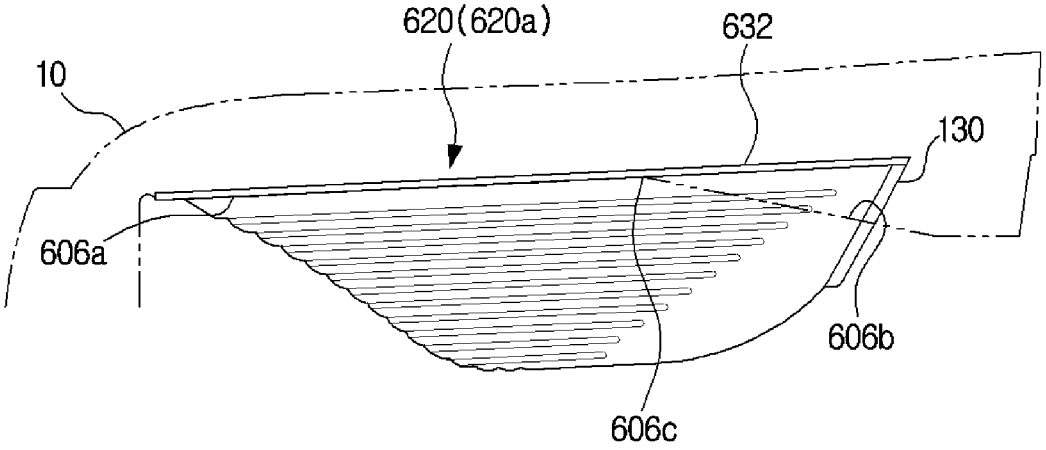
FIGS. 34 and 35 are views related to a movement of the sub-washing unit according to still another embodiment of the present disclosure.
Figure 35:
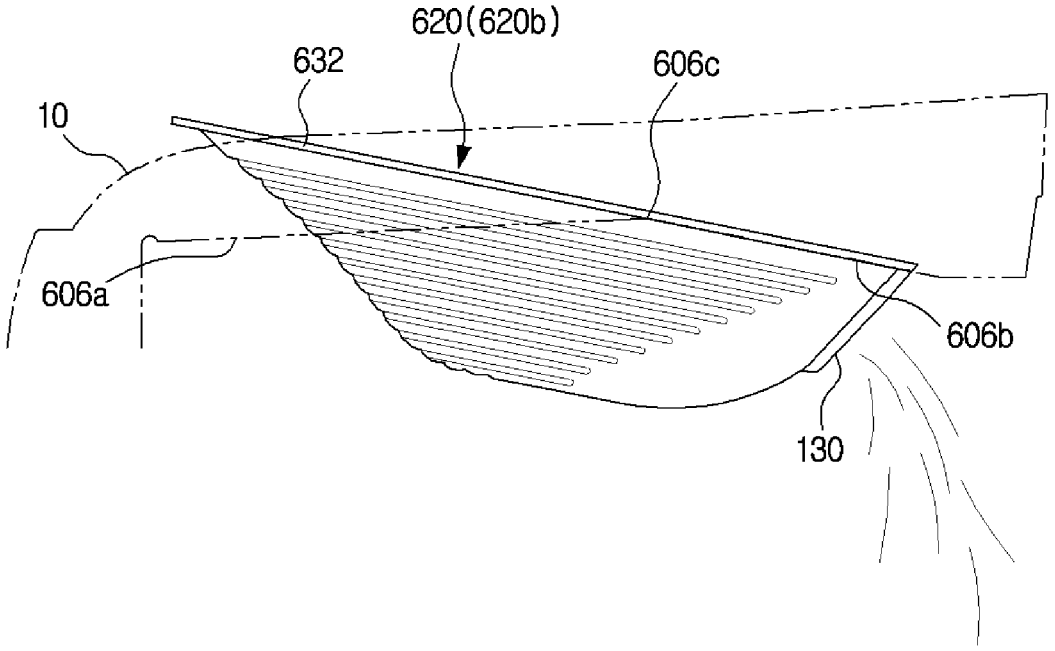

FIGS. 32 and 33 are views related to mounting of a sub-washing unit on a main body according to still another embodiment of the present disclosure, and FIGS. 34 and 35 are views related to a movement of the sub-washing unit according to still another embodiment of the present disclosure.

A door assembly 600 may include the door 110 and a sub-washing unit 620.

A seating portion 606*a* and an inclined seating portion 606*b* protruding along the circumference of the opening 24 may be provided at the inner portion of the opening 24 of the main body 10.

A first portion 632*a* of a seating flange 632 is configured to be seated on the seating portion 606*a*. As the seating flange 632 is seated on the seating portion 606*a*, the sub-washing unit 620 may be seated on the main body 10.

The inclined seating portion 606*b* may extend to a rear portion from the seating portion 606*a* and be slantly formed by being lowered than the seating portion 606*a*. By this configuration, a second portion of the seating flange 632 configured behind the first portion 632*a* thereof may be seated on the inclined seating portion 606*b* when the sub-washing unit 620 rotates. The inclined seating portion 606*b* may serve as a stopper that prevents the second portion of the seating flange 632 from excessively moving when the sub-washing unit 620 rotates.

A rotation support part 606*c* to support rotation of the sub-washing unit 620 may be provided between the seating portion 606*a* and the inclined seating portion 606*b*.

As illustrated in FIGS. 33 and 34, the sub-washing unit 620 may be mounted on the main body 10 such that the first portion 632*a* of the seating flange 632 is seated on the seating portion 606*a*. A state in which at least a portion of the seating flange 632 is seated on the seating portion 606*a* as above and thus sub-washing is possible may be referred to as a mounted state 620*a*.

Referring to FIG. 35, when wash water inside the sub-washing unit 620 is drained after sub-washing is finished, the sub-washing unit 620 is tilted to discharge the wash water through the sub-water drain port 130.

When the second portion of the seating flange 632 is pressed, the sub-washing unit 620 is rotated such that the first portion 632*a* of the seating flange 632 is spaced apart from the seating portion 606*a*. When the sub-washing unit 620 rotates, the second portion of the seating flange 632 may come in contact with the inclined seating portion 606*b* such that the seating flange 632 may be prevented from excessively moving. The sub-washing unit 620 may rotate around the rotation support part 606*c*, and the sub-water drain port 130 is moved to a position lower than at the mounted state 620*a* such that the wash water inside the sub-washing unit 620 is discharged from the sub-washing unit 620. A state in which the sub-washing unit 620 rotates from the mounted state 620*a* and thus the wash water may be drained through the sub-water drain port 130 may be referred to as a discharge state 620*b*.

As above, after the sub-washing is finished, the sub-washing unit 620 may be rotated from the mounted state 620*a* to the discharge state 620*b* to discharge the wash water retained in the sub-washing unit 620 through the sub-water drain port 130.

Hereinafter, still another embodiment of a washing machine of the present disclosure will be described.

Description of configurations overlapping with the above description will be omitted.

Figure 36:
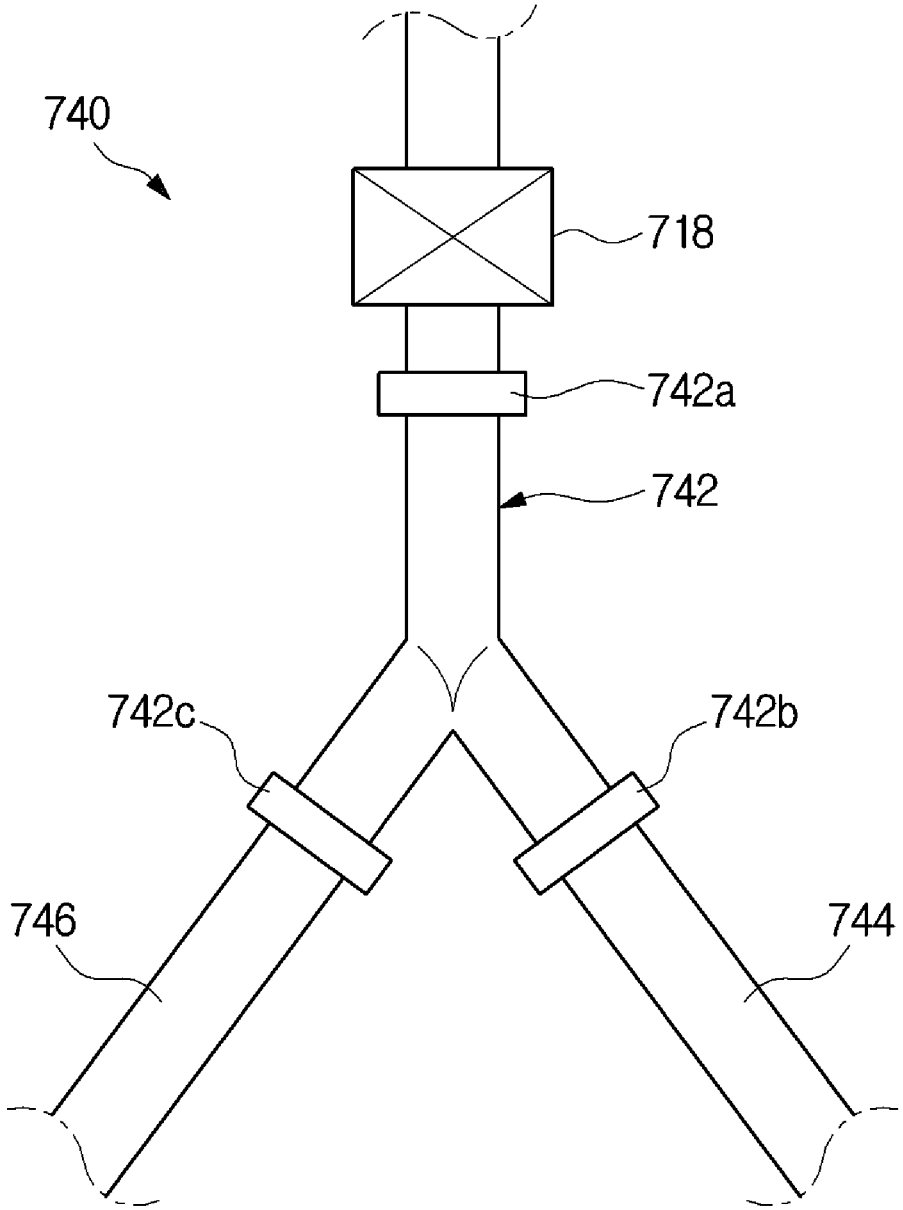
FIG. 36 is a view related to a configuration of a water supply device according to still another embodiment of the present disclosure.
Figure 37:
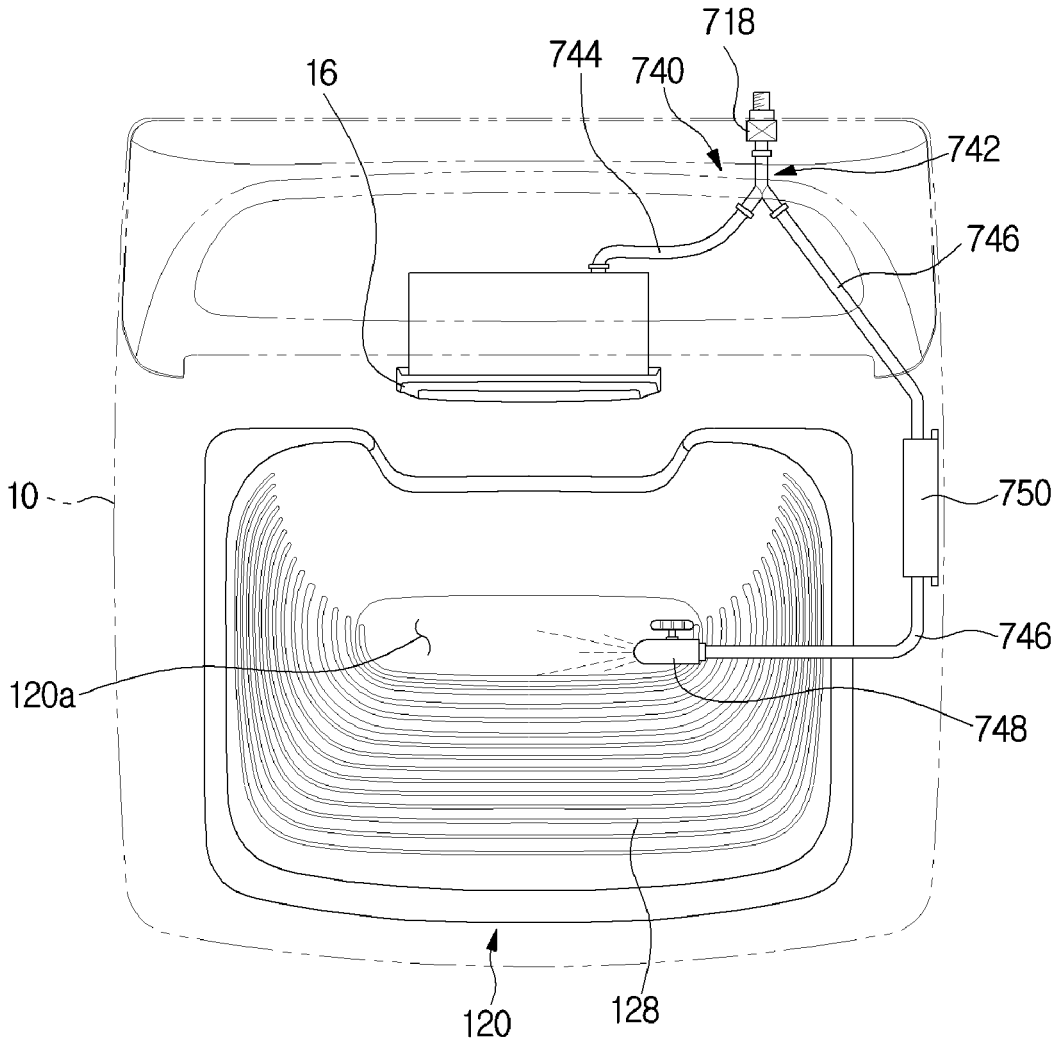
FIG. 37 is a view related to an arrangement of the water supply device according to still another embodiment of the present disclosure.

FIG. 36 is a view related to a configuration of a water supply device according to still another embodiment of the present disclosure, and FIG. 37 is a view related to an arrangement of the water supply device according to still another embodiment of the present disclosure.

The washing machine 1 may include a water supply device 740 for supplying water to the main washing space 11*a* and a sub-washing space 821. The water supply device 740 may include a water supply valve 718, a water supply pipe 742, a main water supply extension pipe 744 and a sub-water supply extension pipe 746.

As described above, the water supply valve 718 is configured to control wash water being introduced into the main body 10 from the outside.

The water supply pipe 742 is connected to the water supply valve 718 to guide wash water into the washing machine. The water supply pipe 742 may be formed in a Y-shape. An inlet part 742*a* of the water supply pipe 742 may be connected to the water supply valve 718, and outlet parts 742*b* and 742*c* thereof may include a first outlet part 742*b* connected to the main water supply extension pipe 744 and a second outlet part 742*c* connected to the sub-water supply extension pipe 746. The water supply pipe 742 branches wash water supplied as the water supply valve 718 is opened into the main water supply extension pipe 744 and the sub-water supply extension pipe 746 respectively connected to the first and second outlet parts 742*b* and 742*c* such that the wash water may be supplied to each of the main washing space 11*a* and the sub-washing space 821. By applying the water supply pipe 742 having a branched shape as above, water may be easily supplied to the sub-washing space 120*a*.

One end of the main water supply extension pipe 744 may be connected to the first outlet part 742*b* and the other end thereof may be connected to the detergent feed device 16. One end of the sub-water supply extension pipe 746 may be connected to the second outlet part 742*c* and the other end thereof may be connected to the sub-water supply port 60 (refer to FIG. 1).

The water supply device 740 may include the sub-water supply valve 748. The sub-water supply valve 748 may be provided at the other end of the sub-water supply extension pipe 746. The sub-water supply valve 748 may be configured to be fixed to the sub-water supply port 60, and as in this embodiment, may pass through the sub-water supply port 60 (refer to FIG. 1) to be exposed to the sub-washing space 120*a*.

The sub-water supply valve 748 may be provided at an end portion of the sub-water supply port 60 to control the amount of wash water discharged through the sub-water supply port 60. That is, the end portion of the sub-water supply port 60 may be opened and closed by the sub-water supply valve 748 to control the discharge of the wash water.

Since the sub-water supply extension pipe 746 may pass through the sub-water supply port 60 to be exposed to the sub-washing space 120*a* as described above, the sub-water supply extension pipe 746 may be applied to various ways of washing by adjusting the length of the sub-water supply extension pipe 746 being exposed. Also, although not illustrated in this embodiment, the sub-water supply extension pipe 746 may be mounted within the sub-washing space 821 by a mounting stand (not shown) on which an end portion of the sub-water supply extension pipe 746 may be mounted. By this configuration, wash water may be supplied throughout the sub-washing space 120*a* such that various washing modes may be realized.

In this embodiment, the wash water supply to the main washing space 11*a* and the sub-washing space 821 may be controlled by the water supply valve 718 and the sub-water supply valve 748.

When the water supply valve 718 is opened and the sub-water supply valve 748 is closed, wash water is supplied only to the main washing space 11*a* through the detergent feed device 16. When both of the water supply valve 718 and the sub-water supply valve 748 are open, the wash water is supplied to both of the main washing space 11*a* and the sub-washing space 120*a*.

The water supply device 740 may include an extension pipe guide 750. The extension pipe guide 750 is configured to fix the sub-water supply extension pipe 746 such that the sub-water supply extension pipe 746 does not move inside the main body 10. The shape of the extension pipe guide 750 is not limited and may be any shape so long as the extension pipe guide 750 supports the sub-water supply extension pipe 746 inside the main body 10.

Hereinafter, still another embodiment of a washing machine of the present disclosure will be described.

Description of configurations overlapping with the above description will be omitted.

Figure 38:
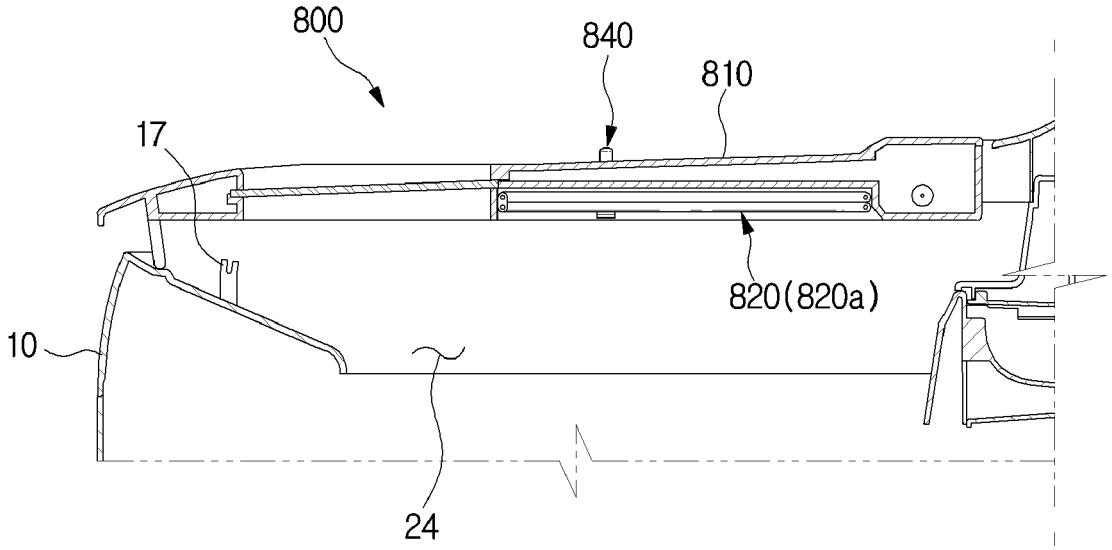
FIG. 38 is a cross-sectional view of a washing machine and a door assembly according to still another embodiment of the present disclosure.
Figure 39:
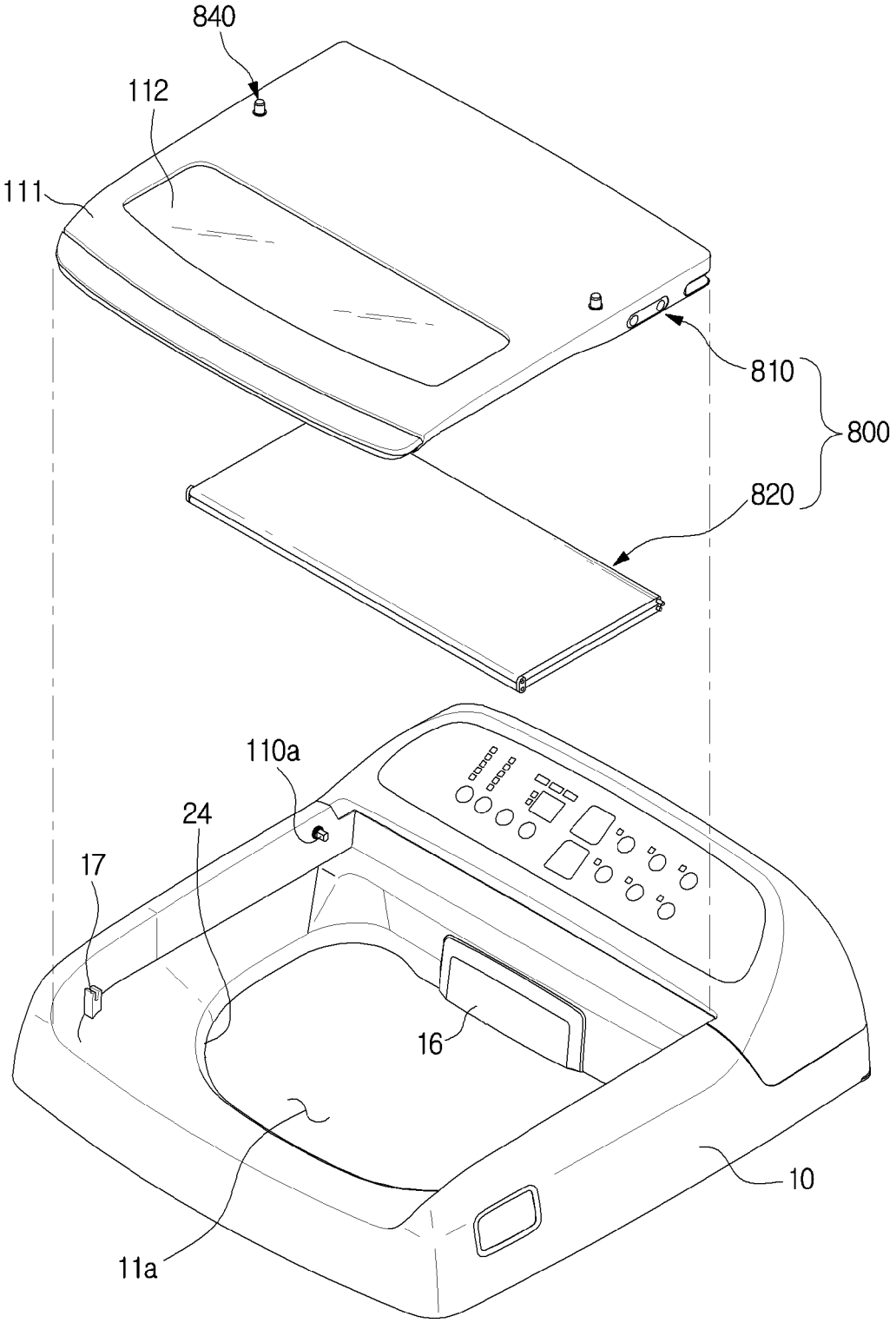
FIG. 39 is an exploded perspective view of the washing machine and the door assembly according to still another embodiment of the present disclosure.
Figure 40:
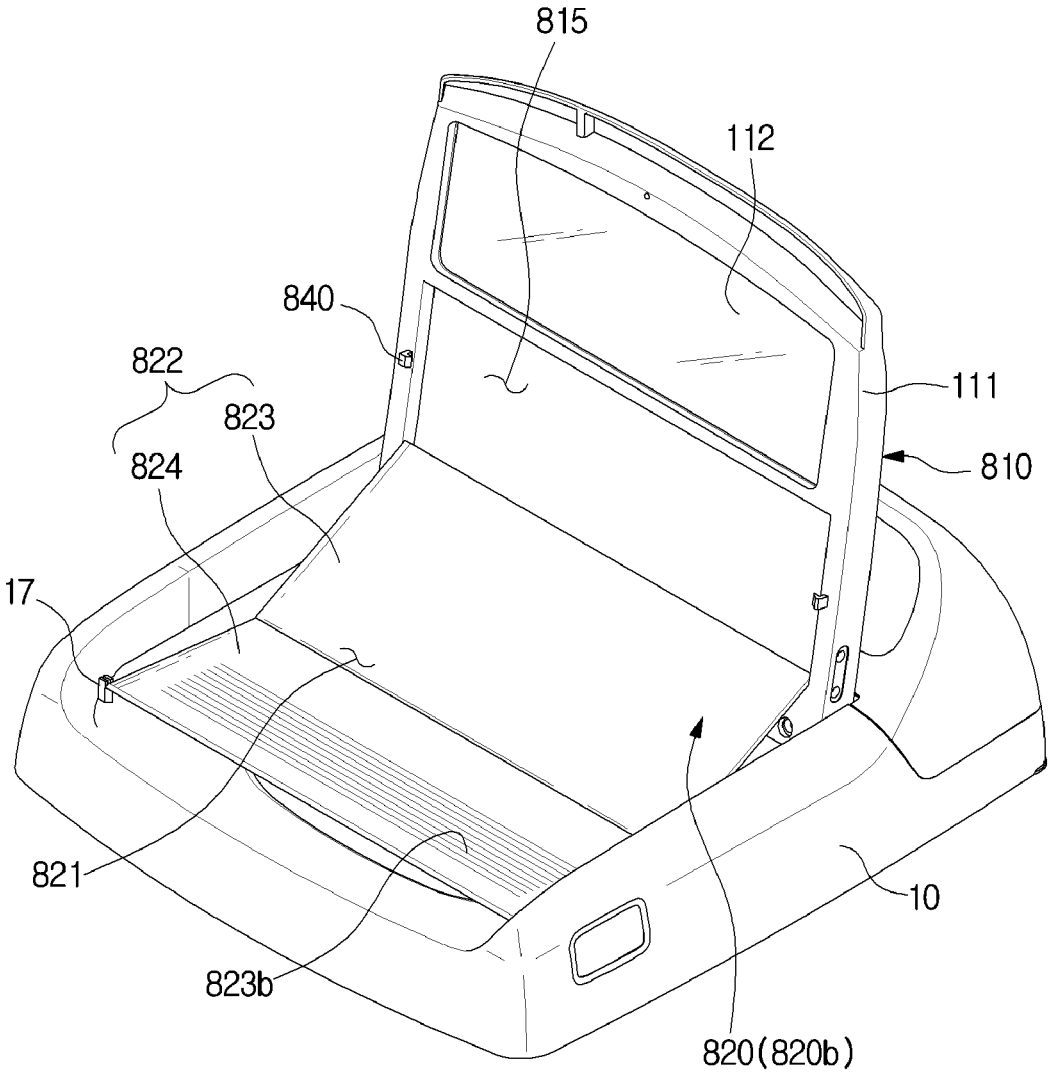
FIG. 40 is a perspective view of the washing machine and the door assembly according to still another embodiment of the present disclosure.
Figure 41:
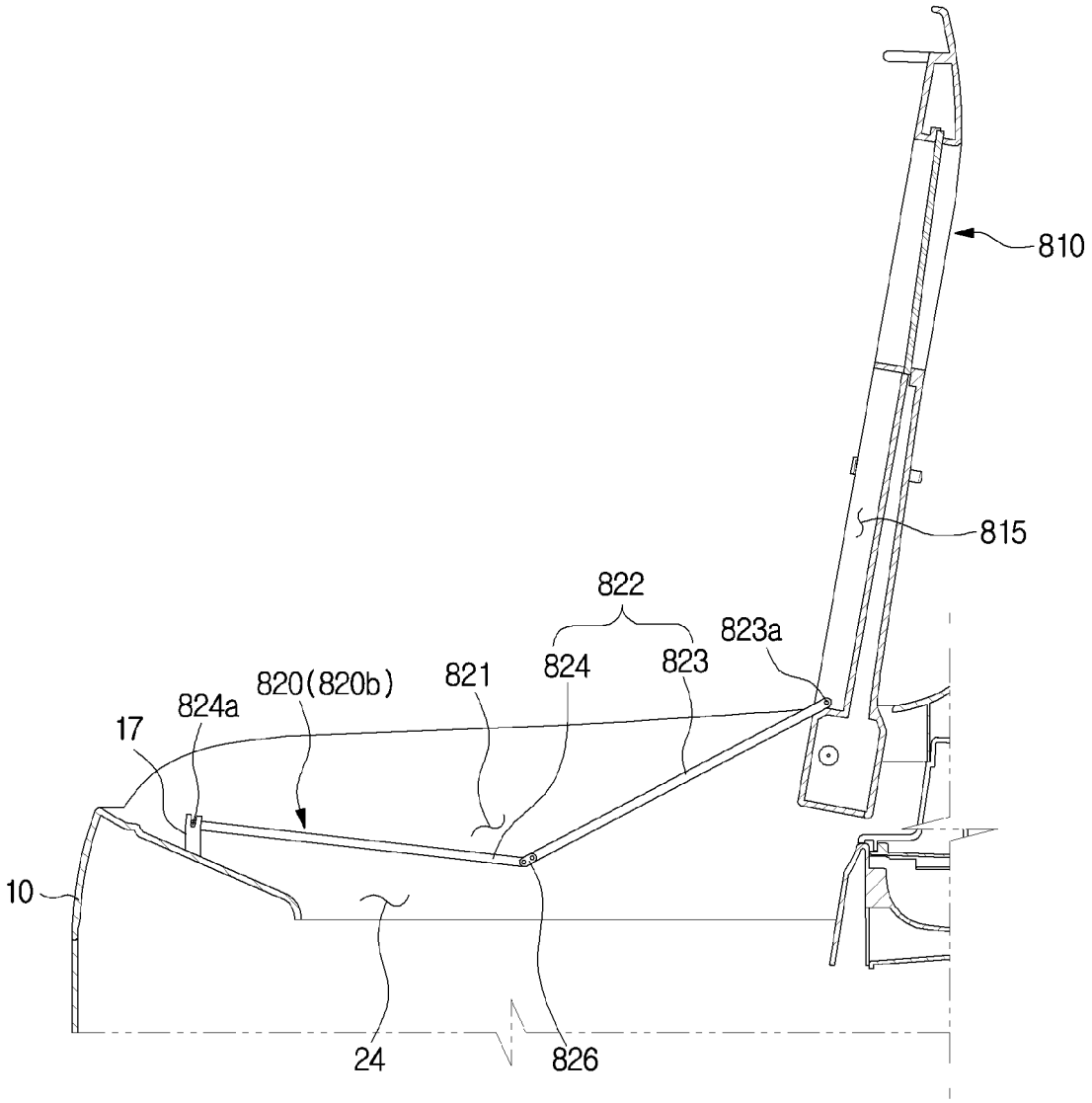
FIG. 41 is a cross-sectional view of the washing machine and the door assembly according to still another embodiment of the present disclosure.
Figure 42:
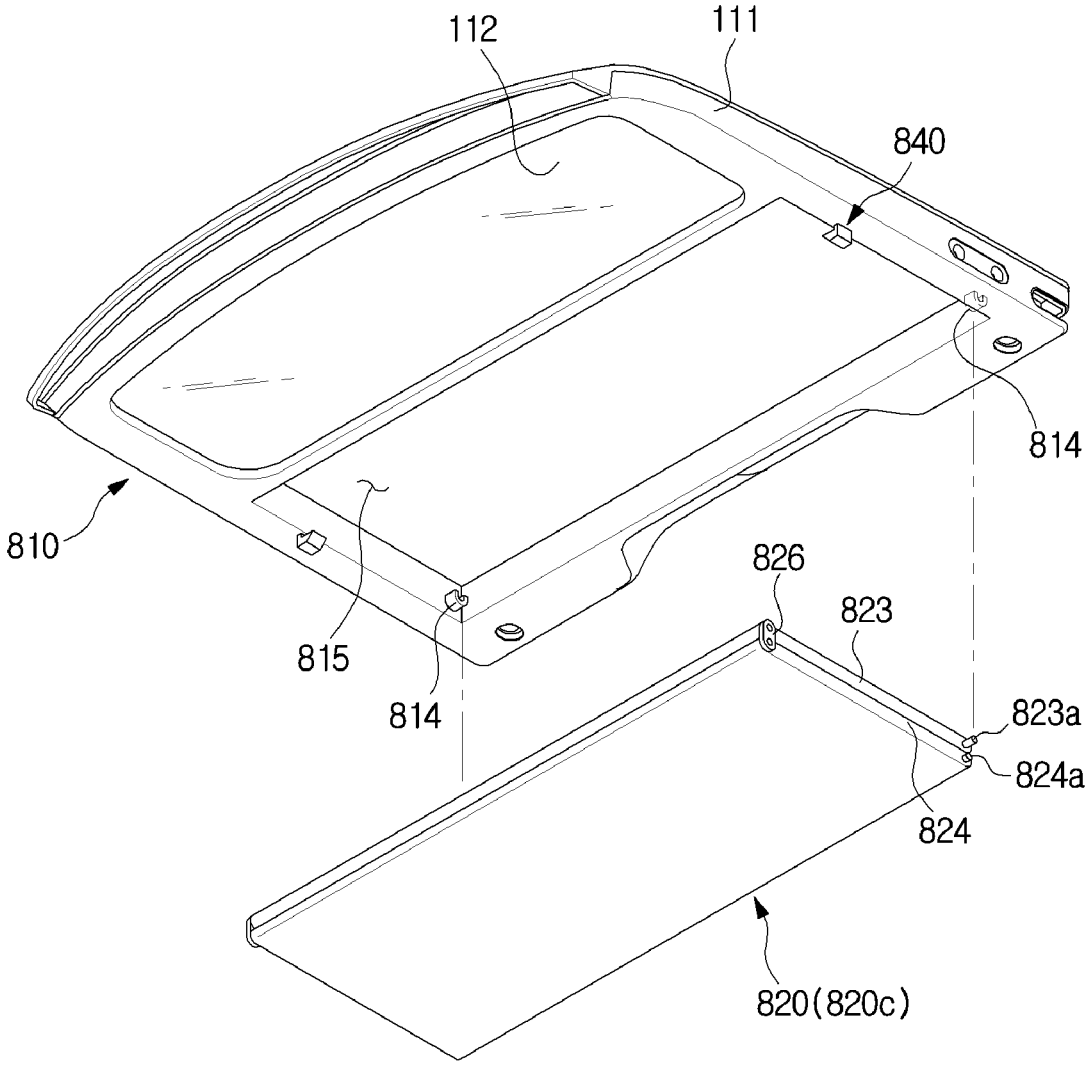
FIG. 42 is an exploded perspective view of the door assembly according to still another embodiment of the present disclosure.

FIG. 38 is a cross-sectional view of a washing machine and a door assembly according to still another embodiment of the present disclosure, FIG. 39 is an exploded perspective view of the washing machine and the door assembly according to still another embodiment of the present disclosure, FIG. 40 is a perspective view of the washing machine and the door assembly according to still another embodiment of the present disclosure, FIG. 41 is a cross-sectional view of the washing machine and the door assembly according to still another embodiment of the present disclosure, and FIG. 42 is an exploded perspective view of the door assembly according to still another embodiment of the present disclosure.

A door assembly 800 may include a door 810 and a sub-washing unit 820.

The sub-washing unit 820 is provided to enable separate hand-washing. The sub-washing unit 820 has the sub-washing space 821 to be described below to allow separate hand-washing. The sub-washing unit 820 may be separably coupled to the door 810. In this embodiment, the sub-washing unit 820 may be separably coupled to the door 810 and may be rotatably provided with respect to the door 810.

The sub-washing unit 820 may be provided to be insertable into the door 810. Specifically, a mounting space 815 on which the sub-washing unit 820 is mounted may be formed at the door 810, and the sub-washing unit 820 may be mounted on the mounting space 815 and move together with the door 810. The mounting space 815 may be provided at a rear surface of the door 810. The mounting space 815 may be formed at a portion recessed from a body of the door 810 in the size corresponding to the sub-washing unit 820.

The sub-washing unit 820 may include a unit body 822, and a unit hinge part 823*a* provided at one end of the unit body 822 to enable the sub-washing unit 820 to rotate with respect to the door 810. The unit hinge part 823*a* may be rotatably coupled with respect to a door hinge part 814 provided at the door 810. Also, the unit hinge part 823*a* may be formed in a shape of a pipe with one open portion to be separable from the door hinge part 814. By this configuration, the sub-washing unit 820 may rotate with respect to the door 810 and may be separated from the door 810.

The unit hinge part 823*a* is formed in a shape of a protrusion protruding from a first body 823, and the door hinge part 814 is formed in a shape of a pipe with one open portion to allow the unit hinge part 823*a* to be rotatable and separable. However, the shapes of the unit hinge part 823*a* and the door hinge part 814 are not limited thereto and may be any shapes so long as the unit hinge part 823*a* is formed to be rotatable and separable with respect to the door hinge part 814.

The unit body 822 may include the first body 823 at which the unit hinge part 823*a* is provided and a second body 824 rotatably coupled to the first body 823. That is, a body rotation part 826 may be provided between the first body 823 and the second body 824 such that the first body 823 and the second body 824 may be folded or unfolded. Friction protrusions 823*b* may be provided at the first body 823 and the second body 824 such that friction force between clothes and the friction protrusions 823*b* is increased when the user performs hand-washing in the sub-washing unit 820. Although the first and second bodies 823 and 824 are configured in the shape of a plate in this embodiment, the shapes of the first and second bodies 823 and 824 are not limited thereto. For example, the first and second bodies 823 and 824 may be formed in a shape of a concave bowl.

Referring to FIGS. 40 and 41, the unit body 822 may be unfolded while the door 810 is open, to form the sub-washing space 821. That is, the sub-washing unit 820 may move between a first state 820*a* (refer to FIG. 38) of being restrained by the door 810 and a second state 820*b* (refer to FIGS. 40 and 41) of being moved from the first state 820*a* to form the sub-washing space 821.

When the sub-washing unit 820 is at the second state 820*b*, the first body 823 and the second body 824 may be unfolded to form the sub-washing space 821 thereon.

When the sub-washing unit 820 is restrained by the door 810 at the first state 820*a*, at least a portion of the unit body 822 is configured to be restrained by a unit holding part 840.

A unit mounting part 824*a* may be provided at the second body 824. The unit mounting part 824*a* is provided to enable an end portion of the sub-washing unit 820 to be mounted on the main body 10 when the sub-washing unit 820 is at the second state 820*b*. A coupling part 17 is formed at the main body 10 to be coupled to the unit mounting part 824*a*.

The coupling part 17 may be provided at a front portion of the main body 10 to be adjacent to the opening 24, and the unit mounting part 824*a* may be provided at an end portion of the second body 824 to correspond to the coupling part 17. That is, the unit hinge part 823*a* may be provided at one end of the unit body 822 and the unit mounting part 824*a* may be provided at the other end thereof. However, the shapes and arrangements of the unit mounting part 824*a* and the coupling part 17 are not limited thereto.

In this embodiment, the unit mounting part 824*a* has a shape of a protrusion protruding from the second body 824 and the coupling part 17 protrudes from the main body 10 in a shape of a recessed groove for the unit mounting part 824*a* to be inserted thereinto.

When the sub-washing unit 820 is at the second state 820*b*, the first body 823 and the second body 824 may be configured to remain bent by a predetermined angle. The first body 823 and the second body 824 may be configured to be bent by a predetermined angle for the sub-washing space 821 to be stably formed thereon. The sum of a body length of the first body 823 and a body length of the second body 824 may be formed to be longer than a distance between the coupling part 17 of the cabinet and the door hinge part 814. By this configuration, the first body 823 and the second body 824 may remain bent by a predetermined angle.

In addition, when the sub-washing unit 820 is at the second state 820*b*, the body rotation part 826 is configured to be at a lower position than the first body 823 and the second body 824. That is, the body rotation part 826 provided between the first body 823 and the second body 824 may be disposed lower than the first and second bodies 823 and 824 to stably form the sub-washing space 821.

Referring to FIG. 42, the sub-washing unit 820 may move to a third state 820*c* of being separated from the door 810, along with the first state 820*a* and the second state 820*b*.

Specifically, the unit hinge part 823*a* of the first body 823 is formed in the shape of a protrusion protruding from the first body 823. The unit hinge part 823*a* is seated on the hinge coupling part 814 of the door 810 corresponding to the unit hinge part 823*a* while one portion of the hinge coupling part 814 is opened for the unit hinge part 823*a* to be separable from the hinge coupling part 814. The hinge coupling part 814 may be formed at the mounting space 815. By this, the sub-washing unit 820 may be separated from the door 810.

Figure 43:
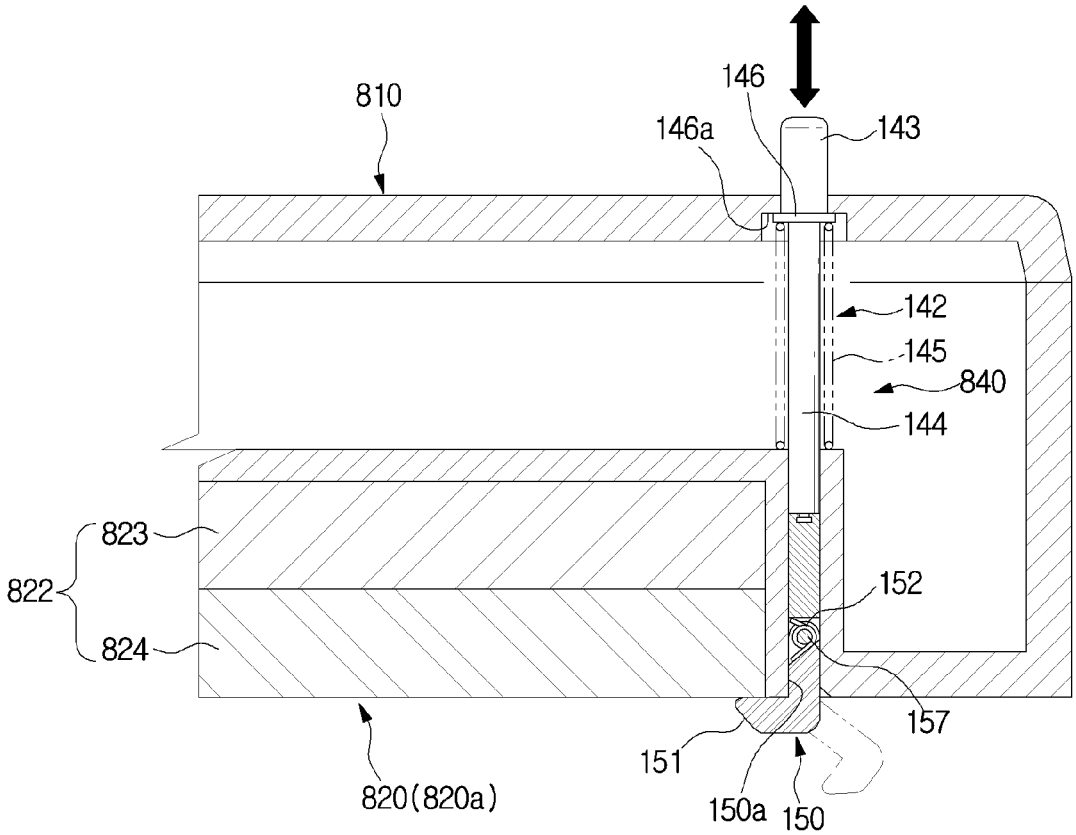
FIG. 43 is a cross-sectional view of the door assembly and a unit holding part according to still another embodiment of the present disclosure.

FIG. 43 is a cross-sectional view of the door assembly and a unit holding part according to still another embodiment of the present disclosure.

The door assembly 800 may include the unit holding part 840. Since description of the unit holding part 840 overlaps with the description of the previous configuration, some description will be omitted.

The locking part 150 of the unit holding part 840 is configured to restrain one portion of the sub-washing unit 820. The locking part 150 may be formed in a shape of a ring bent toward an inner portion of the door 810, and one portion of the sub-washing unit 820 may be restrained by the locking part 150. The locking part 150 comes in contact with the unit body 822 such that the sub-washing unit 820 may maintain the first state 820*a*.

The locking guide part 151 may be slantly formed at the ring-shaped end portion of the locking part 150 such that the locking part 150 is elastically deformed by a movement of the unit body 822.

The locking guide part 151 may be formed of an inclined surface tilted toward the inner portion of the door 810 with respect to a direction in which the sub-washing unit 820 is coupled to the door 810. By this configuration, the locking guide part 151 moves along the unit body 822 and elastically deforms the locking part 150 when the sub-washing unit 820 is being coupled to the door 810. When the unit body 822 moves to an inner portion of the locking part 150, the locking part 150 is elastically restored to restrain the unit body 822.

When the unit holding part 840 is at the restraining position 140*a* (refer to FIG. 6), the control elastic member 145 supports the control part 142 in a tensioned state and the locking part 150 is restrained by the rotation restraining part 150*a*. When the unit holding part 840 is at the releasing position 140*b* (refer to FIG. 7), the control part 142 is pressed such that the control elastic member 145 supports the control part 142 in a compressed state. As the control part 142 moves downward, the releasing of the locking part 150 by the rotation restraining part 150*a* is released and the locking part 150 rotates in a direction spacing apart from the unit body 822 by the locking elastic member 152.

Hereinafter, a movement of the unit holding part 840 will be described.

First, a movement of separating the sub-washing unit 820 from the door 810 will be described.

The unit holding part 840 is at the restraining position 140*a* (refer to FIG. 6) when an external force is not acted thereon. That is, the unit body 822 of the sub-washing unit 820 is restrained by the locking part 150.

Then, the unit holding part 840 moves to the releasing position 140*b* (refer to FIG. 7) from the restraining position 140*a* (refer to FIG. 6) when the external force is acted thereon. That is, when the control part 142 is pressed, the control elastic member 145 is compressed, and the locking part 150 moves downward. The locking part 150 rotates in the direction spacing apart from the unit body 822 by the locking elastic member 152, and restraining of the sub-washing unit 820 by the unit body 822 is released.

After the sub-washing unit 820 is separated from the locking part 150, when the external force is released, the control part 142 is elastically restored by the control elastic member 145, and the locking part 150 is restrained by the rotation restraining part 150*a* such that the unit holding part 840 moves to be restored to the restraining position 140*a*.

A movement of coupling the sub-washing unit 820 to the door 810 will be described.

When the sub-washing unit 820 is moved toward the door 810 for the locking part 150 to be locked to the unit body 822, the unit body 822 presses the locking guide part 151 of the locking part 150. The locking part 150 is pressed and elastically deformed by the unit body 822. When the unit body 822 passes through the locking guide part 151, the locking part 150 is elastically restored to restrain the unit body 822.

Hereinafter, still another embodiment of a washing machine of the present disclosure will be described.

Description of configurations overlapping with the above description will be omitted.

Figure 44:
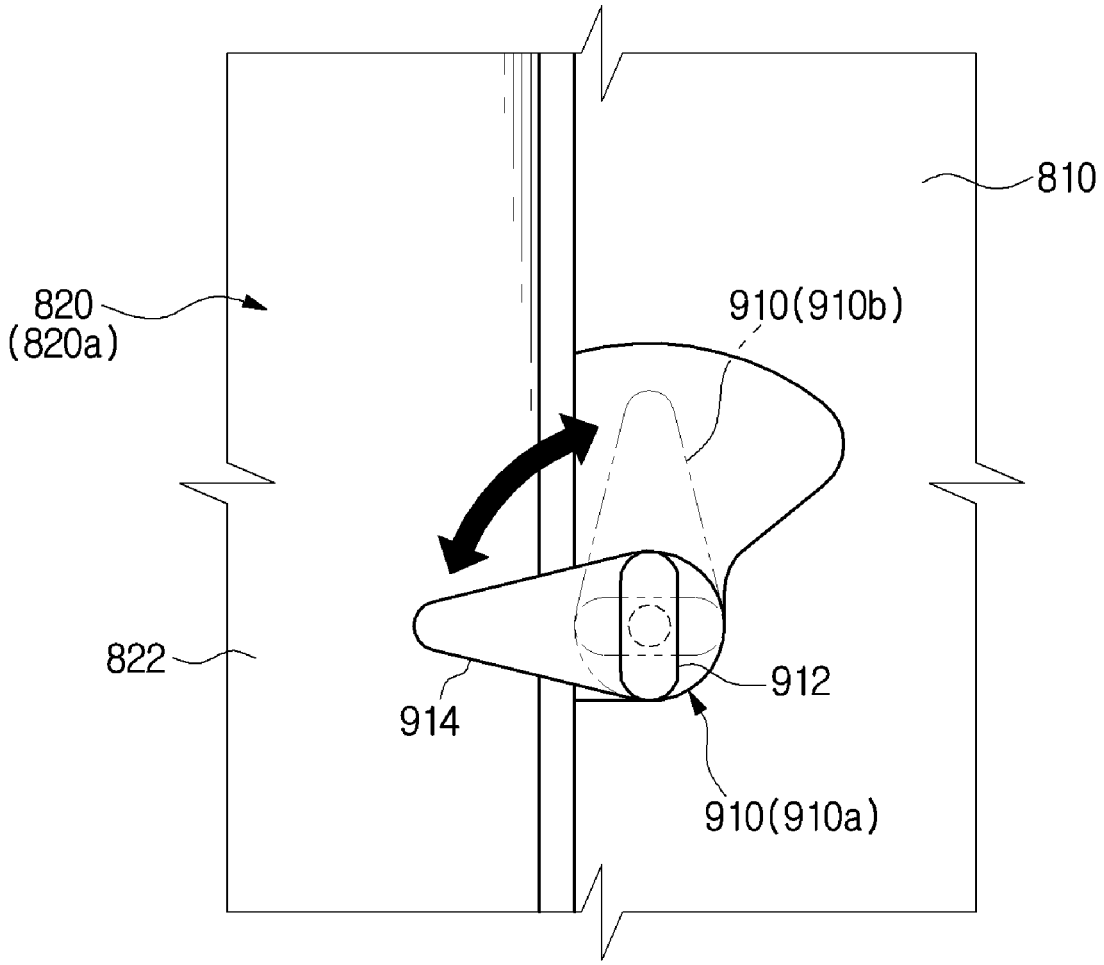
FIG. 44 is a front view of a unit holding part according to still another embodiment of the present disclosure.

FIG. 44 is a front view of a unit holding part according to still another embodiment of the present disclosure.

The door assembly 800 may include a unit holding part 910.

The unit holding part 910 may be provided at a lower surface of the door 810 and be disposed to be adjacent to at least one portion of the sub-washing unit 820. The sub-washing unit 820 may be separated from or mounted on the door 810 by manipulating the unit holding part 910.

The unit holding part 910 may include a handle part 912 and a holding lever 914. The handle part 912 is configured to be gripped to rotate the unit holding part 910. The shape of the handle part 912 is not limited.

The holding lever 914 may be integrally formed with the handle part 912. The holding lever 914 may rotate together with rotation of the handle part 912 such that the sub-washing unit 820 is selectively restrained by the door 810. The holding lever 914 may be formed to protrude in a direction perpendicular to a rotation axis of the unit holding part 910.

The unit holding part 910 is configured to move between a locking position 910*a* and an unlocking position 910*b*.

When the unit holding part 910 is at the locking position 910*a*, the holding lever 914 is configured to support one portion of the unit body 822. That is, when the unit holding part 910 is at the locking position 910*a*, the holding lever 914 comes in contact with one surface of the unit body 822 to restrain a movement of the unit body 822.

The unit holding part 910 may rotate and move from the locking position 910*a* to move to the unlocking position 910*b*. When the unit holding part 910 is at the unlocking position 910*b*, the holding lever 914 is configured to move to release the restraining of the unit body 822.

Hereinafter, still another embodiment of a washing machine of the present disclosure will be described.

Description of configurations overlapping with the above description will be omitted.

Figure 45:
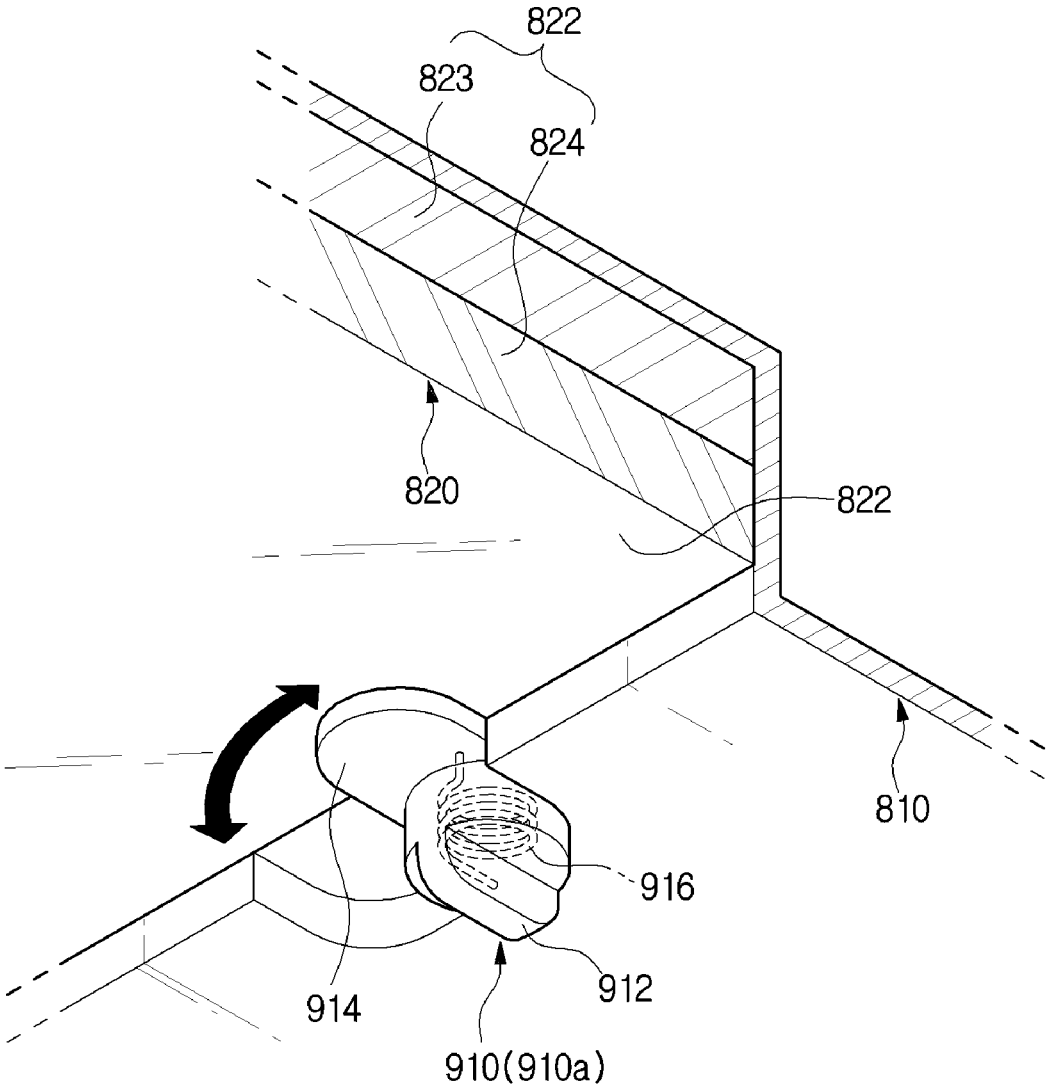
FIG. 45 is a perspective view of the unit holding part according to still another embodiment of the present disclosure.

FIG. 45 is a perspective view of the unit holding part according to still another embodiment of the present disclosure.

The door assembly 800 may include the unit holding part 910.

The unit holding part 910 may be provided at the lower surface of the door 810 and be disposed to be adjacent to at least one portion of the sub-washing unit 820. The sub-washing unit 820 may be separated from or mounted on the door 810 by manipulating the unit holding part 910.

The unit holding part 910 may include the handle part 912 and the holding lever 914. The handle part 912 is configured to be gripped to rotate the unit holding part 910. The shape of the handle part 912 is not limited.

The unit holding part 910 may include a restoring elastic member 916.

The restoring elastic member 916 may be configured to generate an elastic force in the circumferential direction around the rotation axis of the unit holding part 910. One end of the restoring elastic member 916 is fixed to the door 810, and the other end thereof includes a torsion spring that is fixed to one portion of the unit holding part 910 and has a magnitude of a rotary force varying in accordance with rotation of the unit holding part 910.

The unit holding part 910 may be elastically restored to the locking position 910*a* from the unlocking position 910*b* by the restoring elastic member 916.

Hereinafter, still another embodiment of a washing machine of the present disclosure will be described.

Description of configurations overlapping with the above description will be omitted.

Figure 46:
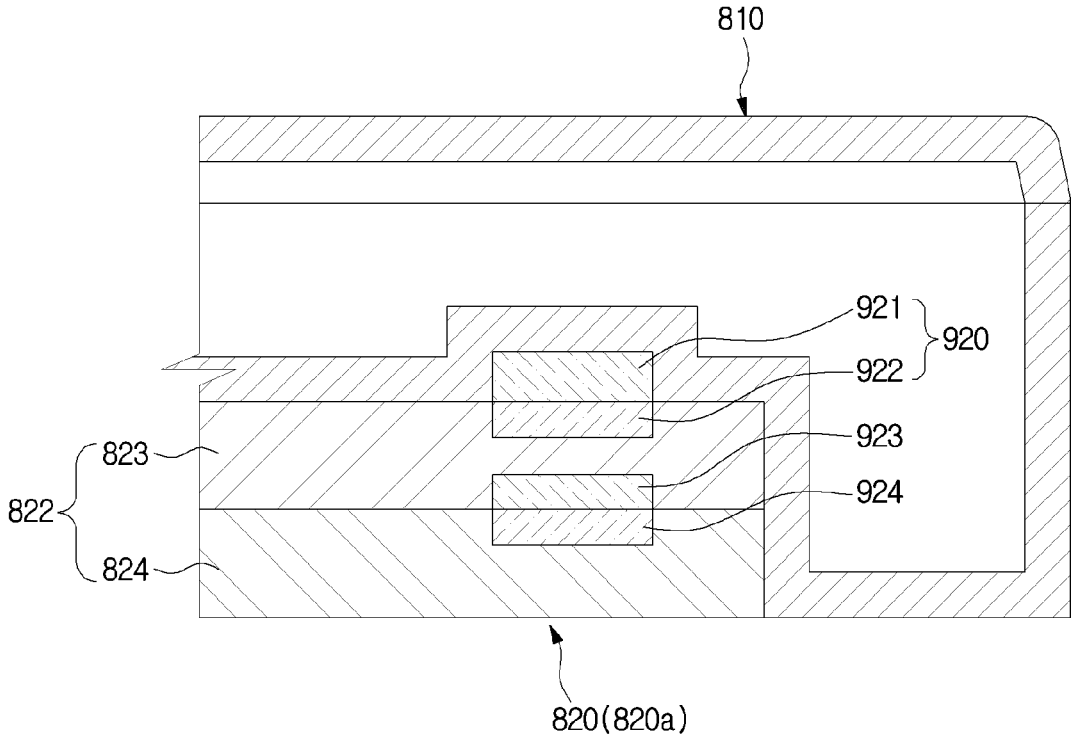
FIG. 46 is a cross-sectional view of a door assembly and a unit holding part according to still another embodiment of the present disclosure.

FIG. 46 is a cross-sectional view of the door assembly and the unit holding part according to still another embodiment of the present disclosure.

The door assembly 800 may include a unit holding part 920.

The unit holding part 920 may include a first holding part 921 provided at the door 810 and a second holding part 922 provided at the sub-washing unit 820. When the sub-washing unit 820 is at the first state 820*a*, the first and second holding parts 921 and 922 are configured to come in contact with each other.

The first and second holding parts 921 and 922 may include magnetic bodies. That is, when the sub-washing unit 820 is at the first state 820*a*, the first and second holding parts 921 and 922 enable the sub-washing unit 820 to maintain the first state 820*a* by an attractive force therebetween. When an external force greater than the attractive force is applied to the sub-washing unit 820 to make the sub-washing unit 820 and the door 810 spaced apart from each other, the sub-washing unit 820 may move to the second and third states 820*b* and 820*c* from the first state 820*a*.

The first holding part 921 may be disposed at the mounting space 815 of the door 810, and the second holding part 922 may be disposed at the unit body 822 facing the mounting space 815. However, the shapes and the arrangements of the first and second holding parts 921 and 922 are not limited thereto.

The door assembly 800 may include body holding parts 923 and 924. The body holding parts 923 and 924 are provided at the first body 823 and the second body 824, respectively, such that the first body 823 and the second body 824 may remain folded when the sub-washing unit 820 is at the first state 820*a*. Specifically, the body holding parts 923 and 924 include a first body holding part 923 provided at the first body 823 and a second body holding part 924 provided at the second body 824, and the first and second body holding parts 923 and 924 enable the sub-washing unit 820 to maintain the first state 820*a* by the attractive force therebetween.

Hereinafter, still another embodiment of a washing machine of the present disclosure will be described.

Description of configurations overlapping with the above description will be omitted.

Figure 47:
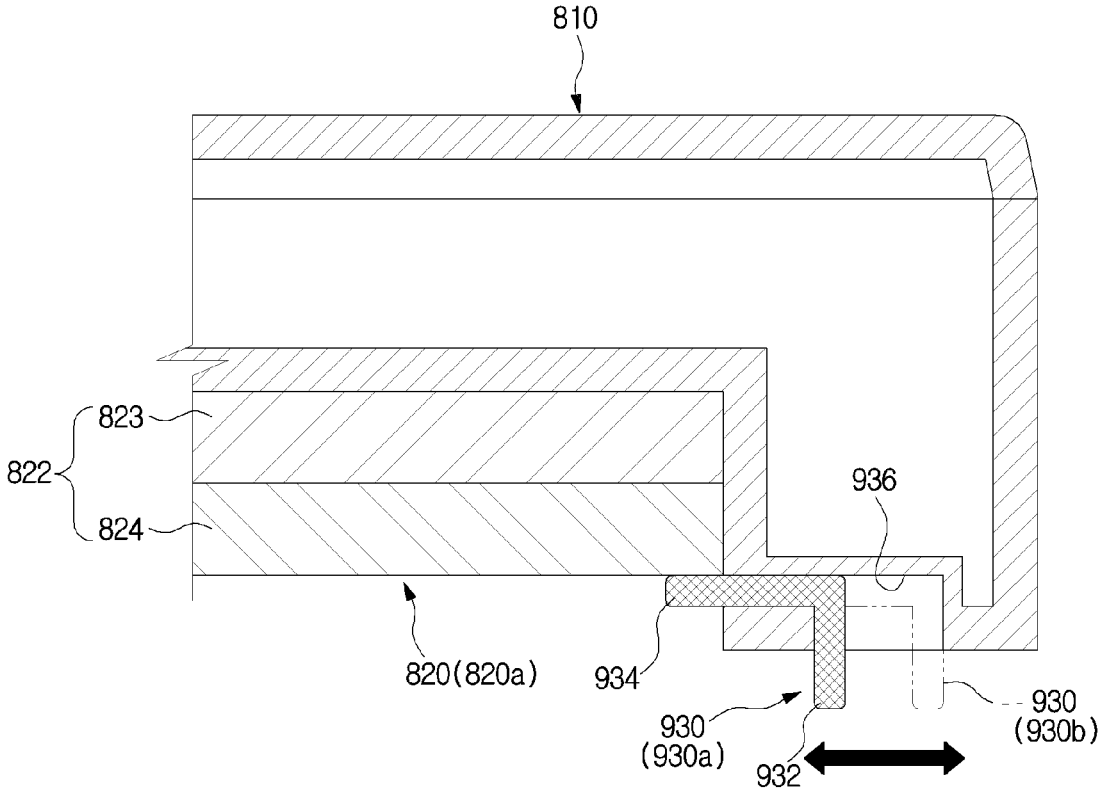
FIG. 47 is a cross-sectional view of a door assembly and a unit holding part according to still another embodiment of the present disclosure.

FIG. 47 is a cross-sectional view of a door assembly and a unit holding part according to still another embodiment of the present disclosure.

The door assembly 800 may include a unit holding part 930.

The unit holding part 930 may be provided at the lower surface of the door 810 and be disposed to be adjacent to at least one portion of the sub-washing unit 820. The sub-washing unit 820 may be separated from or mounted on the door 810 by manipulating the unit holding part 930.

The unit holding part 930 may include a handle part 932 and a sliding lever 934. The handle part 932 may be configured to be gripped to manipulate the sliding lever 934. The shape of the handle part 932 is not limited.

The sliding lever 934 may be integrally formed with the handle part 932. The sliding lever 934 may be configured to move together with the handle part 932 such that the sub-washing unit 820 is selectively restrained by the door 810.

A sliding rail 936 may be formed at the door 810 to enable the unit holding part 930 to move. The sliding rail 936 may be provided at a portion of the door 810 adjacent to the sub-washing unit 820. The sliding rail 936 may be formed inside a body of the door 810. However, embodiments are not limited thereto, and the sliding rail 936 may be formed at the rear surface of the door 810 to be exposed to the outside when the door 810 is opened.

The unit holding part 930 is configured to move between a locking position 930*a* and an unlocking position 930*b*. When the unit holding part 930 is at the locking position 930*a*, the sliding lever 934 is configured to support one portion of the unit body 822. That is, when the unit holding part 930 is at the locking position 930*a*, the sliding lever 934 comes in contact with one surface of the unit body 822 to restrain a movement of the unit body 822.

The unit holding part 930 may slide and move from the locking position 930*a* to move to the unlocking position 930*b*. When the unit holding part 930 is at the unlocking position 930*b*, the sliding lever 934 is configured to move to release the restraining of the unit body 822.

Hereinafter, still another embodiment of a washing machine of the present disclosure will be described.

Description of configurations overlapping with the above description will be omitted.

Figure 48:
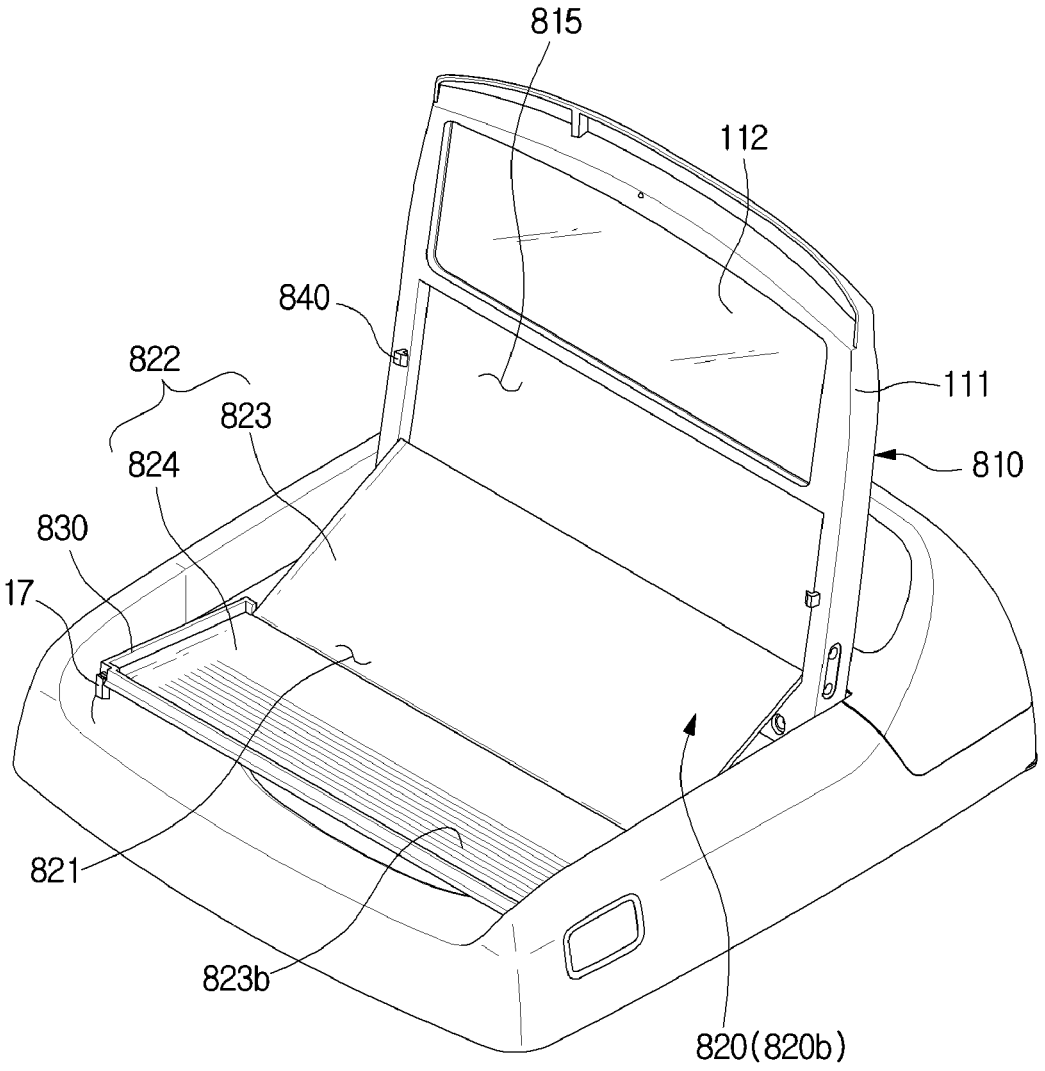
FIG. 48 is a perspective view of the washing machine and the door assembly according to still another embodiment of the present disclosure.

FIG. 48 is a perspective view of the washing machine and the door assembly according to still another embodiment of the present disclosure.

The unit body 822 of a different shape from the embodiment illustrated in FIG. 40 may be provided at the sub-washing unit 820.

The unit body 822 may include the first body 823 at which the unit hinge part 823*a* is provided and the second body 824 rotatably coupled to the first body 823. That is, the body rotation part 826 (refer to FIG. 41) may be provided between the first body 823 and the second body 824 such that the first body 823 and the second body 824 may folded or unfolded. Although not illustrated in the drawings, friction protrusions may be provided at the first body 823 and the second body 824 such that friction force between clothes and the friction protrusions is increased when the user performs hand-washing in the sub-washing unit 820.

The unit body 822 may include an edge portion 830. The edge portion 830 may be disposed along the circumference of the unit body 822. The edge portion 830 may be formed on at least a portion of circumferences of the first and second bodies. Although the edge portion 830 is formed along the circumference of the second body 824 in this embodiment, embodiments are not limited thereto. For example, the edge portion 830 may also be formed at the first body 823 or formed only at partial sections of the first and second bodies 823 and 824.

The edge portion 830 is formed in a shape of a rib perpendicular to the first and second bodies 823 and 824 to partition the sub-washing space 821 from surroundings. The edge portion 830 may be integrally formed with the first and second bodies 823 and 824. The edge portion 830 may guide clothes or wash water not to fall out from the sub-washing space 821.

In this embodiment, the edge portion 830 is formed along the circumference of the first body 823, and when the sub-washing unit 820 is at the first state 820*a*, the second body 824 is configured to be disposed at an inner portion of the edge portion 830. By reducing a volume occupied by the sub-washing unit 820 when the sub-washing unit 820 is not being used by the above configuration, the sub-washing unit 820 may be prevented from being interfered by the opening 24 of the main body 10.

Hereinafter, still another embodiment of a washing machine of the present disclosure will be described.

Description of configurations overlapping with the above description will be omitted.

Figure 49:
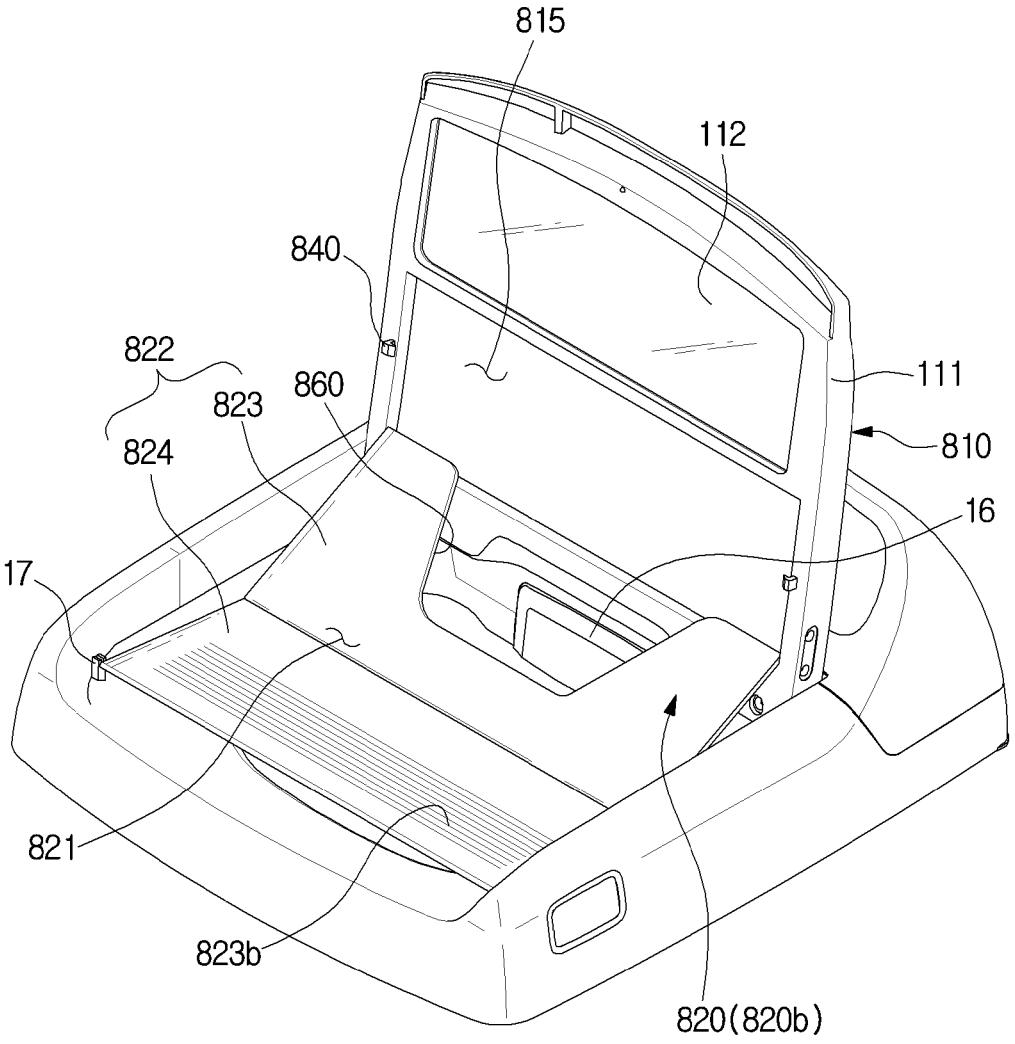
FIG. 49 is a perspective view of the washing machine and the door assembly according to still another embodiment of the present disclosure.

FIG. 49 is a perspective view of the washing machine and the door assembly according to still another embodiment of the present disclosure.

In the embodiment illustrated in FIG. 40, the sub-washing unit 820 may include a sub-water drain port 860. The sub-water drain port 860 is configured such that wash water used in washing in the sub-washing space 821 is drained. The sub-water drain port 860 may be formed in the shape of a hole and may be disposed at a bottom portion of the sub-washing space 821 while having a separate opening-and-closing member. In the embodiment of the present disclosure, the sub-water drain port 860 is provided on the first body 823 of the unit body 822. The sub-water drain port 860 is configured to enable the wash water retained in the sub-washing space 821 to be tilted and discharged when the sub-washing unit 820 rotates.

The sub-water drain port 860 may be formed at a portion adjacent to the detergent feed device 16 at the first body 823. By this configuration, even when the sub-washing unit 820 is at the second state 820*b*, the detergent feed device 16 being opened and closed by the sub-washing unit 820 is not interfered. That is, the sub-water drain port 860 may have the size corresponding to the detergent feed device 16 and may be provided on the first body 823.

According to the present disclosure, a washing machine enables sub-washing such as hand-washing.

In addition, sub-washing is possible independent of a conventional washing method, thereby improving washing efficiency.

In addition, a sub-washing unit is separably provided such that the sub-washing unit for sub-washing may be conveniently operated.

In addition, the sub-washing unit is easily detachable, thereby improving space utilization.

In the above, particular embodiments have been illustrated and described. However, the present disclosure is not limited to the above embodiments, and those of ordinary skill in the art to which the present disclosure pertains will be able to modify and practice the present disclosure in various ways without departing from the gist of the technical spirit of the disclosure defined by the claims below.

What is claimed is:

1. A washing machine comprising:

a main body having an opening through which laundry is receivable into a main washing space of the washing machine;

a detergent feed device;

a unit body forming a sub-washing space;

a water supply valve to regulate inflow of water from outside to the main body;

a water supply pipe including an inlet part connected to the water supply valve, and first and second outlet parts branching from the inlet part; and a sub-water supply pipe, wherein the detergent feed device, the water supply valve and the water supply pipe are arranged so that water regulated by the water supply valve is flowable through the inlet to the first outlet part, then through the first outlet part to the detergent feed device, and then through the detergent feed device to the main washing space; and the unit body is rotatable from a first position at which the unit body is seated over the opening and aligned with the sub-water supply pipe so that water regulated by the water supply valve is flowable through the inlet to the second outlet part, and then through the second outlet part to be received into the sub-washing space, to a second position at which the unit body is unseated from being seated over the opening, and is no longer aligned with the sub-water supply pipe.

2. The washing machine according to claim 1, wherein, when the unit body is rotated from the first position to the second position, water in the sub-washing space is discharged into the main washing space.

3. The washing machine according to claim 2, further comprising:

a rotary protrusion disposed on a side of the unit body, and, when the unit body rotates from the first position to the second position, a front end of the unit body is lifted and the rear end of the unit body is lowered.

4. The washing machine according to claim 3, wherein the unit body includes a drain port formed at the rear end of the unit body.

5. The washing machine according to claim 4, wherein the rotary protrusion is disposed in front of the drain port.

6. The washing machine according to claim 4, wherein, when the unit body is in the second position, the drain port is located lower than when the unit body is in the first position.

7. The washing machine according to claim 2, further comprising:

a rotation support part provided on the main body, wherein the unit body includes a rotary protrusion protruding from the unit body, and that is rotatably supported on the rotation support part so that the unit body is rotatable from the first position to the second position, and the main body includes a seating portion on which the unit body is seated when in the first position and on which the rotation support part is disposed.

8. The washing machine according to claim 7, wherein the rotary protrusion is disposed at a side of the unit body.

9. The washing machine according to claim 7, wherein the unit body is spaced apart from the seating portion when the unit body is in the second position.

10. The washing machine according to claim 7, wherein the rotation support part includes:

a protrusion insertion part into which the rotary protrusion is inserted, and a protrusion support part that supports the protrusion insertion part from the seating portion such that the protrusion insertion part is spaced from the seating portion.

11. The washing machine according to claim 10, wherein the rotary protrusion is detachable from the protrusion insertion part so that the unit body is detachable from the main body.

12. The washing machine according to claim 10, wherein the protrusion insertion part is opened upward.

13. The washing machine according to claim 1, wherein the water supply pipe is formed in a Y shape.

14. The washing machine according to claim 1, wherein the unit body forms a water inlet that, when the unit body is in the first position, is aligned with the sub-water supply pipe so that water regulated by the water supply valve is flowable through the inlet to the second outlet part, and then through the second outlet part to be received into the sub-washing space through the water inlet, and when the unit body is in the second position, is no longer aligned with the sub-water supply pipe.

* * * * *